US008776894B2

(12) United States Patent
Orbell et al.

(10) Patent No.: US 8,776,894 B2
(45) Date of Patent: Jul. 15, 2014

(54) OFFSHORE UNIVERSAL RISER SYSTEM

(75) Inventors: Charles R. Orbell, Melbourne Beach, FL (US); Christian Leuchtenberg, Singapore (SG); Craig W. Godfrey, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/542,781

(22) Filed: Jul. 6, 2012

(65) Prior Publication Data

US 2012/0285697 A1 Nov. 15, 2012

Related U.S. Application Data

(62) Division of application No. 12/299,411, filed as application No. PCT/US2007/083974 on Nov. 7, 2007.

(60) Provisional application No. 60/864,712, filed on Nov. 7, 2006.

(51) Int. Cl.
*E21B 17/01* (2006.01)

(52) U.S. Cl.
USPC ..... 166/367; 166/350; 166/345; 166/359; 166/369

(58) Field of Classification Search
USPC ..... 166/334, 339, 344, 345, 359, 367
See application file for complete search history.

(56) References Cited

U.S. PATENT DOCUMENTS 3,362,487 A 1/1968 Lindsey
3,387,851 A 6/1968 Cugini
3,429,385 A 2/1969 Jones et al.
3,443,643 A 5/1969 Jones
3,552,502 A 1/1971 Wilson
3,603,409 A 9/1971 Watkins
3,815,673 A 6/1974 Bruce et al.
3,827,511 A 8/1974 Jones (Continued)

FOREIGN PATENT DOCUMENTS

EP 0881357 A2 12/1998
EP 1240404 B1 12/2003

(Continued)

OTHER PUBLICATIONS

International Search Report with Written Opinion issued Nov. 21, 2011 for PCT Patent Application No. PCT/US11/036616, 13 pages.

(Continued)

*Primary Examiner* — James Sayre
(74) *Attorney, Agent, or Firm* — Smith IP Services, P.C.

(57) ABSTRACT

An offshore universal riser system may include a valve module which selectively permits and prevents fluid flow through a flow passage extending longitudinally through a riser string. An anchoring device may releasably secure the valve module in the passage. A method of constructing a riser system may include the steps of installing the valve module in the passage, and installing at least one annular seal module in the passage. The annular seal module may prevent fluid flow through an annular space between the riser string and a tubular string positioned in the passage. Drilling methods may include injecting relatively low density fluid compositions into the annular space, and selectively varying a restriction to flow through a subsea choke in a drilling fluid return line. The riser string, including housings for the various modules and external control systems, may be dimensioned for installation through a rotary table.

4 Claims, 35 Drawing Sheets

(56) References Cited

U.S. PATENT DOCUMENTS 3,971,926 A 7/1976 Gau et al.
4,046,191 A 9/1977 Neath
4,063,602 A 12/1977 Howell et al.
4,091,881 A 5/1978 Maus
4,099,583 A 7/1978 Maus
4,194,567 A 3/1980 Marais
4,234,043 A * 11/1980 Roberts ..... 166/336
4,291,772 A 9/1981 Beynet
4,436,157 A * 3/1984 Brooks ..... 166/344
4,468,056 A 8/1984 Kramer et al.
4,502,534 A 3/1985 Roche et al.
4,626,135 A 12/1986 Roche
4,682,913 A * 7/1987 Shatto et al. ..... 405/169
4,685,521 A * 8/1987 Raulins ..... 166/341
4,813,495 A 3/1989 Leach
4,832,126 A 5/1989 Roche
4,848,473 A 7/1989 Lochte
4,880,060 A 11/1989 Schwendemann et al.
5,006,845 A 4/1991 Calcar et al.
5,010,956 A 4/1991 Bednar
5,154,078 A 10/1992 Codazzi
5,303,582 A 4/1994 Miska
5,444,619 A 8/1995 Hoskins et al.
5,771,971 A 6/1998 Horton et al.
5,771,974 A * 6/1998 Stewart et al. ..... 166/336
5,934,371 A 8/1999 Bussear et al.
6,002,985 A 12/1999 Stephenson
6,012,015 A 1/2000 Tubel
6,021,377 A 2/2000 Dubinsky et al.
6,035,952 A 3/2000 Bradfield et al.
6,053,252 A 4/2000 Edwards
6,065,550 A 5/2000 Gardes
6,101,447 A 8/2000 Poe, Jr.
6,102,673 A 8/2000 Mott et al.
6,125,936 A 10/2000 Swisher
6,138,774 A 10/2000 Bourgoyne, Jr. et al.
6,173,768 B1 1/2001 Watson
6,230,824 B1 5/2001 Peterman et al.
6,263,982 B1 7/2001 Hannegan et al.
6,273,193 B1 8/2001 Hermann et al.
6,325,159 B1 12/2001 Peterman et al.
6,328,107 B1 12/2001 Maus
6,450,262 B1 9/2002 Regan
6,454,022 B1 9/2002 Sangesland et al.
6,457,540 B2 10/2002 Gardes
6,470,975 B1 10/2002 Bourgoyne et al.
6,474,422 B2 11/2002 Schubert et al.
6,527,062 B2 3/2003 Elkins et al.
6,571,873 B2 6/2003 Maus
6,585,044 B2 7/2003 Rester et al.
6,598,682 B2 7/2003 Johnson et al.
6,662,110 B1 12/2003 Bargach et al.
6,668,943 B1 12/2003 Maus et al.
6,732,798 B2 5/2004 Johnson et al.
6,732,804 B2 5/2004 Hosie et al.
6,739,397 B2 5/2004 Ayling
6,745,857 B2 6/2004 Gjedebo
6,802,379 B2 10/2004 Dawson et al.
6,814,140 B2 11/2004 Robichaux
6,820,702 B2 11/2004 Niedermayr et al.
6,840,322 B2 1/2005 Haynes et al.
6,853,921 B2 2/2005 Thomas et al.
6,854,532 B2 2/2005 Fincher et al.
6,892,812 B2 5/2005 Niedermayr et al.
6,901,391 B2 5/2005 Storm, Jr. et al.
6,904,981 B2 6/2005 Van Riet
6,913,092 B2 7/2005 Bourgoyne et al.
6,920,085 B2 7/2005 Finke et al.
6,920,942 B2 7/2005 Koederitz
6,926,101 B2 8/2005 DeBoer
6,981,561 B2 1/2006 Krueger et al.
7,023,691 B1 4/2006 Feight et al.
7,032,691 B2 4/2006 Humphreys
7,044,237 B2 5/2006 Leuchtenberg
7,055,627 B2 6/2006 Fontana et al.
7,073,591 B2 7/2006 Massie et al.
7,079,952 B2 7/2006 Thomas et al.
7,080,685 B2 7/2006 Bailey et al.
7,090,036 B2 8/2006 DeBoer
7,093,662 B2 8/2006 DeBoer
7,096,975 B2 8/2006 Aronstam et al.
7,114,571 B2 10/2006 Gatherar et al.
7,134,489 B2 11/2006 Van Riet
7,158,886 B2 1/2007 Hou et al.
7,159,669 B2 1/2007 Bourgoyne et al.
7,165,610 B2 1/2007 Hopper
7,174,975 B2 2/2007 Krueger et al.
7,185,718 B2 3/2007 Gardes
7,185,719 B2 3/2007 Van Riet
7,201,231 B2 4/2007 Chaplin et al.
7,207,399 B2 4/2007 Duhe et al.
7,237,613 B2 7/2007 Radi et al.
7,237,623 B2 7/2007 Hannegan
7,258,171 B2 8/2007 Bourgoyne et al.
7,264,058 B2 9/2007 Fossli
7,270,185 B2 9/2007 Fontana et al.
7,278,496 B2 10/2007 Leuchtenberg
7,281,593 B2 10/2007 Steiner et al.
7,350,597 B2 4/2008 Reitsma et al.
7,353,887 B2 4/2008 Krueger et al.
7,367,410 B2 5/2008 Sangesland
7,367,411 B2 5/2008 Leuchtenberg
7,395,878 B2 7/2008 Reitsma
7,407,019 B2 8/2008 Kinder et al.
7,487,837 B2 2/2009 Bailey et al.
7,497,266 B2 3/2009 Fossli
7,513,310 B2 4/2009 Fossli
7,562,723 B2 7/2009 Reitsma
7,610,251 B2 10/2009 Shayegi et al.
7,650,950 B2 1/2010 Leuchtenberg
7,658,228 B2 2/2010 Moksvold
7,677,329 B2 3/2010 Stave
7,708,064 B2 5/2010 Sehsah
7,721,822 B2 5/2010 Krueger
7,806,203 B2 10/2010 Krueger et al.
7,913,774 B2 3/2011 Partouche
7,926,593 B2 4/2011 Bailey et al.
7,997,345 B2 8/2011 Hannegan
8,033,335 B2 10/2011 Orbell et al.
8,201,628 B2 6/2012 Lovorn et al.
8,322,432 B2 12/2012 Bailey et al.
8,397,836 B2 3/2013 Pool et al.
2001/0047885 A1 12/2001 Calder
2001/0050185 A1 12/2001 Calder et al.
2002/0011338 A1 1/2002 Maurer et al.
2002/0092655 A1 7/2002 Fincher et al.
2002/0108783 A1 8/2002 Elkins et al.
2002/0112888 A1 8/2002 Leuchtenberg
2003/0066650 A1 4/2003 Fontana et al.
2003/0070840 A1 4/2003 Boer
2003/0079912 A1 5/2003 Leuchtenberg
2003/0089498 A1 5/2003 Johnson et al.
2003/0098181 A1 5/2003 Aronstam et al.
2003/0106712 A1 * 6/2003 Bourgoyne et al. ..... 175/5
2003/0110017 A1 6/2003 Guthrie et al.
2003/0111799 A1 6/2003 Gilmore
2003/0127230 A1 7/2003 Von Eberstein, Jr. et al.
2003/0139916 A1 7/2003 Choe et al.
2003/0170077 A1 9/2003 Herd et al.
2003/0220742 A1 11/2003 Niedermayr et al.
2004/0040746 A1 3/2004 Niedermayr et al.
2004/0065440 A1 4/2004 Farabee et al.
2004/0124008 A1 7/2004 Fincher et al.
2004/0178001 A1 9/2004 Bourgoyne et al.
2004/0206548 A1 10/2004 Aronstam et al.
2005/0061499 A1 3/2005 Hopper
2005/0061546 A1 3/2005 Hannegan
2005/0092522 A1 5/2005 Humphreys
2005/0092523 A1 5/2005 McCaskill et al.
2005/0096848 A1 5/2005 Hou et al.
2005/0252286 A1 11/2005 Ibrahim et al.
2006/0006004 A1 1/2006 Terry et al.
2006/0021755 A1 2/2006 Radi et al.
2006/0065402 A9 3/2006 Fontana et al.

(56) References Cited

U.S. PATENT DOCUMENTS

| | | | |
|---|---|---|---|
| 2006/0070772 | A1 | 4/2006 | DeBoer |
| 2006/0086538 | A1 | 4/2006 | Van Riet |
| 2006/0100836 | A1 | 5/2006 | Singh |
| 2006/0102387 | A1 | 5/2006 | Bourgoyne et al. |
| 2006/0169491 | A1 | 8/2006 | Fossli |
| 2006/0185857 | A1 | 8/2006 | York et al. |
| 2006/0191716 | A1 | 8/2006 | Humphreys |
| 2006/0207795 | A1 | 9/2006 | Kinder et al. |
| 2007/0068704 | A1 | 3/2007 | Krueger et al. |
| 2007/0168056 | A1 | 7/2007 | Shayegi et al. |
| 2007/0240875 | A1 | 10/2007 | Van Riet |
| 2007/0278007 | A1 | 12/2007 | Krueger et al. |
| 2008/0041149 | A1 | 2/2008 | Leuchtenberg |
| 2008/0060846 | A1 | 3/2008 | Belcher et al. |
| 2008/0105434 | A1 | 5/2008 | Orbell et al. |
| 2009/0101351 | A1 | 4/2009 | Hannegan |
| 2009/0139724 | A1 | 6/2009 | Gray et al. |
| 2009/0211239 | A1 | 8/2009 | Askeland |
| 2010/0018715 | A1 | 1/2010 | Orbell et al. |
| 2011/0024189 | A1 | 2/2011 | Saeed et al. |
| 2011/0139464 | A1 | 6/2011 | Henderson et al. |
| 2011/0139506 | A1 | 6/2011 | Lovorn et al. |
| 2011/0139509 | A1 | 6/2011 | Pool et al. |
| 2011/0214882 | A1 | 9/2011 | Santos |
| 2011/0259612 | A1 | 10/2011 | Lovorn et al. |
| 2011/0290562 | A1 | 12/2011 | Standifird et al. |
| 2012/0061087 | A1 | 3/2012 | Iblings et al. |
| 2012/0103610 | A1 | 5/2012 | Turner et al. |
| 2012/0168171 | A1 | 7/2012 | Varpe |
| 2012/0186873 | A1 | 7/2012 | Shayegi et al. |
| 2012/0241217 | A1 | 9/2012 | Davis et al. |
| 2012/0242920 | A1 | 9/2012 | Xu et al. |
| 2012/0251407 | A1 | 10/2012 | Petela et al. |
| 2012/0255776 | A1 | 10/2012 | Knudsen et al. |
| 2012/0255777 | A1 | 10/2012 | Bernard |
| 2012/0285744 | A1 | 11/2012 | Bernard |

FOREIGN PATENT DOCUMENTS

| | | | |
|---|---|---|---|
| EP | 1071862 | B1 | 11/2004 |
| EP | 1356186 | B1 | 6/2005 |
| EP | 1664478 | B1 | 12/2005 |
| EP | 1432887 | B1 | 3/2006 |
| EP | 1595057 | B1 | 7/2006 |
| EP | 1488073 | B1 | 8/2006 |
| EP | 1907664 | A1 | 4/2008 |
| EP | 1917444 | A1 | 5/2008 |
| EP | 1969204 | A2 | 9/2008 |
| EP | 2053196 | A1 | 4/2009 |
| EP | 2150681 | A1 | 2/2010 |
| EP | 2171207 | A1 | 4/2010 |
| EP | 2179127 | A1 | 4/2010 |
| EP | 2231997 | A2 | 9/2010 |
| GB | 2229787 | A | 10/1990 |
| WO | 9942696 | A1 | 8/1999 |
| WO | 0165060 | A1 | 9/2001 |
| WO | 0183941 | A1 | 11/2001 |
| WO | 0190528 | A1 | 11/2001 |
| WO | 0206634 | A1 | 1/2002 |
| WO | 0244518 | A1 | 6/2002 |
| WO | 0250398 | A1 | 6/2002 |
| WO | 03025334 | A1 | 3/2003 |
| WO | 03025336 | A1 | 3/2003 |
| WO | 03071091 | A9 | 8/2003 |
| WO | 2004005667 | A1 | 1/2004 |
| WO | 2004074627 | A1 | 9/2004 |
| WO | 2004085788 | A3 | 10/2004 |
| WO | 2005001237 | A1 | 1/2005 |
| WO | 2005017308 | A1 | 2/2005 |
| WO | 2005042917 | A1 | 5/2005 |
| WO | 2006029379 | A1 | 3/2006 |
| WO | 2006031119 | A1 | 3/2006 |
| WO | 2006099362 | A1 | 9/2006 |
| WO | 2006118920 | A3 | 11/2006 |
| WO | 2006138565 | A1 | 12/2006 |
| WO | 2007008085 | A1 | 1/2007 |
| WO | 2007016000 | A1 | 2/2007 |
| WO | 2007030017 | A1 | 3/2007 |
| WO | 2007081711 | A3 | 7/2007 |
| WO | 2007112292 | A3 | 10/2007 |
| WO | 2007124330 | A3 | 11/2007 |
| WO | 2007126833 | A1 | 11/2007 |
| WO | 2008133523 | A1 | 11/2008 |
| WO | 2008134266 | A1 | 11/2008 |
| WO | 2008151128 | A9 | 12/2008 |
| WO | 2008156376 | A1 | 12/2008 |
| WO | 2009017418 | A1 | 2/2009 |
| WO | 2009018448 | A2 | 2/2009 |
| WO | 2009058706 | A2 | 5/2009 |
| WO | 2009086442 | A2 | 7/2009 |
| WO | 2009111412 | A1 | 9/2009 |
| WO | 2009123476 | A1 | 10/2009 |
| WO | 2010065646 | A3 | 6/2010 |
| WO | 2010095947 | A1 | 8/2010 |
| WO | 2011043764 | A1 | 4/2011 |

OTHER PUBLICATIONS

Specification and Drawings for U.S. Appl. No. 13/423,366, filed Mar. 19, 2012, 29 pages.

Society of Petroleum Engineers; "Development and Testing of a Fully Automated System to Accurately Control Downhole Pressure During Drilling Operations", SPE 85310, dated Oct. 20-22, 2003, 12 pages.

Society of Petroleum Engineers; "Dynamically Overbalanced Coiled-Tubing Drilling on the North Slope of Alaska", SPE 72058, dated May 25-26, 2001, 6 pages.

Shell; "Full-Scale Automated Choke Manifold," presentation dated Apr. 20, 2005, 22 pages.

Witold Pedrycz; "From Granular Computing to Computational Intelligence and Human-centric Systems," IEEE Computational Intelligence Society, May 2005, pp. 6-11, 6 pages.

@Balance; "Dynamic Annular Pressure Control," dated 2005, 1 page.

Nils-Olav Skeie, et al.; "Early detection of Hydrocarbon liquid to surface during MPD operations," dated 2006, 1 page.

Press release, "Impact Solutions Group and Drilling Systems Team Up to Offer the Secure DrillingTM Managed Pressure Drilling System to the Industry," dated Oct. 21, 2004, 2 pages.

International Preliminary Report on Patentability issued for International Patent Application No. PCT/US07/60001, dated Sep. 12, 2008, 14 pages.

Office Action issued Mar. 26, 2008 for U.S. Appl. No. 11/333,768, 97 pages.

Office Action issued Sep. 22, 2008 for U.S. Appl. No. 11/333,768, 72 pages.

International Search Report with Written Opinion issued for International Patent Application No. PCT/US07/60001, dated Jul. 18, 2008, 15 pages.

Kishan Mehrotra, et al., "Elements of Artificial Neural Networks," MIT Press, pp. 70-78, dated 1997, 11 pages.

Corrado Mencar, "Theory of Fuzzy Information Granulation: Contributions to Interpretability Issues," University of Bari, pp. 3-8,19, and 211-214, dated Dec. 2004, 12 pages.

Office Action issued Aug. 23, 2012 for U.S. Appl. No. 13/423,366, 19 pages.

Australian Examination report issued Sep. 28, 2012 for AU Patent Application No. 2008365249, 3 pages.

Office Action issued Oct. 11, 2012 for U.S. Appl. No. 13/492,688, 17 pages.

Chinese Office Action issued Nov. 13, 2012 for CN Patent Application No. 200780049409.0, 3 pages.

English translation of Chinese Office Action issued Nov. 13, 2012 for CN Patent Application No. 200780049409.0, 5 pages.

Office Action issued Dec. 5, 2012 for U.S. Appl. No. 13/423,366, 27 pages.

Office Action issued Feb. 27, 2013 for U.S. Appl. No. 13/423,366, 34 pages.

(56) References Cited

OTHER PUBLICATIONS

Canadian Office Action issued Mar. 25, 2013 for CA Patent Application No. 2,765,069, 3 pages.
Office Action issued Apr. 5, 2013 for U.S. Appl. No. 13/542,892, 12 pages.
Office Action issued May 31, 2013 for U.S. Appl. No. 13/542,875, 10 pages.
Office Action issued Jul. 17, 2013 for U.S. Appl. No. 13/330,059, 13 pages.
IRIS; "Automatic Coordination of Equipment While Circulating out a Kick and Displacing the Kill-Weight Mud," IADC Well Control Europe, dated 2010, 41 pages.
Office Action issued Feb. 25, 2011 for U.S. Appl. No. 11/936,411, 66 pages.
Written Opinion issued May 17, 2010, for SG Patent Application Serial No. 2009030222, 2 pages.
GE Oil & Gas; "Hydril Pressure Control K Pulsation Dampers," product information, dated Aug. 6, 2010, 2 pages.
Examination Report issued Apr. 12, 2012 for GB Patent Application No. GB1108380.5, 2 pages.
Office Action issued Mar. 14, 2012 for U.S. Appl. No. 12/299,411, 36 pages.
Office Action issued Sep. 16, 2011 for U.S. Appl. No. 12/299,411, 23 pages.
Chinese Office Action issued Feb. 22, 2012 for CN Patent Application No. 200780049409.0, 11 pages.
Office Action issued Jan. 24, 2012 for U.S. Appl. No. 12/638,012, 18 pages.
International Preliminary Report on Patentability issued May 22, 2009 for PCT Patent Application No. PCT/US07/83974, 13 pages.
International Search Report and Written Opinion issued Feb. 12, 2009 for PCT Patent Application No. PCT/US08/87686, 7 pages.
International Search Report ad Written Opinion issued Sep. 22, 2008 for PCT Patent Application No. PCT/US07/83974, 16 pages.
Pre-Interview First Office Action issued Jul. 14, 2010 for U.S. Appl. No. 11/936,411, 14 pages.
Pre-Interview First Office Action issued Jul. 29, 2010 for U.S. Appl. No. 11/936,411, 3 pages.
Australian First Official Report issued Oct. 5, 2010 for AU Patent Application No. 2007317276, 2 pages.
Singapore Office Action issued Feb. 15, 2011 for SG Patent Application No. 200903022, 9 pages.
Australian Examiner's Report issued Mar. 7, 2011 for AU Patent Application No. 2007317276, 2 pages.
International Search Report and Written Opinion issued Jun. 17, 2011 for PCT Patent Application No. PCT/US2010/056433, 9 pages.
International Preliminary Report on Patentability issued Jun. 30, 2011 for PCT Patent Application No. PCT/US2008/087686, 6 pages.
International Search Report and Written Opinion issued Jul. 27, 2011 for PCT Patent Application No. PCT/US2010/062394, 10 pages.
Chinese Office Action issued Apr. 7, 2013 for CN Patent Application No. 200780049409.0, 3 pages.
English translation of Chinese Office Action issued Apr. 7, 2013 for CN Patent Application No. 200780049409.0, 4 pages.
Office Action issued Oct. 29, 2013 for U.S. Appl. No. 13/542,875, 53 pages.
Office Action issued Dec. 5, 2013 for U.S. Appl. No. 13/542,876, 13 pages.
Office Action issued Dec. 24, 2013 for U.S. Appl. No. 13/542,892, 10 pages.
Office Action issued Feb. 3, 2014 for U.S. Appl. No. 12/299,411, 63 pages.
Advisory Action issued Feb. 4, 2014 for U.S. Appl. No. 13/542,875, 2 pages.
Singapore Examination Report issued Dec. 27, 2011 for SG Patent Application No. 200903022-2, 8 pages.
Office Action issued Feb. 7, 2012 for U.S. Appl. No. 13/022,964, 15 pages.
International Search Report with Written Opinion issued Feb. 8, 2012 for PCT Patent Application No. PCT/US11/031767, 9 pages.
International Search Report with Written Opinion issued Dec. 21, 2011 for PCT Patent Application No. PCT/US11/031790, 15 pages.
Weatherford International Ltd.; "Weatherford Model 7800 Rotating Control Device", article No. 4593.00, dated 2007, 5 pages.
Weatherford International Ltd.; "Model 7875 Rotating Control Device", article No. 4594.01, dated 2010, 4 pages.
Hannegan, Don; Weatherford International; "Offshore Drilling Hazard Mitigation: Controlled Pressure Drilling Redefines What is Drillable", Managed Pressure Drilling Magazine, Drilling Contractor article, dated Jan.-Feb. 2009, 4 pages.
Smith Services; "Hold 2500 Rotating Control Device", product brochure, article No. ss-04-0055, dated 2004, 4 pages.
Smith Services; "Marine Riser RCD", product presentation, dated Jul. 2009, 18 pages.
International Preliminary Report on Patentability issued Feb. 9, 2012 for PCT Patent Application No. PCT/US09/052227, 7 pages.
FAIPP Office Action issued Jul. 14, 2010 for U.S. Appl. No. 11/936,411, 16 pages.
International Search Report with Written Opinion issued Oct. 13, 2010 for PCT Patent Application No. PCT/US10/020122, 13 pages.
International Search Report with Written Opinion issued Jan. 25, 2011 for PCT Patent Application No. PCT/US10/032578, 9 pages.
Office Action issued Nov. 25, 2011 for U.S. Appl. No. 13/084,841, 19 pages.
International Search Report with Written Opinion issued Dec. 13, 2011 for PCT Patent Application No. PCT/US11/035751, 16 pages.
Office Action issued Oct. 18, 2013 for U.S. Appl. No. 13/542,781, 36 pages.
Office Action issued Oct. 7, 2013 for U.S. Appl. No. 13/542,892, 58 pages.
US 6,708,780, 03/2004, Bourgoyne et al. (withdrawn)

* cited by examiner

OFFSHORE UNIVERSAL RISER SYSTEM

CROSS-REFERENCE TO RELATED APPLICATIONS

This application is a division of prior application Ser. No. 12/299,411 filed on Jun. 1, 2009, which claims priority to a national stage application under 35 USC §371 of International Application No. PCT/US07/83974 filed on Nov. 7, 2007, which claims the benefit of the filing date of U.S. Provisional Application No. 60/864,712 filed on Nov. 7, 2006. The entire disclosures of these prior applications are incorporated herein by this reference.

BACKGROUND

The present invention relates generally to marine riser systems and, in an embodiment described herein, more particularly provides an offshore universal riser system.

Risers are used in offshore drilling applications to provide a means of returning the drilling fluid and any additional solids and/or fluids from a borehole back to surface. Riser sections are sturdily built as they have to withstand significant loads imposed by weights they have to carry and environmental loads they have to withstand when in operation. As such, they have an inherent internal pressure capacity.

However, this capacity is not currently exploited to the maximum extent possible. Many riser systems have been proposed to vary the density of fluid in the riser but none have provided a universally applicable and easily deliverable system for varying types of drilling modes. They typically require some specific modification of the main components of a floating drilling installation, with the result that they are custom solutions with a narrow range of application due to costs and design limitations. For example, different drilling systems are required for different drilling modes such as managed pressure drilling, dual density or dual gradient drilling, partial riser level drilling, and underbalanced drilling.

An example of the most common current practice is illustrated by FIG. 1, which is proposed in U.S. Pat. No. 4,626,135. To compensate for movement of a floating drilling installation, a slip joint SJ (telescopic joint) is used at an upper end of a riser system. This slip joint consists of an inner barrel IB and an outer barrel OB that move relative to each other, thus allowing the floating structure S to move without breaking the riser R between the fixed point wellhead W and the moving point diverter D (which is where drilling fluid is returned from the top of the riser R).

Also depicted in FIG. 1 are a rig structure S, rig floor F, rotary table RT, choke manifold CM, separator MB, shale shaker SS, mud pit MP, choke line CL, kill line KL, booster line BL and rigid flowline RF. These elements are conventional, well known to those skilled in the art and are not described further.

A ball joint BJ (also known as a flex-joint) provides for some angular displacement of the riser R from vertical. The conventional method interprets any pressure in the riser R due to flow of pressurized fluids from wellhead W as an uncontrolled event (kick) that is controlled by closing the BOP (blowout preventer) either by rams around the tubulars therein, or by blind rams if no tubulars are present, or by shear rams capable of cutting the tubulars.

It is possible for the kick to enter the riser R, and then it is controlled by closing the diverter D (with or without tubulars present) and diverting the undesired flow through diverter lines DL. In the '135 patent the concept of an annular blow out preventer used as a gas handler to divert the flow of gas from a well control incident is described. This allows diversion of gas in the riser R by closing around the tubulars therein, but not when drilling, i.e., rotating the tubular.

In FIG. 1, seals between the outer barrel OB and inner barrel IB are subjected to much movement due to wave motion, and this causes a limitation in the pressure sealing capacity available for the riser R. In fact, the American Petroleum Institute (API) has established pressure ratings for such seals in its specification 16F, which calls for testing to 200 psi (pounds per square inch). In practice, the common upper limit for most designs is 500 psi.

There are some modifications that can be made to the slip joint SJ, an example of which is described in U.S. Patent Application No. US2003/0111799A1, to produce a working rating to 750 psi. In practice, the limitation on the slip joint SJ seals has also led to an accepted standard in the industry of the diverter D, ball joint BJ (also sometimes replaced by a unit known as a flex-joint) and other parts of the system (such as valves on the diverter line DL) having a typical industry-wide rating of 500 psi working pressure.

The outer barrel OB of the slip joint SJ (telescopic joint) also acts as an attachment point for a tension system that serves to keep the riser R in tension to prevent it from buckling. This means that a leak in the slip joint SJ seals involves significant downtime in having to lift the entire riser R from the subsea BOP (blowout preventer) stack in order to service the slip joint SJ. In practice this has meant that no floating drilling installation service provider or operating company has been willing to take the risk to continuously operate with any pressure in the riser R for the conventional system (also depicted in FIG. 3*a*).

U.S. Patent Application No. 2005/0061546 and U.S. Pat. No. 6,913,092 have addressed this problem by proposing the locking closed of the slip joint SJ, which means locking the inner barrel IB to the outer barrel OB, thus eliminating movement across the slip joint seal. The riser R is then effectively disconnected from the ball joint BJ and diverter D as shown in FIG. 2.

The riser R is closed by the addition of a rotating blowout preventer 70 on top of the locked closed slip joint SJ. This effectively decouples the riser R from any fixed point below the rotary table RT.

Also depicted in FIG. 2 are vertical beams B, adapter or crossover 22, rotatable tubular 24 (such as drill pipe) and T-connectors 26. These elements are conventional and are not described further here.

This method has been used and allowed operations with a limit of 500 psi internal riser pressure, with the weak point still being the slip joint seals. However, decoupling the riser R from the fixed rig floor F means that it is only held by the tensioner system T1 and T2.

This means that the top of the riser R is no longer self centralizing. This causes the top of an RCD 80 (rotating control device) of the blowout preventer 10 to be off center as a result of ocean currents, wind or other movement of the floating structure. This introduces significant wear on the sealing element(s) of the RCD 80, which is detrimental to the pressure integrity of the riser system.

Also, the riser system of FIG. 2 introduces a significant safety hazard, since substantial amounts of easily damaged hydraulic hoses used in the operation of the RCD 80, as well as pressurized hose(s) 62 and safety conduit 64, are introduced in the vicinity of riser tensioner wires depicted as extending upwardly from the slip joint SJ to sheaves at the bottom of the tensioners T1, T2. These wires are under substantial loads (on the order of 50 to 100 tons each) and can easily cut through softer rubber goods (such as hoses). The '092 patent suggests the use of steel pipes, but this is extremely difficult to achieve in practice.

Furthermore, the installation and operation requires personnel to perform tasks around the RCD 80, a hazardous area with the relative movement between the floating structure S to the top of the riser R. All of the equipment does not fit through the rotary table RT and diverter housing D, thus making installation complex and hazardous. As a result, use of the system of FIG. 2 has been limited to operations in benign sea areas with little current, wave motion, and wind loads.

A summary of the evolution for the art for drilling with pressure in the riser is shown in FIGS. 3*a* to 3*c*. FIG. 3*a* shows the conventional floating drilling installation set-up. This consists typically of an 18¾ inch subsea BOP stack, with a LMRP (Lower Marine Riser Package) added to allow disconnection and prevent loss of fluids from the riser, a 21 inch marine riser, and a top configuration identical in principle to the '135 patent discussed above. This is the configuration used by a large majority of today's floating drilling installations.

In order to reduce costs, the industry moved towards the idea of using a SBOP (surface blowout preventer) with a floating drilling installation (for example, U.S. Pat. No. 6,273,193 as illustrated in FIG. 4), where the 21 inch riser is replaced with a smaller high pressure riser capped with a SBOP package similar to a non-floating drilling installation set-up as illustrated in FIG. 3*b*. This design evolved to dispensing completely with the subsea BOP, thus removing the need for choke, kill, and other lines from the sea floor back to the floating drilling installation and many wells were drilled like this in benign ocean areas.

FIG. 4 depicts a riser 74, slip joint 78, collar 102, couplings 92, hydraulic tensioners 68, inner riser 66, load bearing ring 98, load shim 86, drill pipe 72, surface BOP 94, line 76, collar 106 and rotating control head 96. Since these elements are known in the art, they are not described further here.

In attempting to take the concept of a SBOP and high pressure riser further into more environmentally harsh areas, a subsea component for disconnection (known as an environmental safeguard ESG system) and securing the well in case of emergency was re-introduced, but not as a full subsea BOP. This is shown in FIG. 3*c* with another evolution of running the SBOP below the water line and tensioners above to provide for heave on floating drilling installations with limited clearance. The method of U.S. Pat. No. 6,913,092 is shown in FIG. 3*d* for comparison.

In trying to plan for substantially higher pressures as experienced in underbalanced drilling where the formation being drilled is allowed to flow with the drilling fluid to surface, the industry has favored designs utilizing an inner riser run within the typical 21 inch marine riser as described in U.S. Patent Application 2006/0021755 A1. This requires a SBOP as shown in FIG. 3*e*.

Drawbacks of the systems and methods described above include that they require substantial modification of the floating drilling installation to enable the use of SBOP (surface blowout preventers) and the majority are limited to benign sea and weather conditions. Thus, they are not widely implemented since, for example, they require the floating drilling installation to undergo modifications in a shipyard.

Methods and systems as shown in U.S. Pat. Nos. 6,230,824 and 6,138,774 attempt to dispense totally with the marine riser. Methods and systems described in U.S. Pat. No. 6,450,262, U.S. Pat. No. 6,470,975, and U.S. Patent Application 2006/0102387A1 envision setting an RCD device on top of the subsea BOP to divert pressure from the marine riser, as does U.S. Pat. No. 7,080,685 B2. All of these patents are not widely applied as they involve substantial modifications and additions to existing equipment to be successfully applied.

FIG. 5 depicts the system described in U.S. Pat. No. 6,470,975. Illustrated in FIG. 5 are pipe P, bearing assembly 28, riser R, choke line CL, kill line KL, BOP stack BOPS, annular BOP's BP, ram BOP's RBP, wellhead W and borehole B. Since these elements are known in the art, further description is not provided here.

A problem with the foregoing systems that utilize a high pressure riser or a riserless setup is that one of the primary means of delivering additional fluids to the seafloor, namely the booster line BL that is a typical part of the conventional system as depicted in FIG. 3*a*, is removed. The booster line BL is also indicated in FIGS. 1 and 2. So, the systems shown in FIGS. 3*b* and 3*c*, while providing some advantages, take away one of the primary means of delivering fluid into the riser. Even when the typical booster line BL is provided, it is tied in to the base of the riser, which means that the delivery point is fixed.

There is also an evolution in the industry to move from conventional drilling to closed system drilling. These types of closed systems are described in U.S. Pat. Nos. 6,904,981 and 7,044,237, and require the closure and (by consequence) the trapping of pressure inside the marine riser in floating drilling installations. Also, the introduction of a method and system to allow continuous circulation as described in U.S. Pat. No. 6,739,397 allows a drilling circulation system to be operated at constant pressure as the pumps do not have to be switched off when making or breaking a tubular connection. This allows the possibility of drilling with a constant pressure downhole, which can be controlled by a pressurized closed drilling system. The industry calls this Managed Pressure Drilling.

With the conventional method of FIG. 3*a*, no continuous pressure can be kept in the riser. In FIG. 6*a*, fluid flow in the riser system of FIG. 3*a* is schematically depicted. Note that the riser system is open to the atmosphere at its upper end. Thus, the riser cannot be pressurized, other than due to hydrostatic pressure of the fluid therein. Since the fluid (mud, during drilling) in the riser typically has a density equal to or only somewhat greater than that of the fluid external to the riser (seawater), this means that the riser does not need to withstand significant internal pressure.

With the method of U.S. Pat. No. 6,913,092 (as depicted in FIG. 3*d*), the pressure envelope has been taken to 500 psi, however, with the substantial addition of hazards and many drawbacks. It is possible to increase the envelope by the methods shown in FIGS. 3*b*, 3*c* and 3*e*. However, the addition of a SBOP (surface BOP) to a floating drilling installation is not a normal design consideration and involves substantial modification, usually involving a shipyard with the consequence of operational downtime as well as substantial costs involved, as already mentioned above.

The systems mentioned earlier in U.S. Pat. Nos. 6,904,981 and 7,044,237 discuss closing the choke on a pressurized drilling system, and using manipulation of the choke to control the backpressure of the system, in order to control the pressure at the bottom of the well. This method works in principle, but in field applications of these systems, when drilling in a closed system, the manipulation of the choke can cause pressure spikes that are detrimental to the purpose of these inventions, i.e., precise control of the bottom hole pressure.

Also, a peculiarity of a floating drilling installation is, that when a connection is made, the top of the pipe is held stationary in the rotary table (RT in FIGS. 1 and 2). This means that the whole string of pipe in the wellbore now moves up and down as the wave action (known as heave in the industry) causes the pressure effects of surge (pressure increase as the pipe moves into the hole) and swab (pressure drop as the pipe moves out of the hole). This effect already causes substantial pressure variations in the conventional method of FIG. 3*a*.

When the system is closed by the addition of an RCD as shown in FIG. 3*d*, this effect is even more pronounced by the effect of volume changes by the pipe moving in and out of a fixed volume. As the movement of a pressure wave in a compressed liquid is the speed of sound in that liquid, it implies that the choke system would have to be able to respond at the same or even faster speed. While the electronic sensor and control systems are able to achieve this, the mechanical manipulation of the choke system is very far from these speeds.

Development of RCD's (rotating control devices) originated from land operations where typically the installation was on top of the BOP (blowout preventer). This meant that usually there was no further equipment installed above the RCD. As access was easy, almost all of the current designs have hydraulic connections for lubricating and cooling bearings in the RCD, or for other utilities. These require the external attachment of hoses for operation.

Although some versions have progressed from surface type to being adapted for use on the bottom of the sea (such as described in U.S. Pat. No. 6,470,975), they fail to disclose a complete system for achieving this. Some systems (such as described in U.S. Pat. No. 7,080,685) dispense with hydraulic cooling and lubrication, but require a hydraulic connection to release the assembly.

Furthermore, the range of RCD's and alternatives available means that a custom made unit to house a particular RCD design is typically required (such as described in U.S. Pat. No. 7,080,685). The '685 patent provides only for a partial removal of the RCD assembly, leaving the body on location.

Many ideas have been tried and patents have been filed, but the field application of technology to solve some of the shortcomings in the conventional set-up of FIG. 3*a* has been limited. All of these modify the existing system in a custom manner, thereby taking away some of the flexibility. There exist needs in the present industry to provide a solution to allow running a pressurized riser for the majority of floating drilling installations to allow closed system drilling techniques, especially managed pressure drilling, to be safely and expediently applied without any major modification to the floating drilling installation.

These needs include, but are not limited to: the capability to pressurize the marine riser to the maximum pressure capacity of its members; the capability to be safely installed using normal operational practices and operated as part of a marine riser without any floating drilling installation modifications as required for surface BOP operations or some subsea ideas; providing full-bore capability like a normal marine riser section when required; providing the ability to use the standard operating procedures when not in pressurized mode; maintaining the weather (wind, current and wave) operating window of the floating drilling installation; providing a means for damping the pressure spikes caused by heave resulting in surge and swab fluctuations; providing a means for eliminating the pressure spikes caused by movement of the rotatable tubulars into and out of a closed system; and providing a means for easily modifying the density of fluid in the riser at any desired point.

SUMMARY

In carrying out the principles of the present invention, a riser system and associated methods are provided which solve one or more problems in the art. One example is described below in which the riser system includes modular internal components which can be conveniently installed and retrieved. Another example is described below in which the riser system utilizes rotating and/or non-rotating seals about a drill string within a riser, to thereby facilitate pressurization of the riser during drilling.

The systems and methods described herein enable all the systems shown in FIGS. 3*a* to 3*e* to be pressurized and to have the ability to inject fluids at any point into the riser. Any modification to a riser system which lessens the normal operating envelope (i.e. weather, current, wave and storm survival capability) of the floating drilling installation leads to a limitation in use of that system. The riser systems shown in FIGS. 3*b*, 3*d* and 3*e* all lessen this operating envelope, which is a major reason why these systems have not been applied in harsher environmental conditions. The system depicted in FIG. 3*c* does not lessen this operating window significantly, but it does not allow for convenient installation and operation of a RCD. All of these limitations are eliminated by the systems and methods described below.

In order to reduce, or even optimally remove pressure spikes (negative or positive from a desired baseline) from within a pressurized riser, a damping system is provided. A beneficial damping system in an incompressible fluid system includes the introduction of a compressible fluid in direct contact with the incompressible fluid. This could be a gas, e.g., Nitrogen.

An improved annular seal device for use in a riser includes a latching mechanism, and also allows hydraulic connections between the annular seal device and pressure sources to be made within the riser, so that no hoses are internal to the riser. The latching mechanism may be substantially internal or external to the riser.

The present specification provides a more flexible riser system, in part by utilizing a capability to interface an internal annular seal device with any riser type and connection, and providing adapters that are pre-installed to take the annular seal device being used. These can also have wear sleeves to protect sealing surfaces when the annular seal device is not installed. If an annular seal design is custom made for installation into a particular riser type, it may be possible to insert it without an additional adapter. The principle being that it is possible to remove the entire annular seal device to provide the full bore requirement typical of that riser system and install a safety/wear sleeve to positively isolate any ports that are open and provide protection for the sealing surfaces when the annular seal device is not installed.

In one aspect, a riser system is provided which includes a valve module which selectively permits and prevents fluid flow through a flow passage extending longitudinally through a riser string, and wherein a first anchoring device releasably secures the valve module in the flow passage.

In another aspect, a method of pressure testing a riser string is provided which includes the steps of: installing a valve module into an internal longitudinal flow passage extending through the riser string; closing the valve module to thereby prevent fluid flow through the flow passage; and applying a pressure differential across the closed valve module, thereby pressure testing at least a portion of the riser string.

In yet another aspect, a method of constructing a riser system includes the steps of: installing a valve module in a flow passage extending longitudinally through a riser string, the valve module being operative to selectively permit and prevent fluid flow through the flow passage; and installing at least one annular seal module in the flow passage, the annular seal module being operative to prevent fluid flow through an annular space between the riser string and a tubular string positioned in the flow passage.

A drilling method is also provided which includes the steps of: connecting an injection conduit externally to a riser string, so that the injection conduit is communicable with an internal flow passage extending longitudinally through the riser string; installing an annular seal module in the flow passage, the annular seal module being positioned in the flow passage between opposite end connections of the riser string; conveying a tubular string into the flow passage; sealing an annular space between the tubular string and the riser string utilizing the annular seal module; rotating the tubular string to thereby rotate a drill bit at a distal end of the tubular string, the annular seal module sealing the annular space during the rotating step; flowing drilling fluid from the annular space to a surface location; and injecting a fluid composition having a density less than that of the drilling fluid into the annular space via the injection conduit.

Another drilling method is provided which includes the steps of: connecting a drilling fluid return line externally to a riser string, so that the drilling fluid return line is communicable with an internal flow passage extending longitudinally through the riser string; installing an annular seal module in the flow passage, the annular seal module being positioned in the flow passage between opposite end connections of the riser string; conveying a tubular string into the flow passage; sealing an annular space between the tubular string and the riser string utilizing the annular seal module; rotating the tubular string to thereby rotate a drill bit at a distal end of the tubular string, the annular seal module sealing the annular space during the rotating step; flowing drilling fluid from the annular space to a surface location via the drilling fluid return line, the flowing step including varying a flow restriction through a subsea choke externally connected to the riser string to thereby maintain a desired downhole pressure.

Yet another drilling method includes the steps of: installing a first annular seal module in an internal flow passage extending longitudinally through a riser string, the first annular seal module being secured in the flow passage between opposite end connections of the riser string; sealing an annular space between the riser string and a tubular string in the flow passage utilizing the first annular seal module, the sealing step being performed while the tubular string rotates within the flow passage; and then conveying a second annular seal module into the flow passage on the tubular string.

A further aspect is a method which includes the steps of: installing multiple modules in an internal flow passage extending longitudinally through a riser string, the modules being installed in the flow passage between opposite end connections of the riser string; inserting a tubular string through an interior of each of the modules; and then simultaneously retrieving the multiple modules from the flow passage on the tubular string.

Another drilling method includes the steps of: sealing an annular space between a tubular string and a riser string; flowing drilling fluid from the annular space to a surface location via a drilling fluid return line; and injecting a fluid composition having a density less than that of the drilling fluid into the drilling fluid return line via an injection conduit.

Yet another drilling method includes the steps of: installing an annular seal module in an internal flow passage extending longitudinally through a riser string, the annular seal module being secured in the flow passage between opposite end connections of the riser string; then conveying another annular seal module into the flow passage; and sealing an annular space between the riser string and a tubular string in the flow passage utilizing the multiple annular seal modules.

Another drilling method includes the steps of: installing an annular seal module in an internal flow passage extending longitudinally through a riser string, the annular seal module being secured in the flow passage between opposite end connections of the riser string; then conveying on a tubular string at least one seal into the annular seal module; and then sealing an annular space between the riser string and the tubular string in the flow passage utilizing the seal, the sealing step being performed while a drill bit on the tubular string is rotated.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

Figure 1:
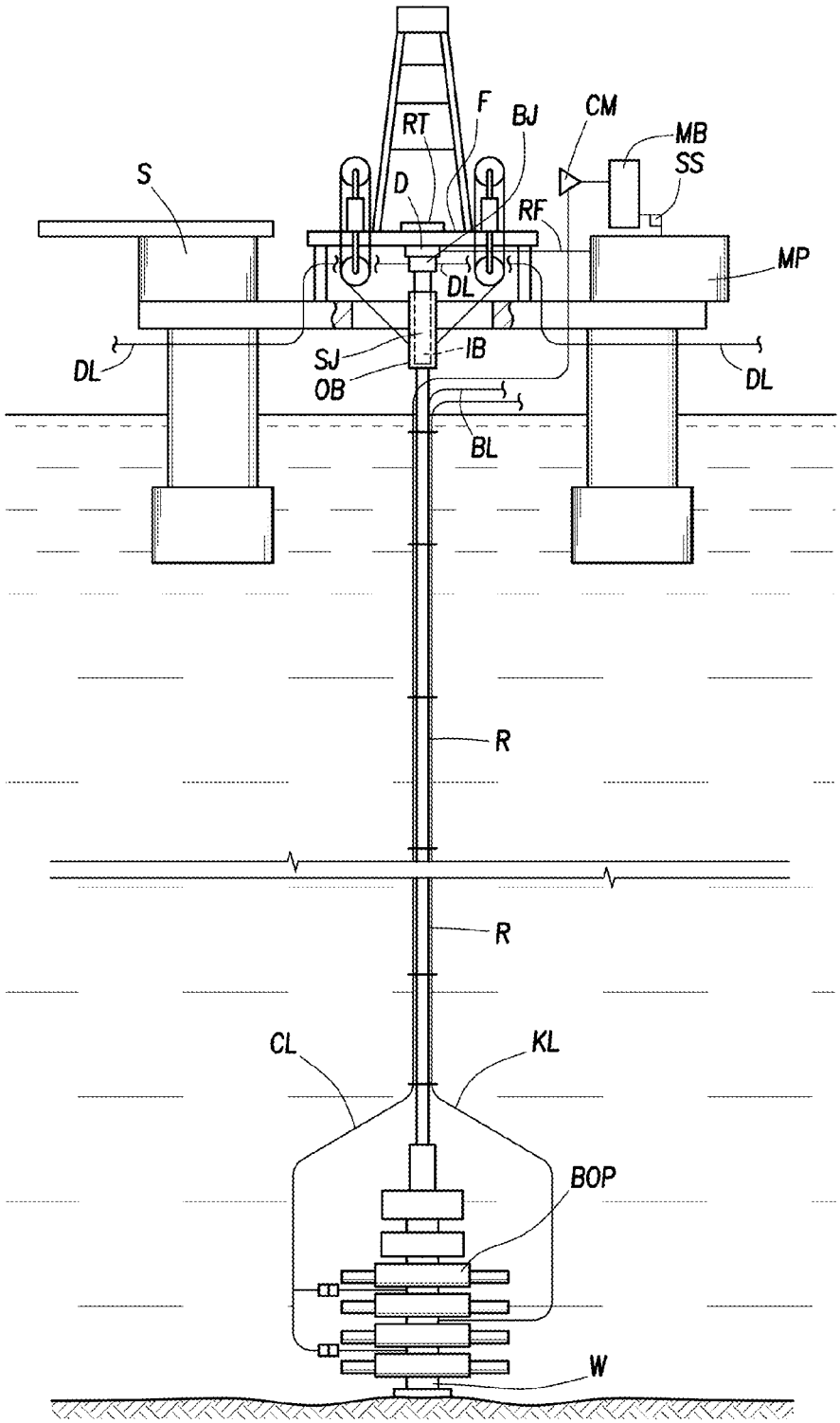
FIG. 1 (PRIOR ART)
FIG. 1 is an elevation view of a prior art floating drilling installation with a conventional riser system.
Figure 2:
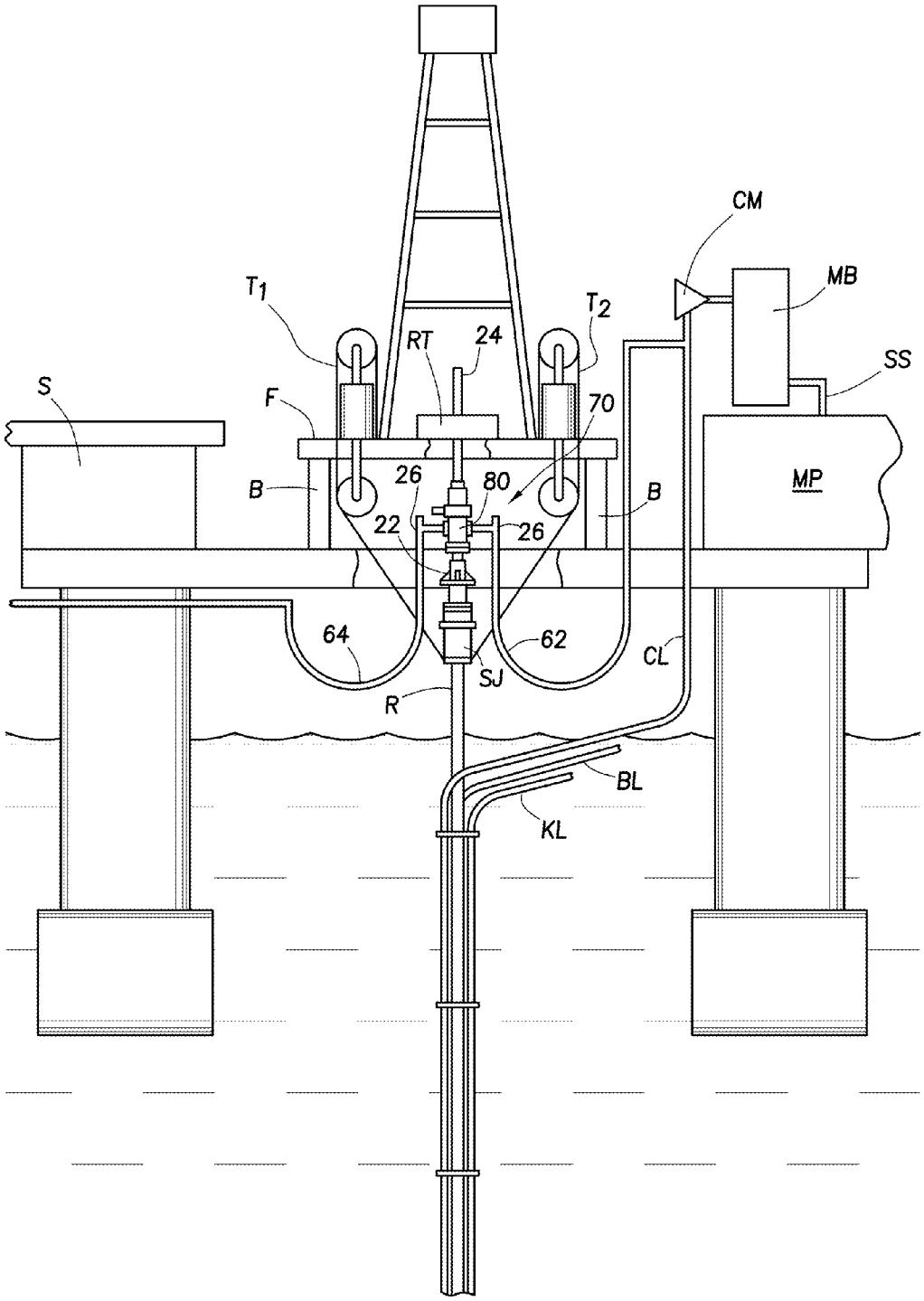
FIG.2 (PRIOR ART)
FIG. 2 is an elevation view of a prior art floating drilling installation in which a slip joint is locked closed and a rotating control device maintains riser pressure and diverts mud flow through hoses into a mud pit, with the riser being disconnected from a rig floor.

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward an upper end of a marine riser, and "below", "lower", "downward" and similar terms refer to a direction toward a lower end of a marine riser.

In the drawings, and in the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Any use of any form of the terms "connect," "engage," "couple," "attach" or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

An offshore universal riser system (OURS) 100 is disclosed which is particularly well suited for drilling deepwater in the floor of the ocean using rotatable tubulars. The riser system 100 uses a universal riser section which may be interconnected near a top of a riser string below the slip joint in a subsea riser system. The riser system 100 includes: a seal bore to take an inner riser string (if present) with a vent for outer riser, a nipple to receive pressure test adapters, an inlet/outlet tied into the riser choke line, kill line or booster line(s) as required, one or more integral Blow Out Preventers as safety devices, outlet(s) for pressurized mud return with a valve(s), an optional outlet for riser overpressure protection, one or more seal bores with adapters that can accept a variety of RCD designs, a provision for locking said RCD(s) in place, a seal bore adapter to allow all RCD utilities to be transferred from internal to external and vice versa. Externally, the universal riser section includes all the usual riser connections and attachments required for a riser section. Additionally the riser system 100 includes provision for mounting an accumulator (s), provision for accepting instrumentation for measuring pressure, temperature and any other inputs or outputs, e.g., riser level indicators; a line(s) taking pressurized mud to the next riser section above or slip joint; Emergency Shut Down system(s) and remote operated valve(s); a hydraulic bundle line taking RCD utilities and controls; an electric bundle line for instrumentation or other electrical requirements. A choking system may also be inserted in the mud return line that is capable of being remotely and automatically controlled. The riser system 100 may also have a second redundant return line if required. As part of the system 100, when desired, an injection system 200 including a lower riser section coupled with a composite hose (or other delivery system) for delivery of fluids may be included with an inlet to allow injection of a different density fluid into the riser at any point between the subsea BOP and the top of the riser. This allows the injection into the riser of Nitrogen or Aphrons (glass spheres), or fluids of various densities that will allow hydrostatic variations to be applied to the well, when used in conjunction with a surface or sub surface choke.

Figure 3A:
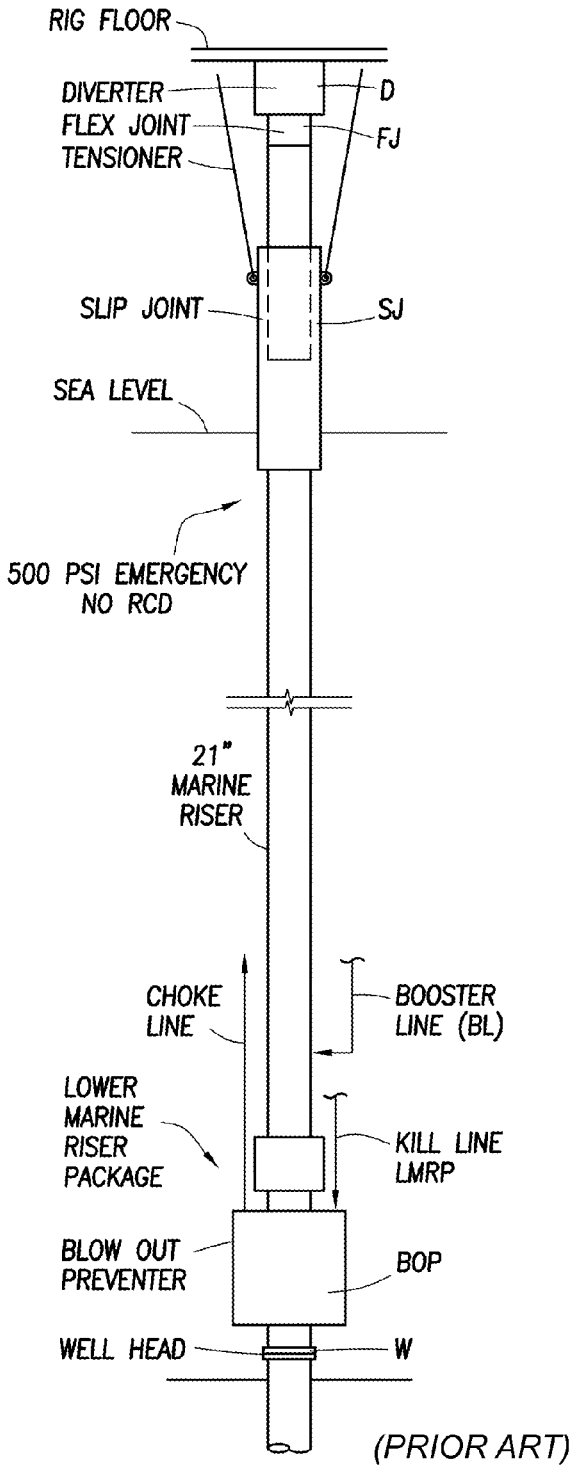
FIGS. 3*a-e* are schematic elevation views of typical conventional riser systems used for floating drilling installations.
Figure 3B:
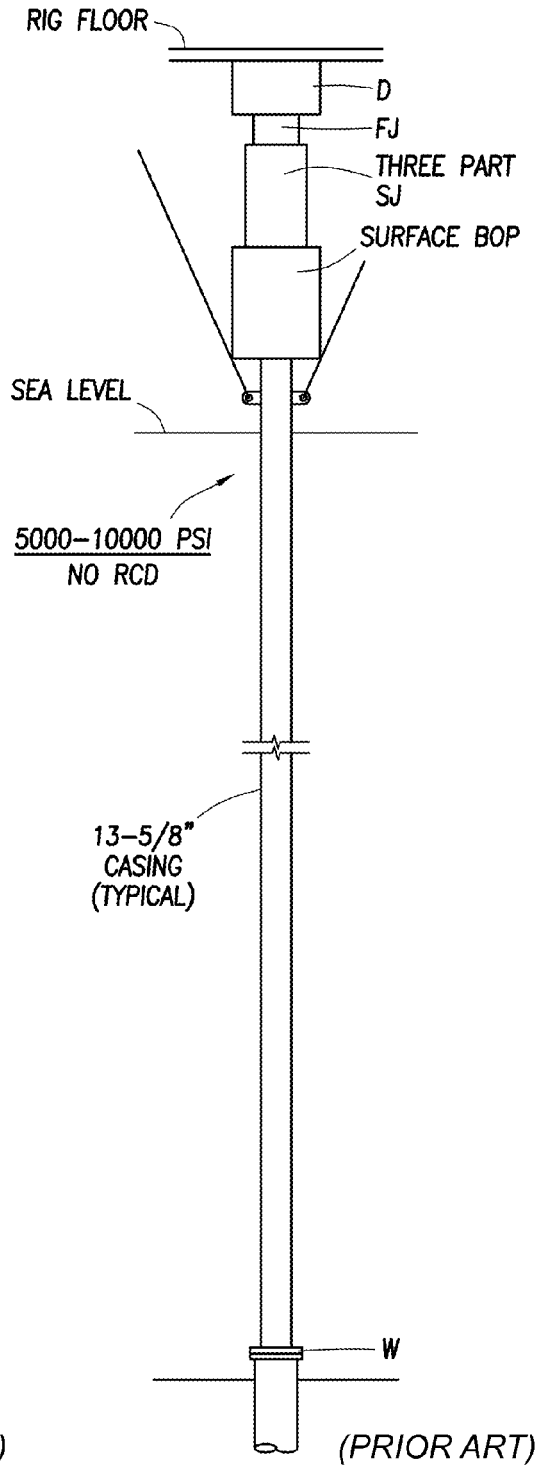
Figure 3C:
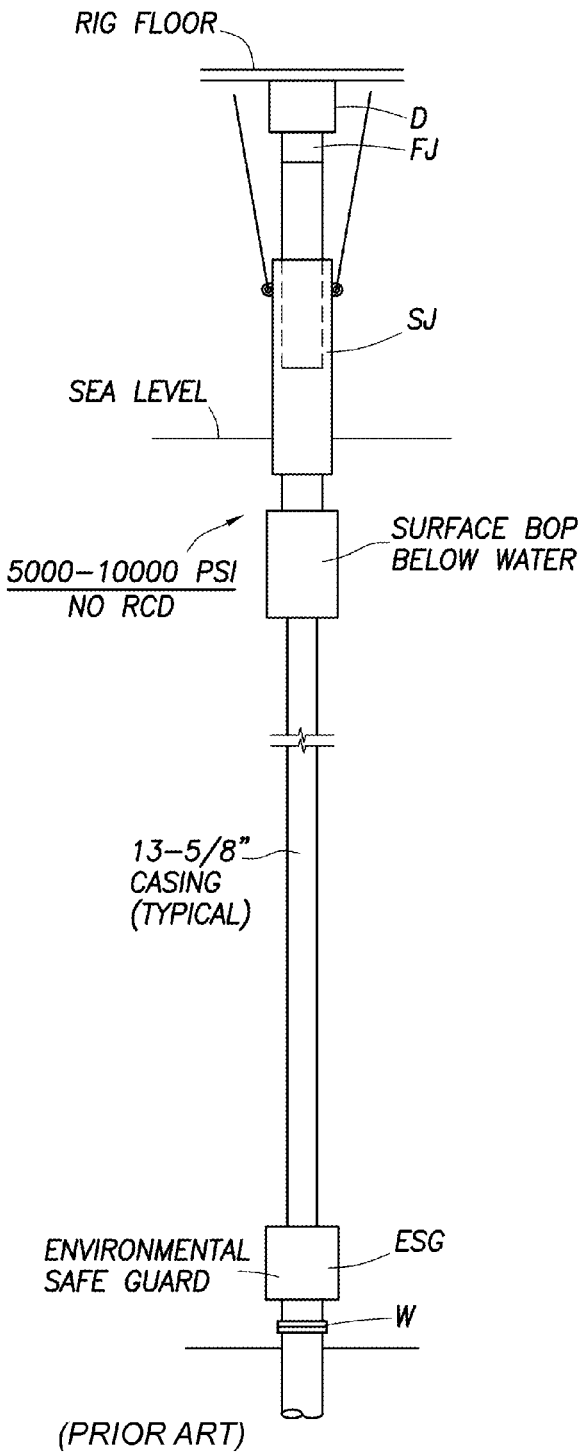
Figure 3D:
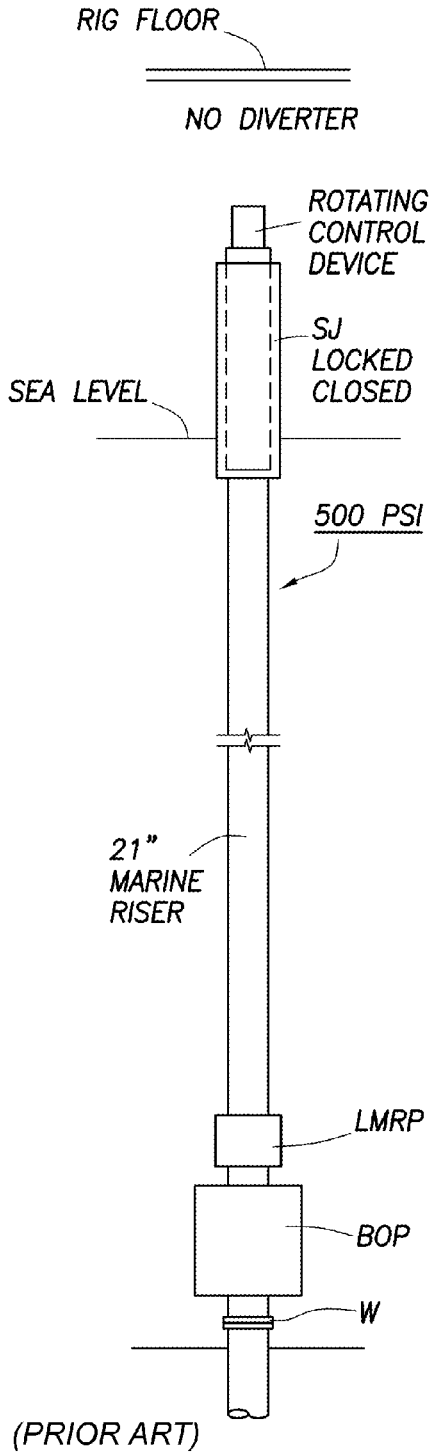
Figure 3E:
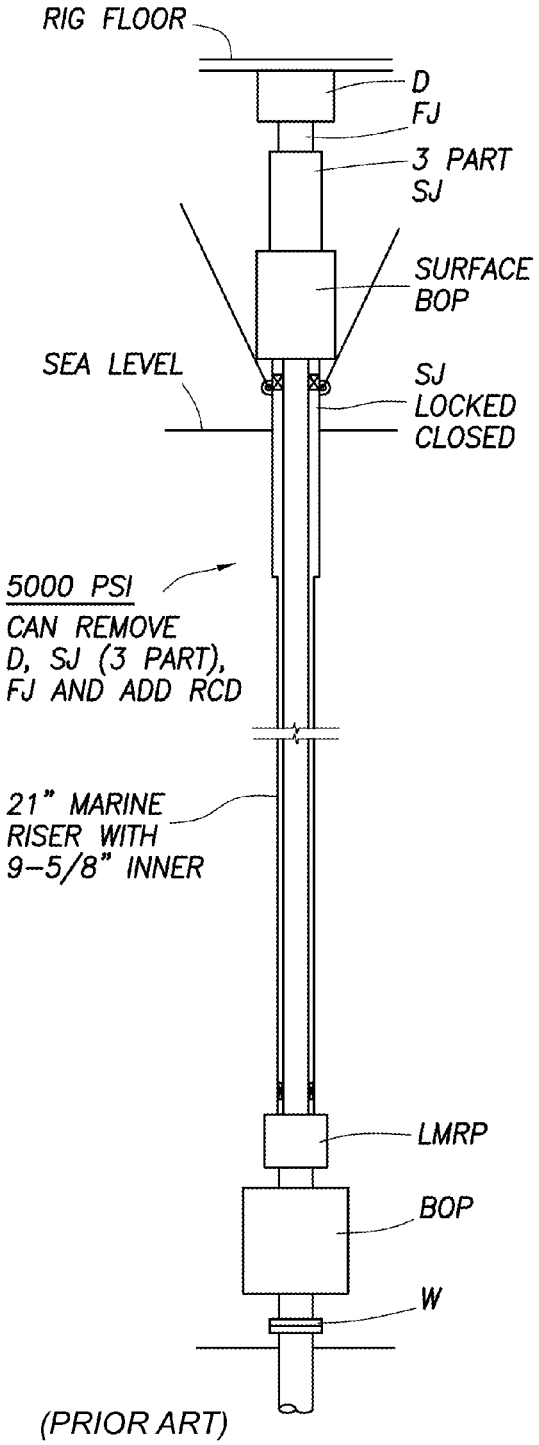

There is flexibility in the riser system 100 to be run in conjunction with conventional annular pressure control equipment, multiple RCDs, adapted to use with 13⅜ high pressure riser systems or other high pressure riser systems based in principle on the outlines in FIG. 3*b*, 3*c*, or 3*e*. Instead of the standard 21 inch riser system, any other size of riser system can also be adapted for use with the riser system 100 and/or injection system 200 (discussed further below), which can be placed at any depth in the riser depending on requirements.

A refined and more sensitive control method for MPD (Managed Pressure Drilling) will be achieved by the riser system 100 with the introduction of Nitrogen in to the riser below the RCD. This will be for the purpose of smoothing out surges created by the heave of the floating drilling installation due to the cushioning effect of the Nitrogen in the riser as well as allowing more time for the choke manipulation to control the bottom hole pressure (BHP) regime. It has been demonstrated on many MPD jobs carried out on non-floating drilling installations, that having a single phase fluid makes it more difficult to control the BHP with the choke manipulation. On a floating drilling installation any surge and swab through the RCD has a more direct effect on the BHP with the monophasic system as it is not possible to compensate with the choke system. With the riser system 100, the choke(s) can be controlled both manually and/or automatically with input from both surface and or bottom hole data acquisition.

The riser system 100 allows Nitrified fluid drilling that is still overbalanced to the formation, improved kick detection and control, and the ability to rotate pipe under pressure during well control events.

This riser system 100 allows a safer installation as there is no change in normal practice when running the riser system and all functions remain for subsea BOP control, emergency unlatch, fluid circulation, and well control.

The riser system 100 includes seal bore protector sleeves and running tool(s) as required, enabling conversion from a standard riser section to full riser system 100 use.

The riser system 100 also may include the addition of lines on the existing slip joint which can be done: (1) permanently with additional lines and gooseneck(s) on slip joint, and hollow pipes for feeding through hydraulic or electrical hoses; or (2) temporarily by strapping hoses and bundles to the slip joint if acceptable for environmental conditions.

A system is disclosed for drilling deepwater in the floor of the ocean using rotatable tubulars. This consists of the riser system 100 and injection system 200. The two components can be used together or independently.

The injection system 200 includes a riser section that is based on the riser system being used. Thus, e.g., in a 21 inch Marine Riser System it will have connectors to suit the particular connections for that system. Furthermore it will have all the usual lines attached to it that are required for a riser section below the slip joint SJ. In a normal 21 inch riser system this would be one choke line and one kill line as a minimum and others like booster line and/or hydraulic lines. For another type of riser, e.g., a 13⅝ casing based riser, it would typically have no other lines attached (other than those particularly required for the riser system 100).

The riser system 100 acts as a passive riser section during normal drilling operations. When pressurized operations are required, components are inserted into it as required to enable its full functionality. The section of riser used for riser system 100 may be manufactured from a thicker wall thickness of tube.

Figure 9:
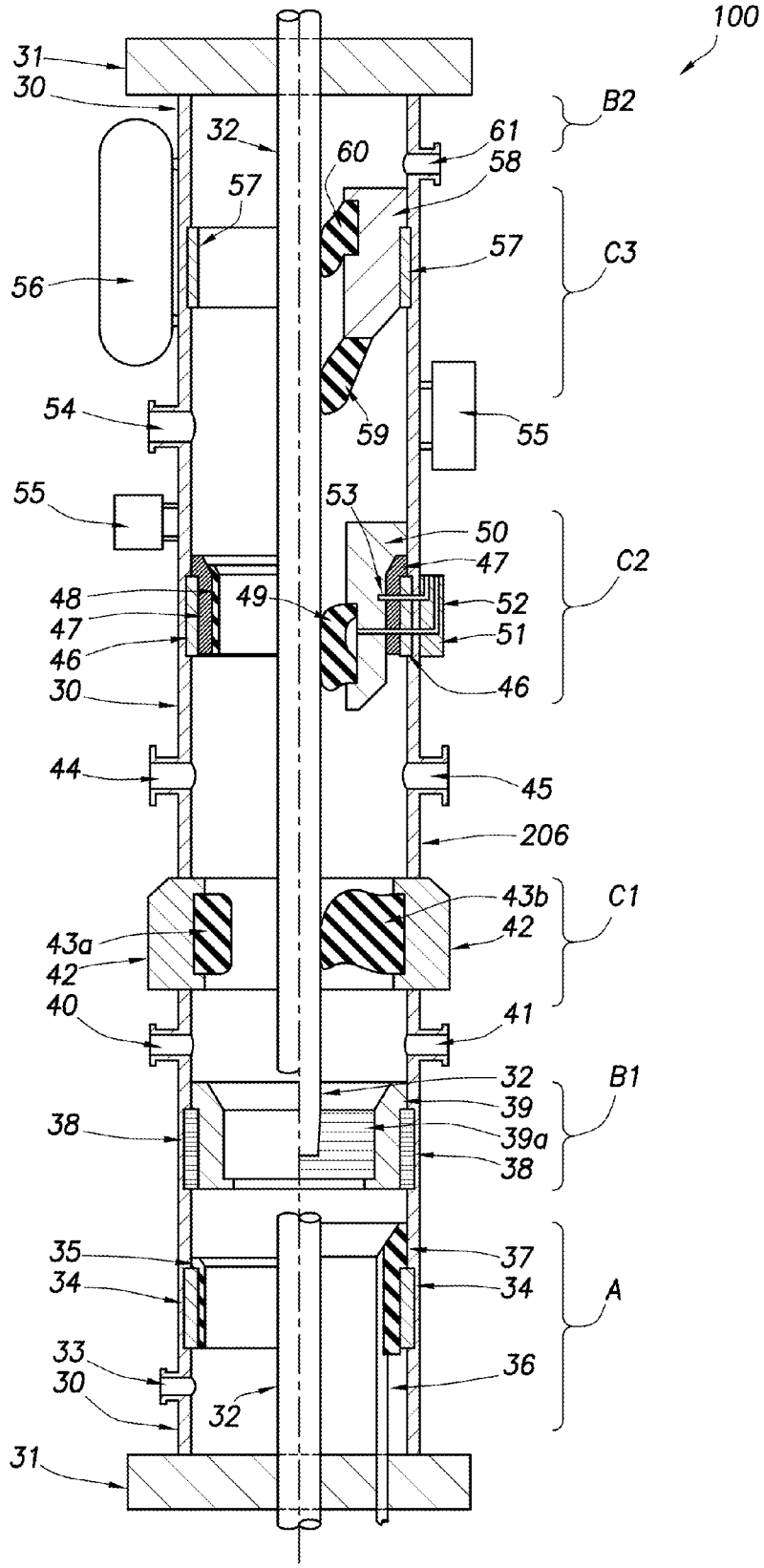
FIG. 9 is a schematic cross-sectional view of another alternate configuration of a riser system and method embodying principles of the present invention.

Referring to FIG. 9, this shows a detailed schematic cross section of an embodiment of a riser system 100. The drawing is split along the center line CL with the left hand side (lhs) showing typical configuration of internal components when in passive mode, and the right hand side (rhs) showing the typical configuration when in active mode. In the drawing, only major components are shown with details like seals, recesses, latching mechanisms, bearings not being illustrated. These details are the standard type found on typical wellbore installations and components that can be used with the riser system 100. Their exact detail depends on the particular manufacturers' equipment that is adapted for use in the riser system 100.

As illustrated in FIG. 9, the riser system 100 includes a riser section 30 with end connectors 31 and a rotatable tubular 32 shown in typical position during the drilling process. This tubular 32 is shown for illustration and does not form part of the riser system 100. The section 30 may include a combination of components. For example, the section 30 may include an adapter A for enabling an inner riser section to be attached to the riser system 100. This is for the purpose of raising the overall pressure rating of the riser system being used. For example, a 21 inch marine riser system may have a rating of 2000 psi working pressure. Installing a 9⅝ inch casing riser 36 will allow the riser internally to be rated to a new higher pressure rating dependent on the casing used. The riser system 100 section will typically have a higher pressure rating to allow for this option.

The section 30 may also include adapters B1 and B2 for enabling pressure tests of the riser and pressure testing the components installed during installation, operation and trouble shooting.

The section 30 may also include adapters C1, C2, and C3, which allow insertion of BOP (Blow Out Preventer) components and RCD (Rotating Control Devices). A typical riser system 100 will have at least one RCD device installed with a back-up system for safety. This could be a second RCD, an annular BOP, a Ram BOP, or another device enabling closure around the rotatable tubular 32. In the configuration shown in FIG. 9, a variety of devices are illustrated to show the principle of the riser system 100 being universally adaptable. For example, but not intended to be limiting, C1 is a schematic depiction of an annular BOP shown as an integral part of the riser system 100. It is also possible to have an annular BOP as a device for insertion. C2 shows schematically an active (requires external input to seal) RCD adaptation and C3 shows a typical passive (mechanically sealing all the time) RCD adaptation with dual seals.

Figure 11:
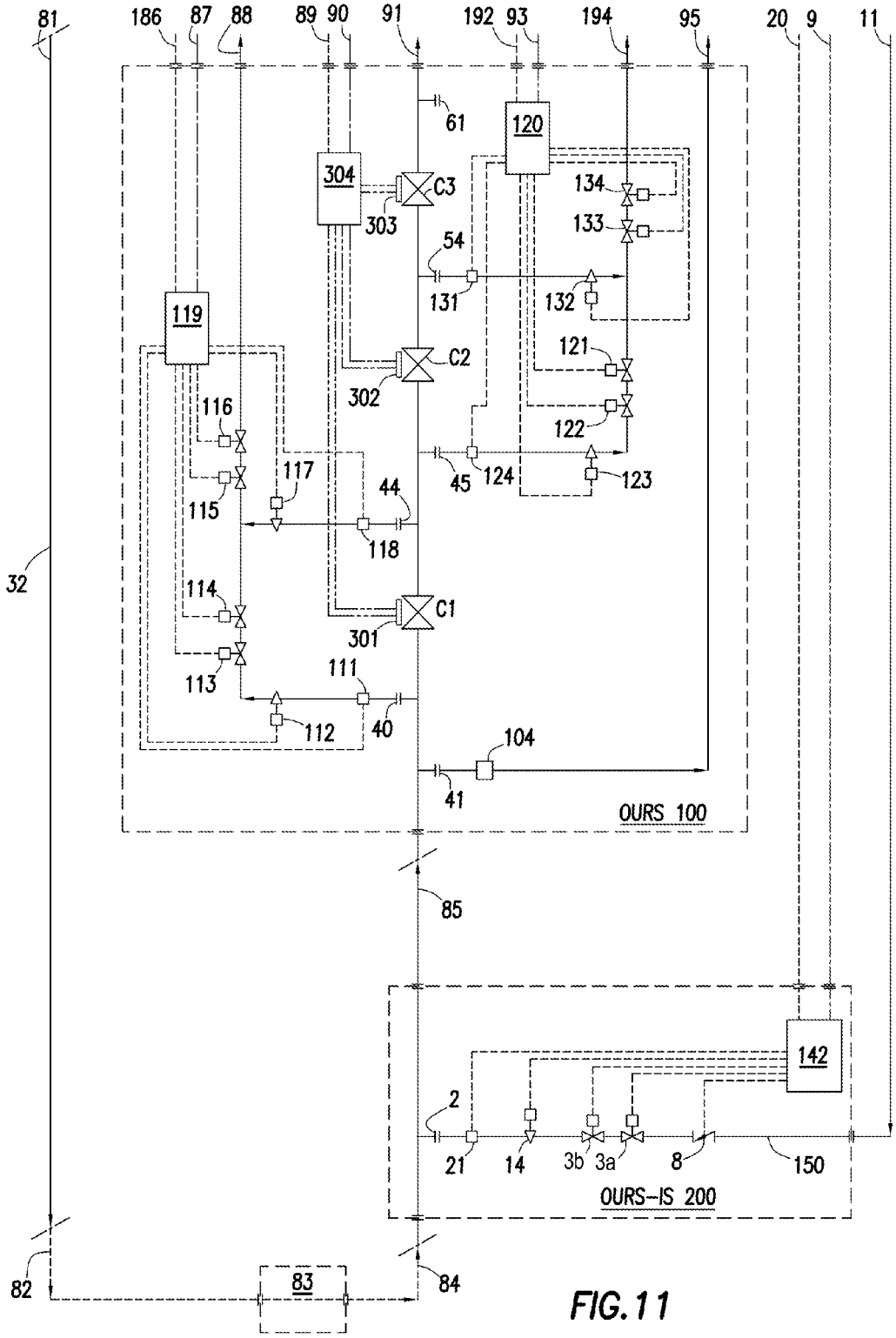
FIG. 11 is a process and instrumentation diagram (P&ID) of the riser system including the riser injection system of FIG. 10.

The riser system 100 has several outlets to enable full use of the functionality of the devices A, B, and C1-C3. These include outlet 33 which allows communication to the annulus between the inner and outer riser (if installed), inlet/outlet 40 which allows communication into the riser below the safety device installed in C1, outlet 41 which is available for use as an emergency vent line if such a system is required for a particular use of the riser system 100, outlet/inlet 44 which would be the main flow outlet (can also be used as an inlet for equalization), outlet 45 which can be used to provide a redundant flow outlet/inlet, outlet 54 which can be used as an alternative outlet/inlet and outlet 61 which can be used as an inlet/outlet. The particular configuration and use of these inlets and outlets depends on the application. For example, in managed pressure drilling, outlets 44 and 45 could be used to give two redundant outlets. In the case of mud-cap drilling, outlet 44 would be used as an inlet tied into one pumping system and outlet 45 would be used as a back-up inlet for a second pumping system. A typical hook-up schematic is illustrated in FIG. 11, which will be described later.

The details for the devices are now given to allow a fuller understanding of the typical functionality of the riser system 100. The riser system 100 is designed to allow insertion of items as required, i.e., the clearances allow access to the lowermost adapter to insert items as required, with increases in clearance from bottom to top.

Device A is the inner riser adapter and may be specified according to the provider of the inner riser system. On the lhs (left hand side) item 34 is the adapter that would be part of the riser system 100. This would have typically a seal bore and a latch recess. A protector sleeve 35 would usually be in place to preserve the seal area. On the rhs (right hand side) the inner riser is shown installed. When the inner riser 36 is run, this sleeve 35 would be removed to allow latching of the inner riser 36 in the adapter 34 with the latch and seal mechanism 37. The exact detail and operation depends on the supplier of the inner riser assembly. Once installed, the inner riser provides a sealed conduit eliminating the pressure weakness of the outer riser section 30. The riser system 100 may be manufactured to a higher pressure rating so that it could enable the full or partial pressure capability of the inner riser system. An outlet 33 is provided to allow monitoring of the annulus between inner riser 36 and outer riser 30.

Devices B1 and B2 are pressure test adapters. Normally in conventional operations the riser is never pressure tested. All pressure tests take place in the subsea BOP stack. For pressurized operations, a pressure test is required of the full riser system after installation to ensure integrity. For this pressure test, adapter B2 is required which is the same in principle as the description here for pressure test adapter B1. The riser system 100 includes an adapter 38 for the purpose of accepting a pressure test adapter 39. This pressure test adapter 39 allows passage of the maximum clearance required during the pressurized operations. It can be pre-installed or installed before pressurized operations are required. When a pressure test is required, an adapter 39*a* is attached to a tubular 32 and set in the adapter 39 as illustrated in the rhs of FIG. 9. The adapter 39*a* will lock positively to accept pressure tests from above and below. The same description is applicable for device B2, which is installed at the very top of the riser system 100, i.e., above the outlet 61. With B2, the whole riser and riser system 100 can be pressure tested to a 'test' pressure above subsequent planned pressure test. Once the overall pressure test is achieved with device B2, subsequent pressure tests will usually use device B1 for re-pressure testing the integrity of the system after maintenance on RCDs.

Device C1 is a safety device that can be closed around the rotatable tubular 32, for example but not being limited to an annular BOP 42, a ram BOP adapted for passage through the rotary table, or an active RCD device like that depicted in C2. The device C1 can be installed internally like C2 and C3 or it can be an integral part of the riser system 100 as depicted in FIG. 9. Item 42 is a schematic representation of an annular BOP without all the details. When not in use as shown on the lhs, the seal element is in a relaxed state 43*a*. When required, it can be activated and will seal around the tubular 32 as shown on the rhs with representation 43*b*. For particular applications, e.g., underbalanced flow drilling where hydrocarbons are introduced into the riser under pressure, two devices of type C1 may be installed to provide a dual barrier.

Device C2 schematically depicts an active RCD. An adapter 46 is part of the riser system 100 to allow installation of an adapter 47 with the required seal and latch systems that are designed for the particular RCD being used in the riser system 100. Both 46 and 47 have ports to allow the typical supply of hydraulic fluids required for the operation of an active RCD. A seal protector and hydraulic port isolation and seal protector sleeve 48 are normally in place when the active RCD 50 is not installed as shown on the lhs. When the use of the active RCD 50 is required, the seal protector sleeve 48 is pulled out with a running tool attached to the rotatable tubular 32. Then the active RCD 50 is installed as shown on the rhs. A hydraulic adapter manifold 51 provides communication from the hydraulic supply (not shown) to the RCD. Schematically, two hydraulic conduits are shown on the rhs. Conduit 52 supplies hydraulic fluid to energize the active element 49 and hydraulic conduit 53 typically supplies oil (or other lubricating fluid) to the bearing. A third conduit may be present (not shown) which allows recirculation of the bearing fluid. Depending on the particular type of active RCD, more or fewer hydraulic conduits may be required for other functions, e.g., pressure indication and/or latching functions.

Device C3 schematically depicts a passive RCD 58 with two passive elements 59 and 60 as is commonly used. An adapter 57 is installed in the riser system 100. It is possible to make adapters that protect the sealing surface by bore variations and in such a case for a passive head requiring no utilities (some require utilities for bearing lubrication/cooling) no seal protector sleeve is required. In this case the passive RCD 58 can be installed directly into the adapter 57 as shown on rhs with the sealing elements 59 and 60 continuously in contact with the tubular 32. This schematic installation also assumes that the latching mechanism for the RCD 58 is part of the RCD and activated/deactivated by the running tool(s).

The riser system 100 may also include other items attached to it to make it a complete package that requires no further installation activity once installed in the riser. These other items may include instrumentation and valves attached to the outlets/inlets 33, 40, 41, 44, 45, 54, 61. These are described in conjunction with FIG. 11 below. To enable full functionality of these outlet utilities and of the devices installed (A, B1, B2, C1, C2, C3) the riser system 100 includes a control system 55 that centralizes all the monitoring activities on the riser system 100 and provides a data link back to the floating drilling installation. The riser system 100 includes another control system 55 that provides for control of hydraulic functions of the various devices and an accumulator package 56 that provides the reserve pressure for all the hydraulic utilities. Other control/utility/supply boxes may be added as necessary to minimize the number of connections required back to surface.

Referring to FIG. 11, this shows the typical flow path through the riser system 100 and injection system 200. Drilling fluid 81 flows down the rotatable tubular 32, exiting at the drilling bit 82. Then the fluid is a mixture of drilling fluid and cuttings that is returning in the annulus between the rotatable tubular and the drilled hole. The flow passes through a subsea BOP 83 if installed and then progresses into the riser string 84. The injection system 200 can inject variable density fluid into this return flow. The flow 85 continues as a mixture of drilling fluid, cuttings, and variable density fluid introduced by the injection system 200 up the riser into the riser system 100. There it passes through the safety devices C1, C2, and C3 and proceeds into the slip joint 91 if none of the devices is closed.

Outlet 41 is connected to a safety device 104 that allows for pressure relief back to the floating drilling installation through line 95. This safety device 104 may be a safety relief valve or other suitable system for relieving pressure.

Devices C1, C2, and C3 are connected through their individual control pods 301, 302, and 303 respectively to a central electro-hydraulic control system 304 that also includes accumulators. It has an electric line 89 and a hydraulic line 90 back to the floating drilling installation. In concept, the usage of the different connections is similar so the following description for items 40, 111, 112, 113, 114, and 119 is the same as for: 44, 118, 117, 115, 116 and 119; and for 45, 124, 123, 122, 121 and 120; as well as for 54, 131, 132, 133, 134 and 120.

How many of these sets of connections and valves are installed is dependent on the planned operation, number of devices (C1, C2, and C3) installed, and the degree of flexibility required. A similar set of items can be connected to outlet 61 if required.

Taking outlet/inlet 40 as a typical example of the above listed sets, an instrument adapter or sensor 111 which can measure any required data, typically pressure and temperature, is attached to the line from outlet 40. The flow then goes through this line via a choking system 112 that is hydraulically or otherwise controlled, then through two hydraulically controlled valves 113 and 114 of which at least one is fail closed. The flow can then continue up line 88 back to the floating drilling installation. Flow can also be initiated in reverse down this line 88 if required. A similar line 194 is provided connected to outlet/inlet 45.

Sensor 111 can monitor parameters (such as pressure and/or temperature, etc.) in the interior of the riser section 30, riser string 84 or riser string 206 (described below) below the annular BOP 42 or the valve module 202 described below (see FIGS. 12 & 13). Sensors 118, 124 can monitor parameters (such as pressure and/or temperature, etc.) in the interior of the riser section 30 or riser string 84 or 206 between the annular BOP 42 or valve module 202 and the active RCD 50 or annular seal module 224 (described below, see FIGS. 14 & 15). Sensor 131 can monitor parameters (such as pressure and/or temperature, etc.) in the interior of the riser section 30 or riser string 84 or 206 between the active RCD 50 or annular seal module 224 and the passive RCD 58 or annular seal module 222 (described below, see FIGS. 16 & 17). Further or different sensors may be used to monitor, store and/or transmit data indicative of any combination of parameters, as desired.

As depicted, FIG. 11 is a typical process and instrumentation diagram and can be interpreted as such, meaning any variation of flow patterns as required can be obtained by opening and closing of valves in accordance with the required operation of the devices C1, C2, and C3 which can be closed or opened (except, for example, the passive RCD 58 depicted in FIG. 9, which is normally always closed).

The control systems 55 described above are depicted in further detail in FIG. 11 as control systems 119, 120, 304. These control systems 119, 120, 304 are located subsea external to the riser string 84 or 206 and centralize electrical and hydraulic connections to the subsea valves 113, 114, 115, 116, 121, 122, 133, 134, so that fewer electrical and hydraulic lines are needed to the surface.

Control system 119 is connected to electric line 186 and hydraulic supply line 87 for controlling actuation of valves 113, 114, 115, 116 and chokes 112, 117. Control system 119 also receives data signals from sensors 111, 118. Control signals from the surface may be multiplexed on the electric line 186, and data signals from the sensors 111, 118 may also be multiplexed on the electric line 186.

Figure 6A:
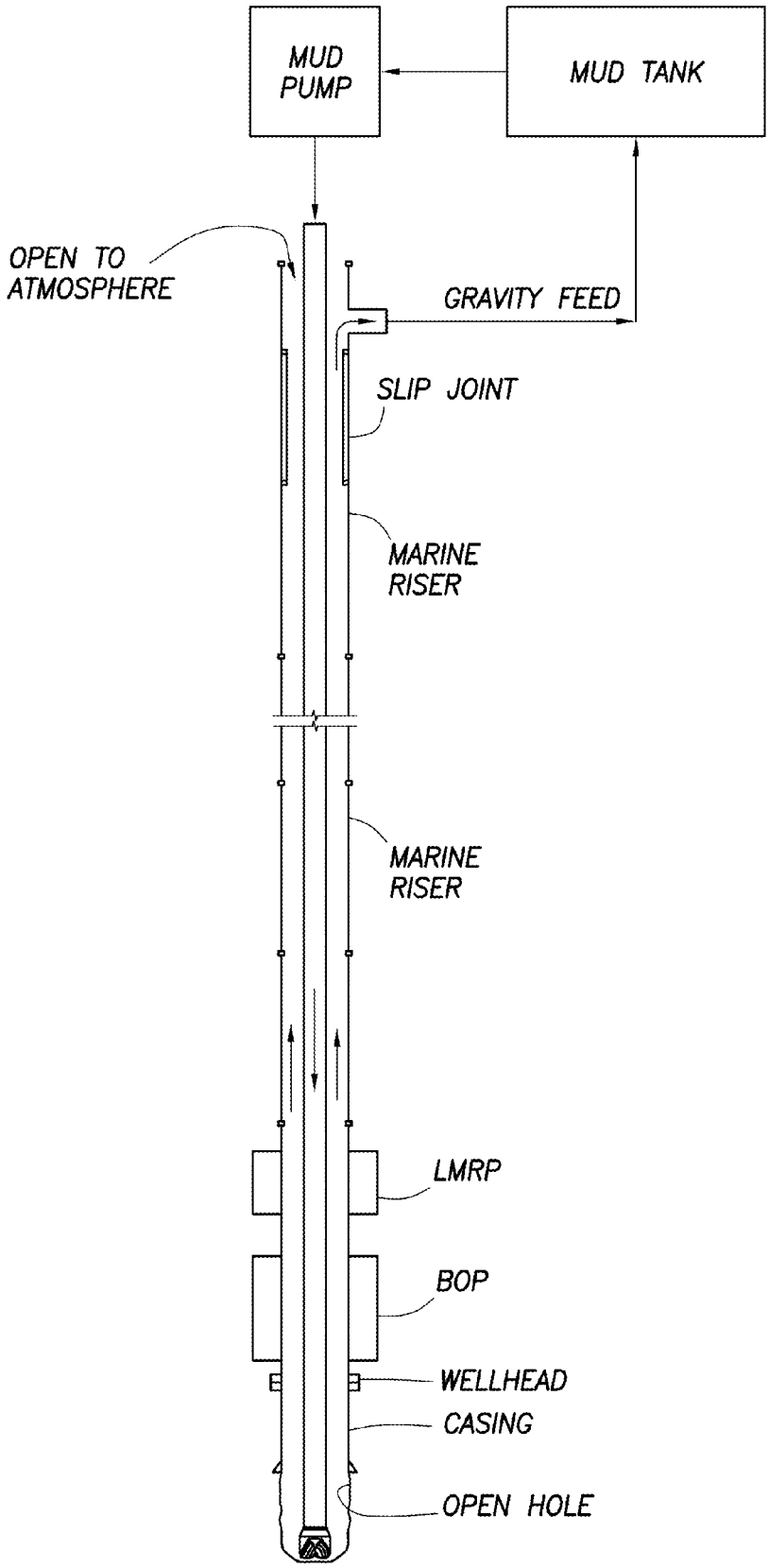
FIG. 6*a* is a schematic view of fluid flow in a prior art concept of conventional drilling.
Figure 6B:
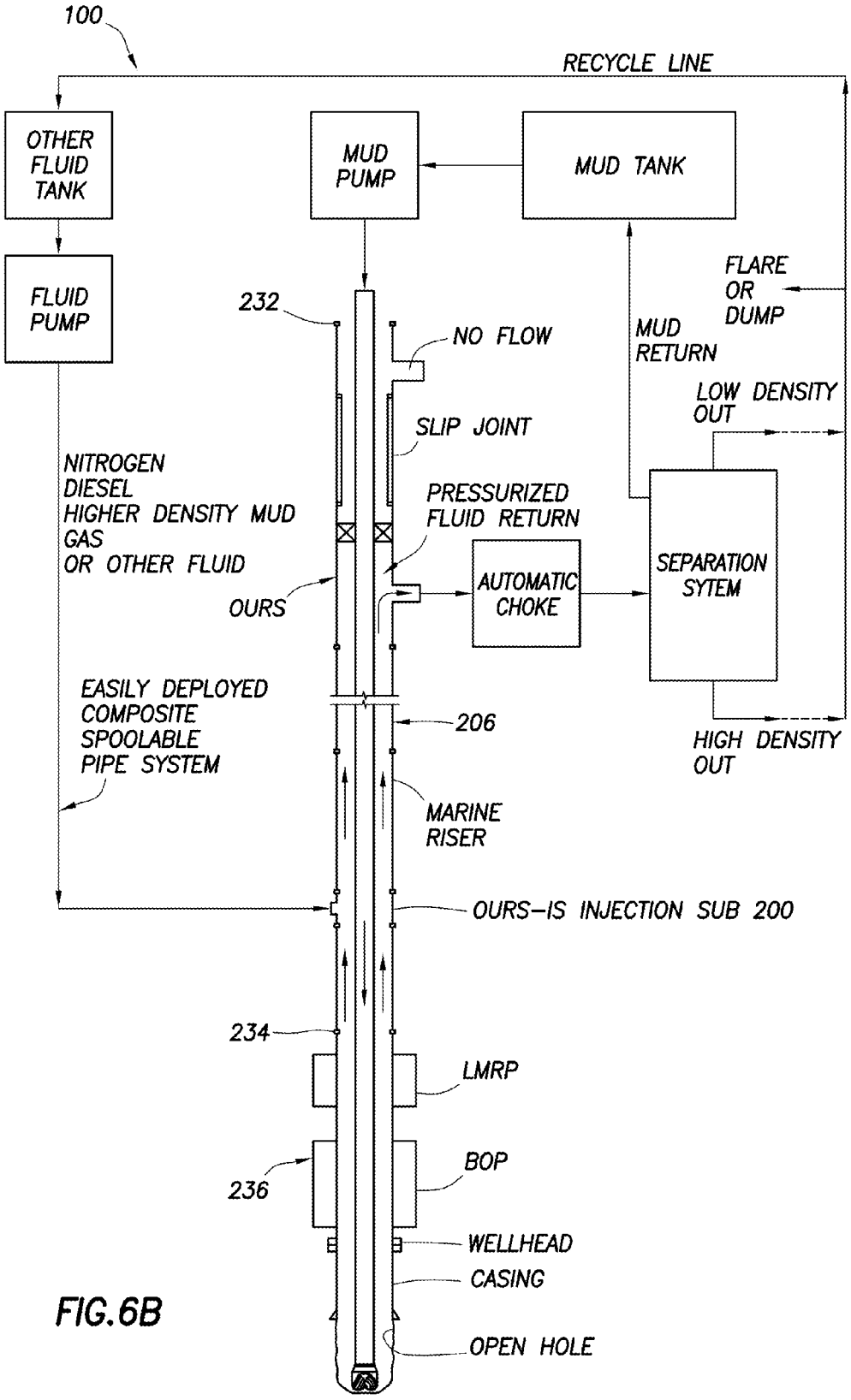
FIG. 6*b* is a schematic view of a concept of closed system drilling embodying principles of the present invention.
Figure 7:
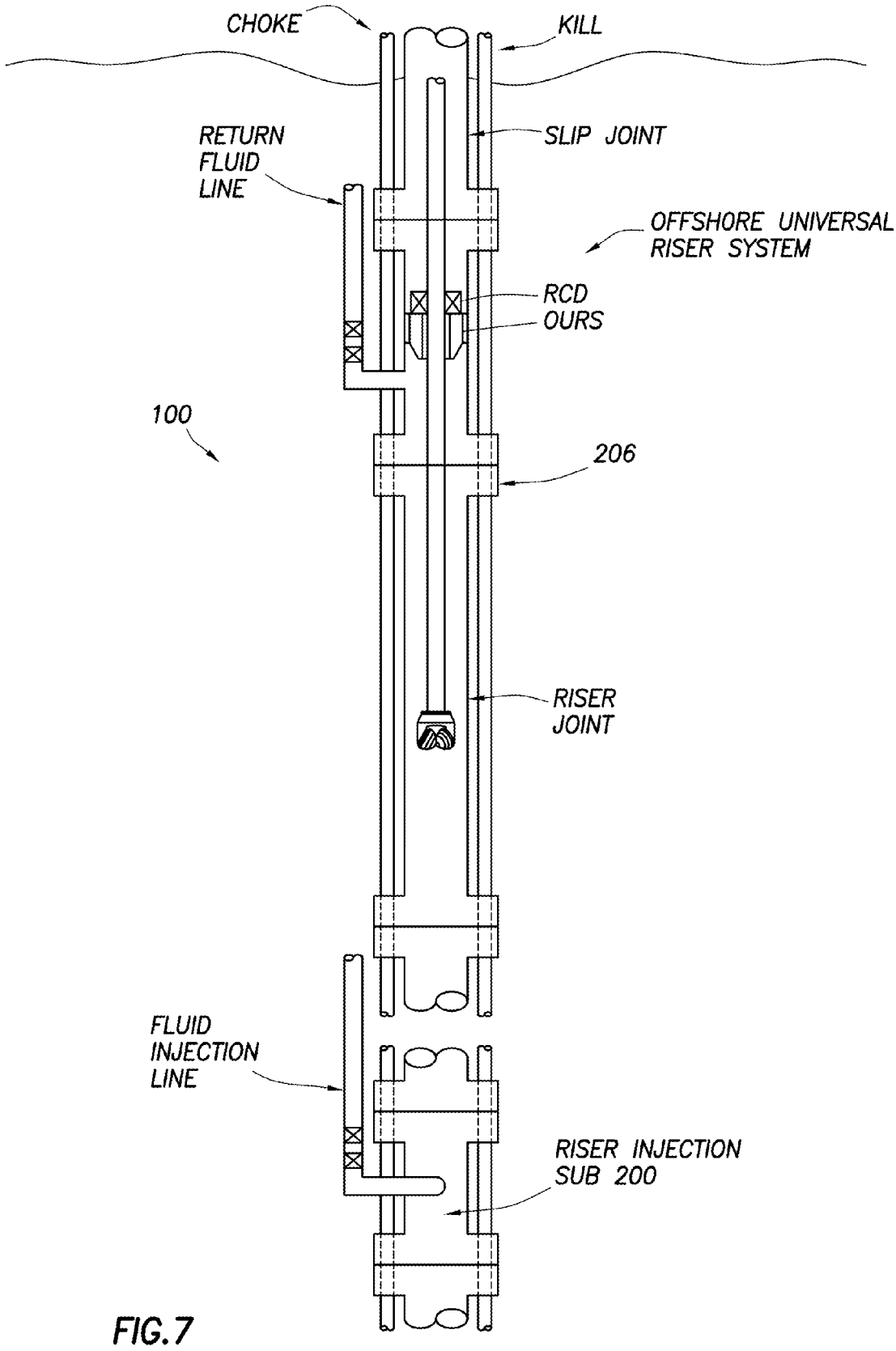
FIG. 7 is a further detailed schematic elevation view of another alternate configuration of a riser system and method embodying principles of the present invention.

If outlet 44 is used for return flow of drilling fluids during drilling, then choke 117 may be used to regulate back pressure in the riser string 84 for managed pressure drilling to maintain a desired constant or selectively varying downhole pressure (for example, a bottomhole pressure at the drill bit depicted in FIG. 6B). The choke 117 may be automatically controlled via the control system 119 in conjunction with a surface control system 18 (see FIG. 10), for example, to enable automatic control of the choke without need for human intervention (although human intervention may be provided for, if desired).

Control system 120 is connected to electric line 192 and hydraulic supply line 93 for controlling actuation of valves 121, 122, 133, 134 and chokes 123, 132. Control system 120 also receives data signals from sensors 124, 131. Control signals from the surface may be multiplexed on the electric line 192, and data signals from the sensors 124, 131 may also be multiplexed on the electric line 192.

If outlet 45 or 54 is used for return flow of drilling fluids during drilling, then choke 123 or 132 may be used to regulate back pressure in the riser string 84 for managed pressure drilling to maintain a desired constant or selectively varying downhole pressure (for example, a bottomhole pressure at the drill bit depicted in FIG. 6B). The choke 123 or 132 may be automatically controlled via the control system 120 in conjunction with a surface control system (not shown), for example, to enable automatic control of the choke without need for human intervention (although human intervention may be provided for, if desired).

Control system 304 is connected to electric line 89 and hydraulic supply line 90 for controlling operation of the control pods 301, 302, 303. The control pods 301, 302, 303 include valves, actuators, accumulators, sensors for actuating and monitoring operation of the various modules (e.g., annular BOP 42, active RCD 50, passive RCD 58, valve module 202 and/or annular seal modules 222, 224, 226) which may be installed in the riser section 30 or riser string 84 or 206.

Figure 30:
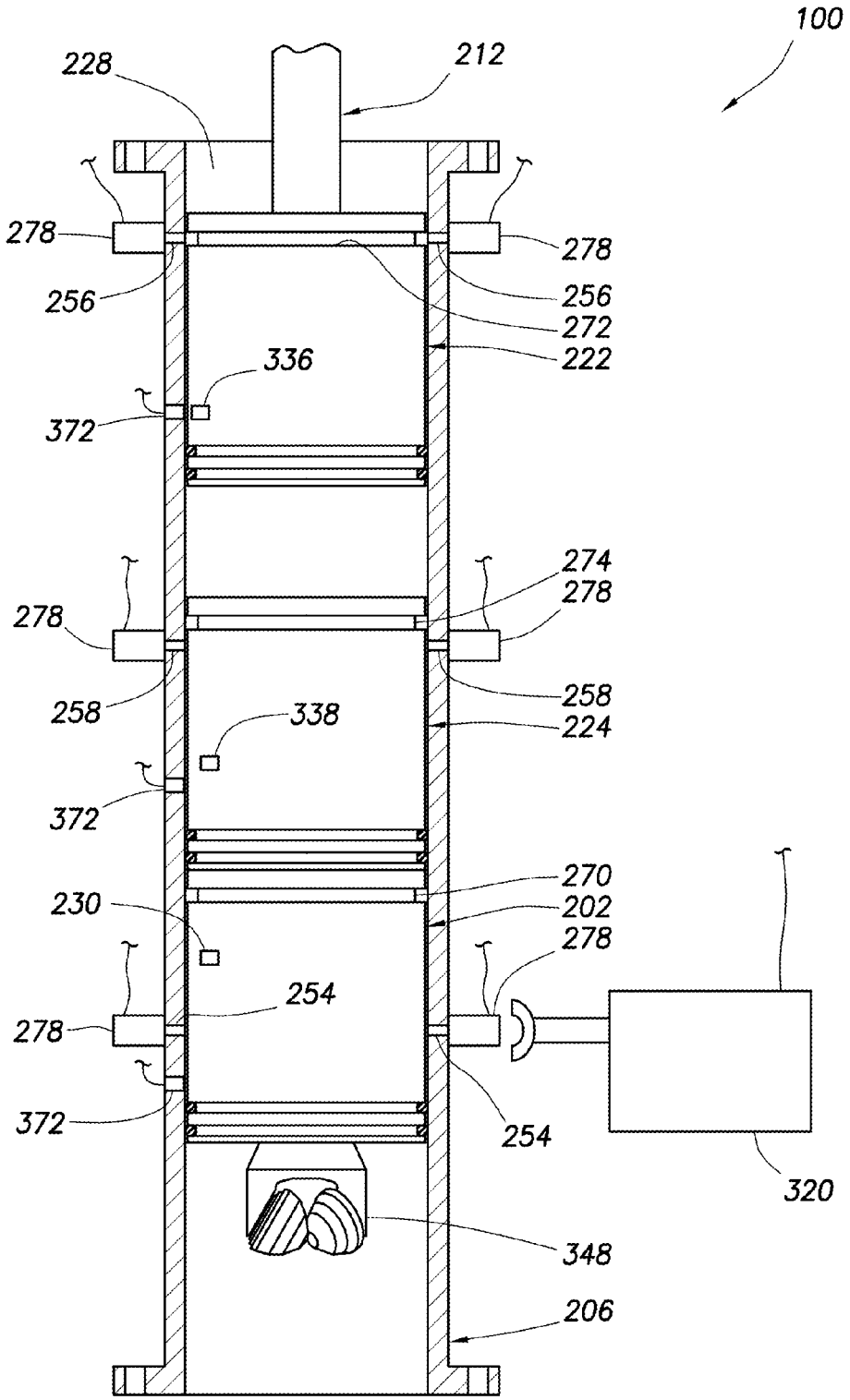
FIG. 30 is a schematic partially cross-sectional view of a method whereby multiple modules may be retrieved in the riser system and method of FIG. 12.

Any of the subsea control systems 119, 120, 304 can be replaced by means of a subsea remotely operated vehicle 320 (see FIG. 30). Thus, in the event of failure, malfunction, updating or requirement for maintenance of any of the control systems 119, 120, 304, this can be accomplished without need for disturbing the riser string 84 or 206.

Variable density fluid is injected down conduit 11 to the injection system 200 and the detailed description for this operation is described more fully below.

Figure 10:
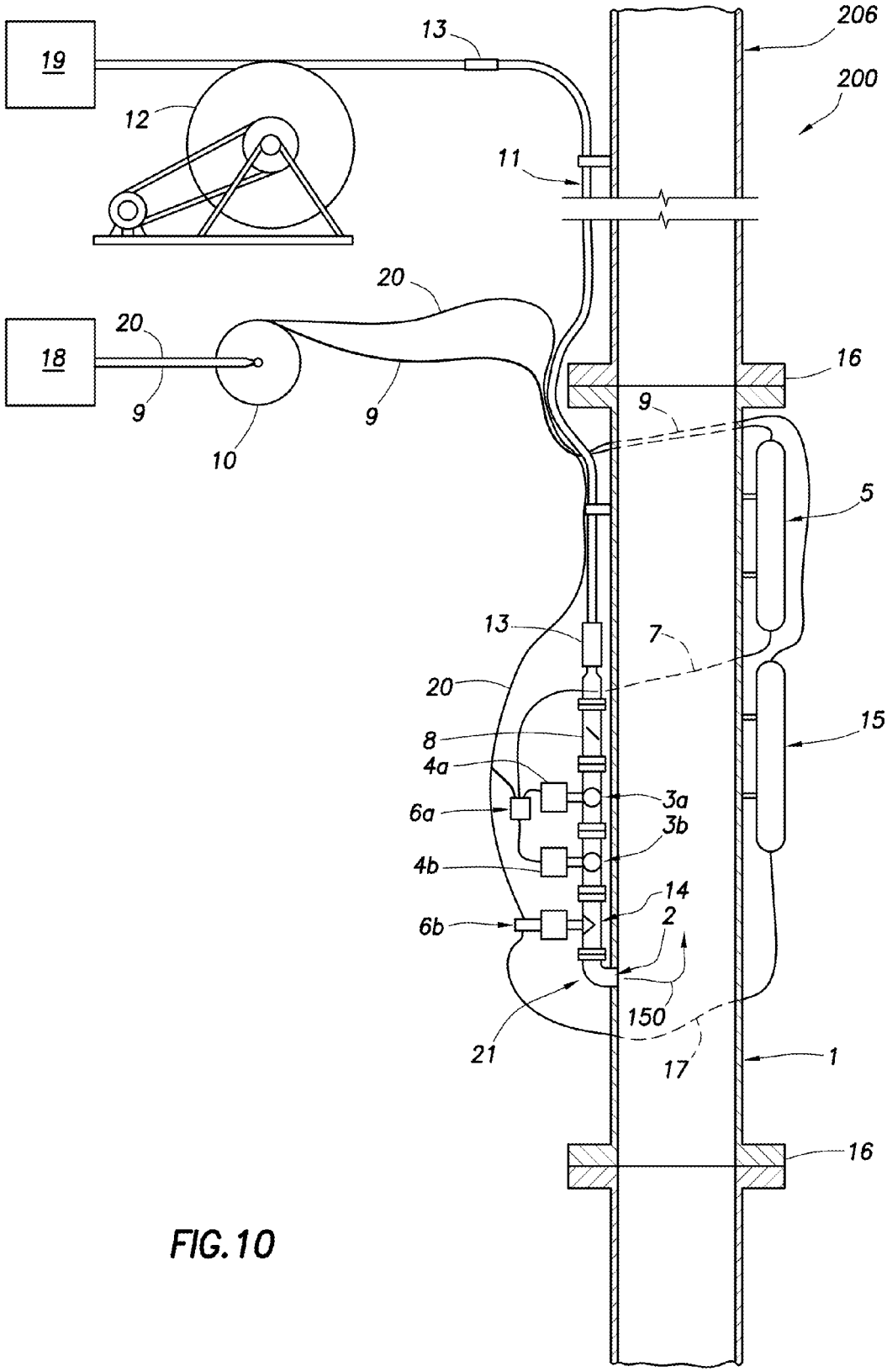
FIG. 10 is a schematic cross-sectional view of a riser injection system which may be used with any riser system and method embodying principles of the present invention.

Referring to FIG. 10, the injection system 200 consists of a riser section (usually a shorter section called a pup) which has an inlet, and a composite hose system, or other suitable delivery mechanism to allow injection of different density fluids into the riser at any point between the subsea BOP and the top of the riser system 100.

The injection system 200 can be used independently of or in conjunction with the riser system 100 on any floating drilling installation to enable density variations in the riser. In managed pressure or underbalanced drilling operations, the injection system 200 may be used to inject a fluid composition 150 into the riser string 84 which has less density than the drilling fluid 81 returned from the wellbore during drilling.

The injection system 200 allows the injection into the riser of a fluid composition 150 including, for example, Nitrogen or Aphrons (hollow glass spheres), or fluids of various densities which will allow hydrostatic variations to be applied to the well, when used in conjunction with a surface or sub surface choke. As described previously, the injection system 200 is a conduit through which a Nitrogen cushion could be applied and maintained to allow more control of the BHP by manipulation of the surface choke, density of fluid injected, and injection rate both down the drill string and into the annulus through the injection system 200.

The injection system 200 externally includes all the usual riser connections and attachments required for a riser section. Additionally, the injection system 200 includes provision for mounting an accumulator(s) (shown), provision for accepting instrumentation for measuring pressure, temperature, and any other inputs or outputs. Emergency shut down system(s) remote operated valve(s), a hydraulic bundle line supplying hydraulic fluid, hydraulic pressure and control signals to the valve, and choke systems may also be included on the injection system 200.

The injection system 200 may be based solely on a hydraulic system, a hydraulic and electric bundle line for instrumentation or other electrical control requirements, or a full MUX (Multiplex) system. A choking system may also be inserted in the fluid injection conduit (shown) that is remotely and automatically controlled.

A riser section 1, which may be a riser pup, of the same design as the riser system with the same end connections 16 as the riser system is the basis of the injection system 200. This riser section 1 includes a fluid injection connection 2 with communication to the inside of the riser section 1. This connection 2 can be isolated from the riser internal fluid by hydraulically actuated valves 3*a* and 3*b* fitted with hydraulic actuators 4*a* and 4*b*. The injection rate can be controlled both by a surface control system 19 (pump rate and/or choke) and subsea by a remotely operated choke 14. As added redundancy, one or more non-return valve(s) 8 may be included in the design. The conduit to supply the injection fluid from surface to the injection system 200 is shown as a spoolable composite conduit 11, which can be easily clamped to the riser or subsea BOP guidelines (if water depth allows and they are in place). Composite pipe and spooling systems as supplied by the Fiberspar Corporation are suitable for this application. The composite conduit 11 is supplied on a spoolable reel 12. The composite conduit 11 can be easily cut and connectors 13 fitted in-situ on the floating drilling installation for the required length. The operating hydraulic fluid for the actuators 4*a* and 4*b* of subsea control valves 3*a* and 3*b* and hydraulic choke 14 can be stored on the injection system 200 in accumulators 5 and 15, respectively. They can be individual, independent accumulator systems or one common supply system with electronic control valves as supplied in a MUX system. The fluid to the accumulators 5, 15 is supplied and maintained through hydraulic supply lines 9 from hydraulic hose reel 10 supplied with hydraulic fluid from a surface hydraulic supply and surface control system 18. As discussed above, the surface control system 18 may also be used to control operation of subsea control systems 119, 120, 304, although additional or separate surface control system(s) may be used for this purpose, if desired.

Hydraulic fluid for the valve actuators 3*a* and 3*b* from the accumulator 5 is supplied through hose 7 and hydraulic fluid from accumulator 15 is supplied through hose 17 to hydraulic choke 14. Electro-hydraulic control valve 6*a* for actuators 4*a* and 4*b* allows closing and opening of valves 3*a* and 3*b* by way of electrical signals from surface supplied by electric line 20 and electro-hydraulic control valve 6*b* allows closing and opening of the hydraulic choke 14 similarly supplied by control signal from surface by line 20.

During conventional drilling operations, the valves 3*a* and 3*b* are closed and the injection system 200 acts like a standard section of riser. When variable density operations are required in the riser, valves 3*a* and 3*b* are opened by hydraulic control and a fluid composition 150 including, e.g., Nitrogen is injected by the surface system 19 through the hose reel 12 down the conduit 11 into the riser inlet connection 2. The rate can be controlled at the surface system 19 and/or by the downhole choke 14 as required. One of the hydraulic control valves 3*b* is set up as a fail-safe valve, meaning that if pressure is lost in the hydraulic supply line it will close, thus always ensuring the integrity of the riser system. Similarly, when a return to conventional operations is required, fluid injection is stopped and the valves 3*a* and 3*b* are closed.

The injection system 200 may include, as illustrated in FIG. 11, pressure and temperature sensors 21, plus the required connections and systems going to a central control box 142 (see FIG. 11) to transmit these to surface. The valves 3*a*, 3*b* and choke 14 may be operated by hydraulic or electric signal and cables 9, 20 run with the reel 10 or by acoustic signal or other system enabling remote control from surface.

In FIG. 11 the variable density fluid composition 150 is injected down the conduit 11, through a non-return valve 8, two hydraulic remote controlled valves 3*a* and 3*b*, then through a remote controlled choke 14 into inlet 2. Sensors 21 allow the measurement of desired data which is then routed to the control system 142 which consists of controls, accumulators which receive input/output signals from line 20 and hydraulic fluid from line 9.

An example use and operating procedure are described here for a typical floating drilling installation to illustrate an example method of use of the system.

The riser system 100 will be run as a normal section of riser through the rotary table RT, thus not exceeding the normal maximum OD for a 21 inch riser system of about 49 inches or 60 inches as found on newer generation floating drilling installations. It will have full bore capability for 18¾ inch BOP stack systems and be designed to the same specification mechanically and pressure capability as the heaviest wall section riser in use for that system. An injection system 200 will be run in the lower part of the riser with spoolable composite pipe (FIBERSPAR™, a commercially available composite pipe, is suitable for this application).

In normal drilling operations with, e.g., a plan to proceed to managed pressure drilling, the riser system 100 and injection system 200 will be run with all of the external components installed. The riser system 100 and injection system 200 will be installed with seal bore protector sleeves 35, 48 in place and pressure tested before insertion into riser. During conventional drilling operation the inlet and outlet valves will be closed and both the riser system 100 and injection system 200 will act as normal riser pup joints. The riser system 100 will be prepared with the correct seal bore adapters for the RCD system to be used.

When pressurized operations are required, the injection system 200 is prepared and run as part of the riser inserted at the point required. The necessary connections for control lines 9, 20 are run, as well as the flexible conduit 11, for injecting fluids of variable density in the fluid composition 150. The cables and lines are attached to the riser or to the BOP guidelines if present. Valves 3*a* and 3*b* are closed.

The riser system 100 is prepared with the necessary valves and controls as shown in FIG. 11. All the valves are closed. The hoses and lines are connected as necessary and brought back to the floating drilling installation.

Pipe will be run in hole with a BOP test adapter. The test adapter is set in the subsea wellhead and the annular BOP C3 is closed in the riser system 100. A pressure test is then performed to riser working pressure. The annular BOP C3 in the riser system 100 is then opened and the pressure test string is pulled out. If the subsea BOP has rams that can hold pressure from above, a simpler test string can be run setting a test plug in adapter B2 on the riser system 100 (see FIG. 9).

When the riser system 100 is required for use, an adapter 39 will be run in the lower nipple B1 of the riser system 100 to provide a pressure test nipple similar to that of the smallest casing string in the wellhead so that subsequent pressure tests do not require a trip to subsea BOP.

The seal bore protector sleeve 48 for the RCD adapter C2 may be pulled out. Then the RCD 50 can be set in C2. Once set, the RCD 50 is function tested.

The rotatable tubular 32 is then run in hole with the pressure test adapter 39*a* for the riser system 100 until the adapter 39*a* is set in adapter 39 (already prepared as part of a previous step). The RCD 50 is then closed and, for active systems only, fluid is circulated through the riser system 100 using, e.g., outlet 44. The outlet 44 is then closed and the riser is pressure tested. Once pressure tested, the pressure is bled off and the seal element on the RCD 50 is released. The test assembly is then pulled out of the riser system 100. A similar method may be completed to set another RCD 58 in section C3.

The drilling assembly is then run in hole and circulation at the drilling depth is established. The pumps are then stopped. Once stopped, the RCD 50 seal element is installed (only if needed for the particular type of RCD), and the RCD 50 is activated (for active systems only). The mud outlet 44 on the riser system 100 is then opened. Circulation is then established and backpressure is set with an automated surface choke system or, alternatively, the choke 112 connected to the outlet 44. If a change in density is required in the riser fluid, choke 14 (see FIG. 11) is closed on the injection system 200 and valves 3*a*, 3*b* are opened. A fluid composition 150, including, but not limited to, Nitrogen is circulated at the desired rate into return flow to establish a cushion for dampening pressure spikes. It should be appreciated that Nitrogen is only an example, and that other suitable fluids may be used. For example, a fluid composition 150 containing compressible agents (e.g., solids or fluids whose volume varies significantly with pressure) may be injected into the riser at an optimum point in order to provide this damping. Drilling is then resumed.

Figure 3F:
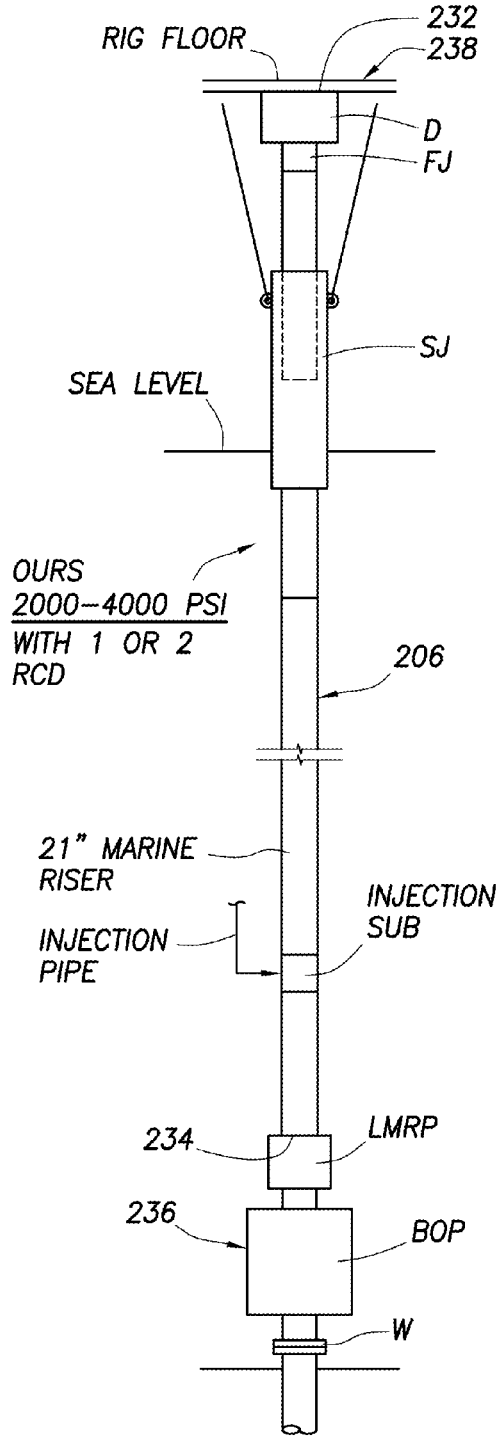
FIG. 3*f* is a schematic elevation view of a riser system and method embodying principles of the present invention as incorporated into the system of FIG. 3*a;*
Figure 3G:
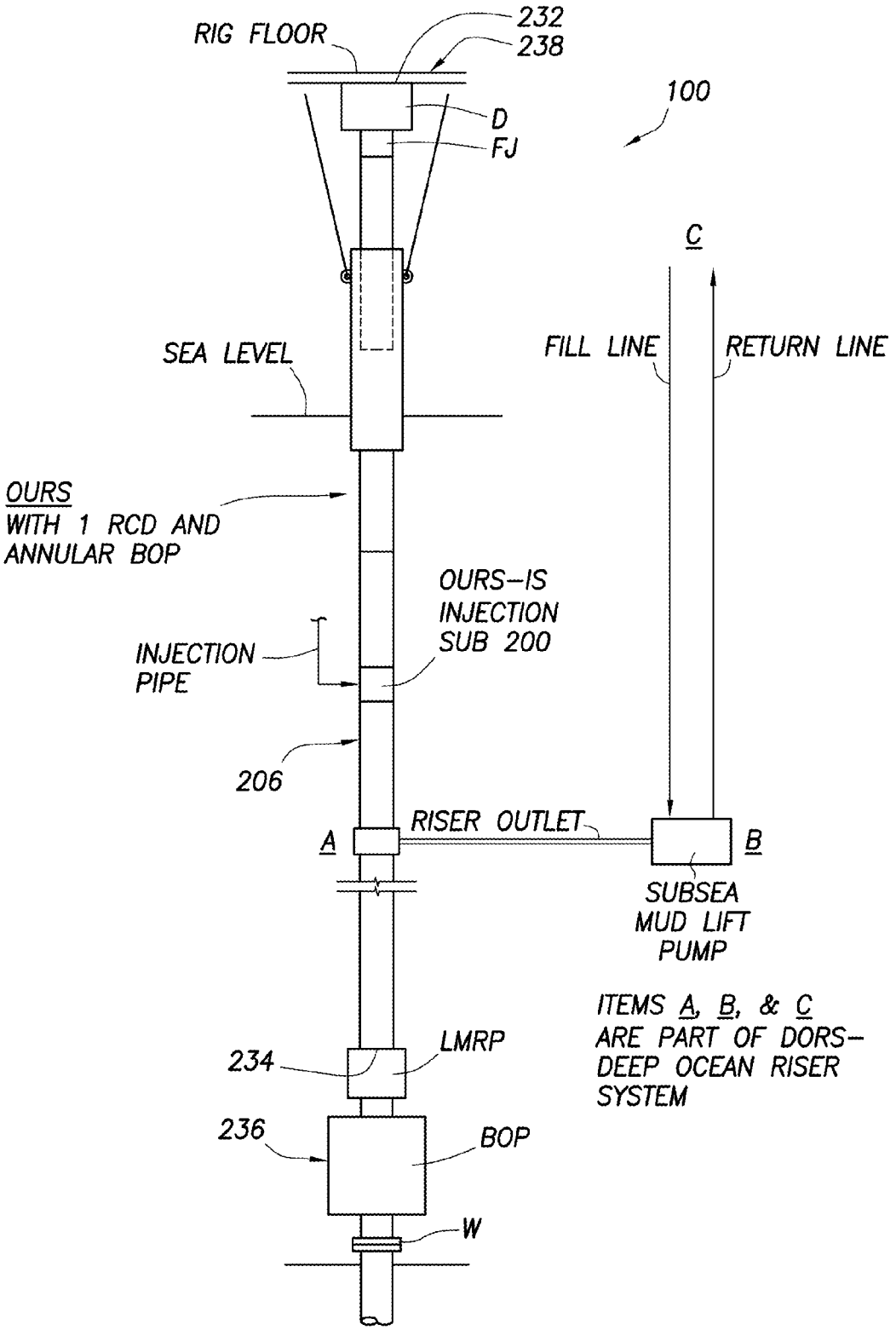
FIG. 3*g* is a schematic elevation view of an alternate configuration of a riser system and method embodying principles of the present invention as incorporated into a DORS (deep ocean riser system)
Figure 4:
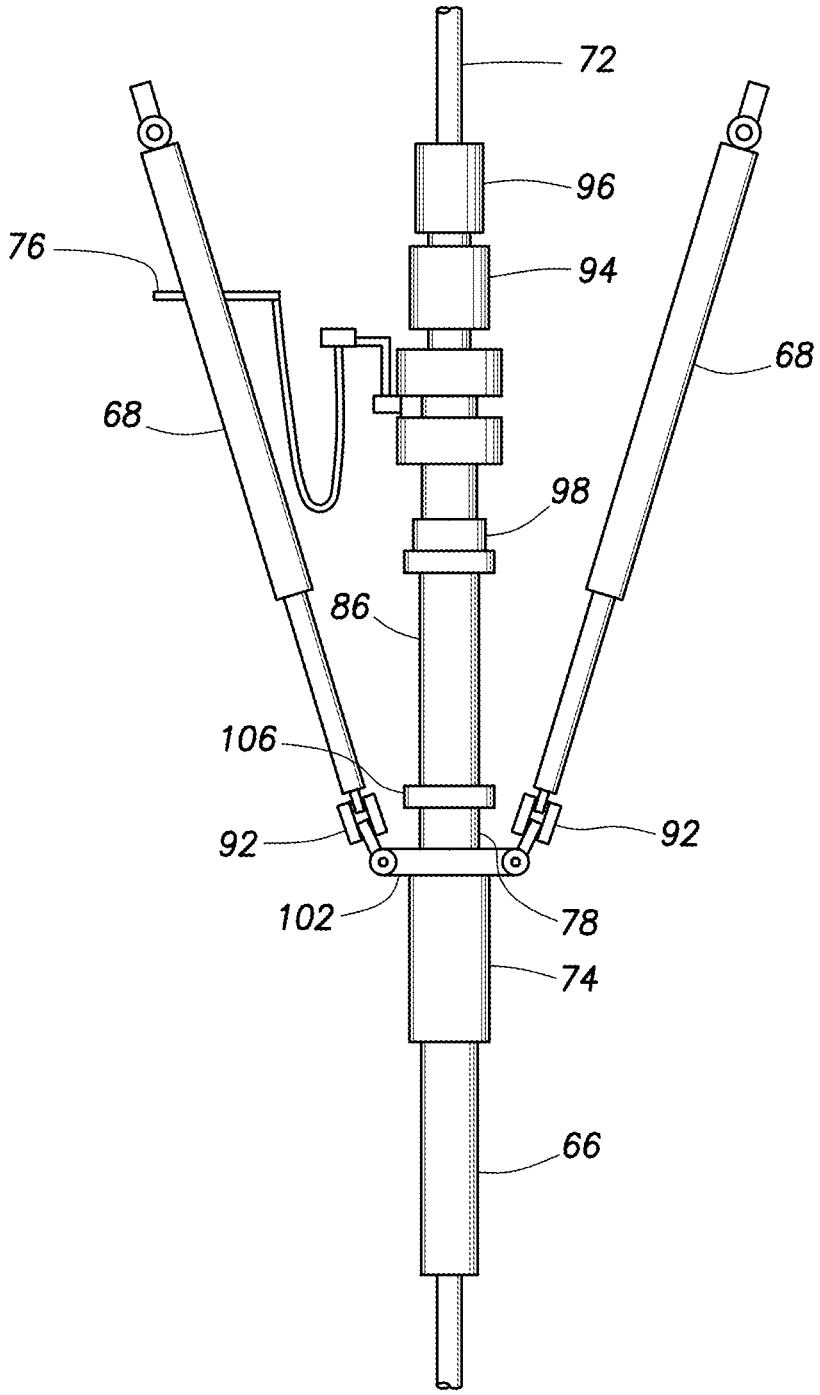
FIG.4 (PRIOR ART)
FIG. 4 is an elevation view of a prior art riser system similar to the system of FIG. 3*b*, utilizing a surface BOP.
Figure 5:
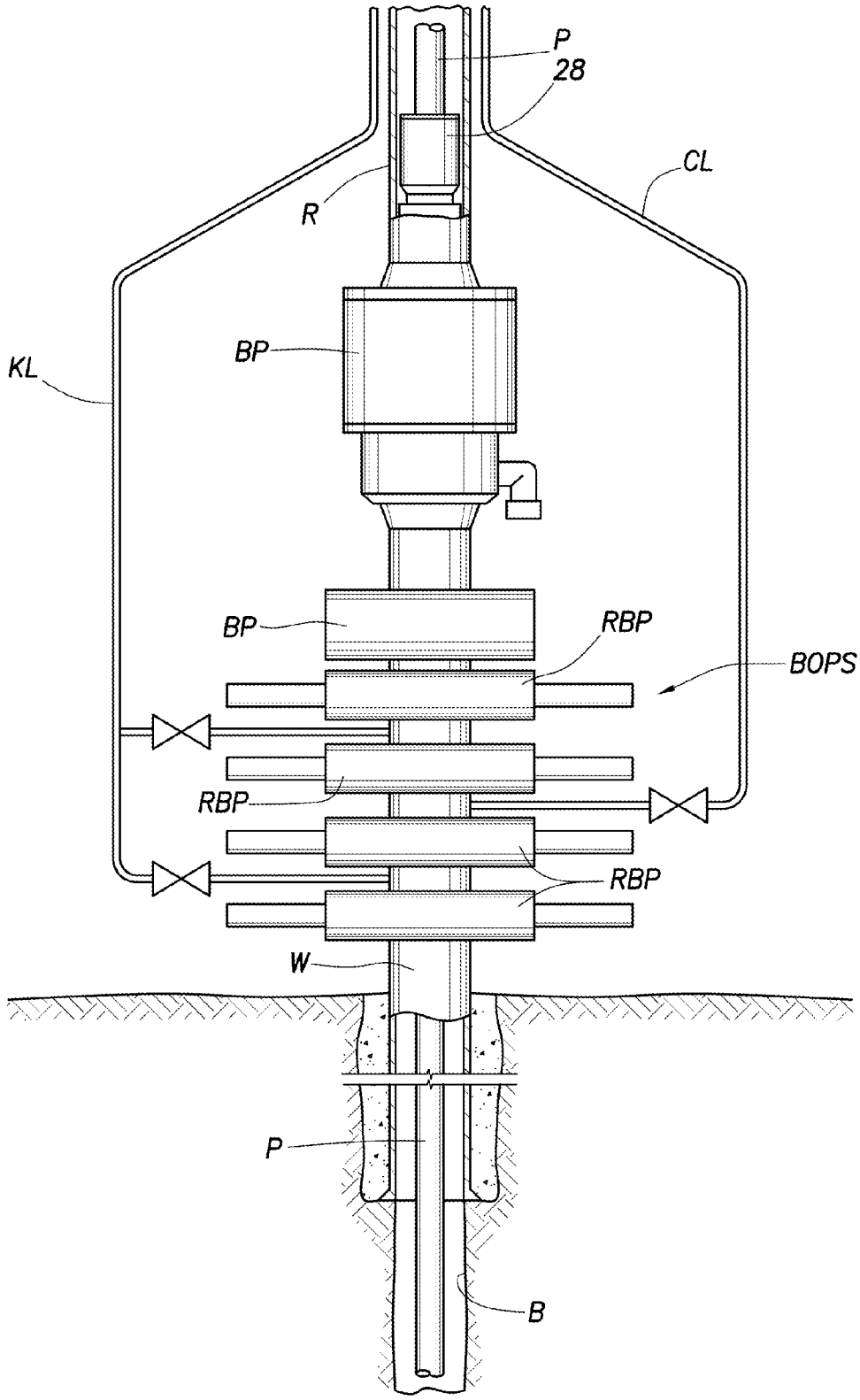
FIG.5 (PRIOR ART)
FIG. 5 is an elevation view of a prior art riser system having a rotating control device attached to a top of a subsea BOP stack.

The system is shown in FIG. 3*f* and depicted schematically in FIG. 6*b* for comparison to the conventional system of FIG. 6*a*. A typical preferred embodiment for the drilling operation using this invention would be the introduction of Nitrogen under pressure into the return drilling fluid flow stream coming up the riser. This is achieved by the presently described invention by the injection system 200 with an attached pipe that can be easily run as part of any of the systems depicted in FIGS. 3*a-g*.

Variations of the above method with the riser system 100 and injection system 200 will enable a variety of drilling permutations that require pressurized riser operations, such as but not limited to dual density or dual gradient drilling; managed pressure drilling (both under and overbalanced mud weights); underbalanced drilling with flow from the formation into the wellbore; mud-cap drilling, i.e., injection drilling with no or little return of fluids; and constant bottom hole pressure drilling using systems that allow continuous circulation. The riser system 100/injection system 200 enables the use of DAPC (dynamic annular pressure control) and SECURE (mass balance drilling) systems and techniques. The riser system 100/injection system 200 also enables the use of pressurized riser systems with surface BOP systems run below the water line. The riser system 100/injection system 200 can also be used to enable the DORS (deep ocean riser system). The ability to introduce Nitrogen as a dampening fluid will for the first time give a mechanism for removing or very much reducing the pressure spikes (surge and swab) caused by heave on floating drilling installations. The riser system 100/injection system 200 enables a line into the interior of any of the riser systems depicted in FIGS. 3*a-g* and allows the placement of this line at any point between the surface and bottom of the riser. The riser system 100 and injection system 200 can be used without a SBOP, thus substantially reducing costs and enabling the technology shown in FIG. 3*g*. The riser system depicted in FIG. 3*g* also illustrates moving the injection system 200 to a higher point in the riser.

As described above, the riser system 100 and injection system 200 may be interconnected into an otherwise conventional riser string. The riser system 100/injection system 200 provides a means for pressurizing the marine riser to its maximum pressure capability and easily allows variation of the fluid density in the riser. The injection system 200 includes a riser pup joint with provision for injecting a fluid into the riser with isolation valves. The riser system 100 includes a riser pup joint with an inner riser adapter, a pressure test nipple, a safety device, outlets with valves for diverting the mud flow and nipples with seal bores for accepting RCDs. The easy delivery of fluids to the lower injection pup joint (injection system 200) is described. A method is detailed to manipulate the density in the riser to provide a wide range of operating pressures and densities enabling the concepts of managed pressure drilling, dual density drilling or dual gradient drilling, and underbalanced drilling.

Referring additionally now to FIGS. 12-31, an alternate configuration of the riser system 100 is schematically and representatively illustrated. The riser system 100 of FIGS. 12-31 includes many elements which are similar in many respects to those described above, or which are alternatives to the elements described above.

Figure 12:
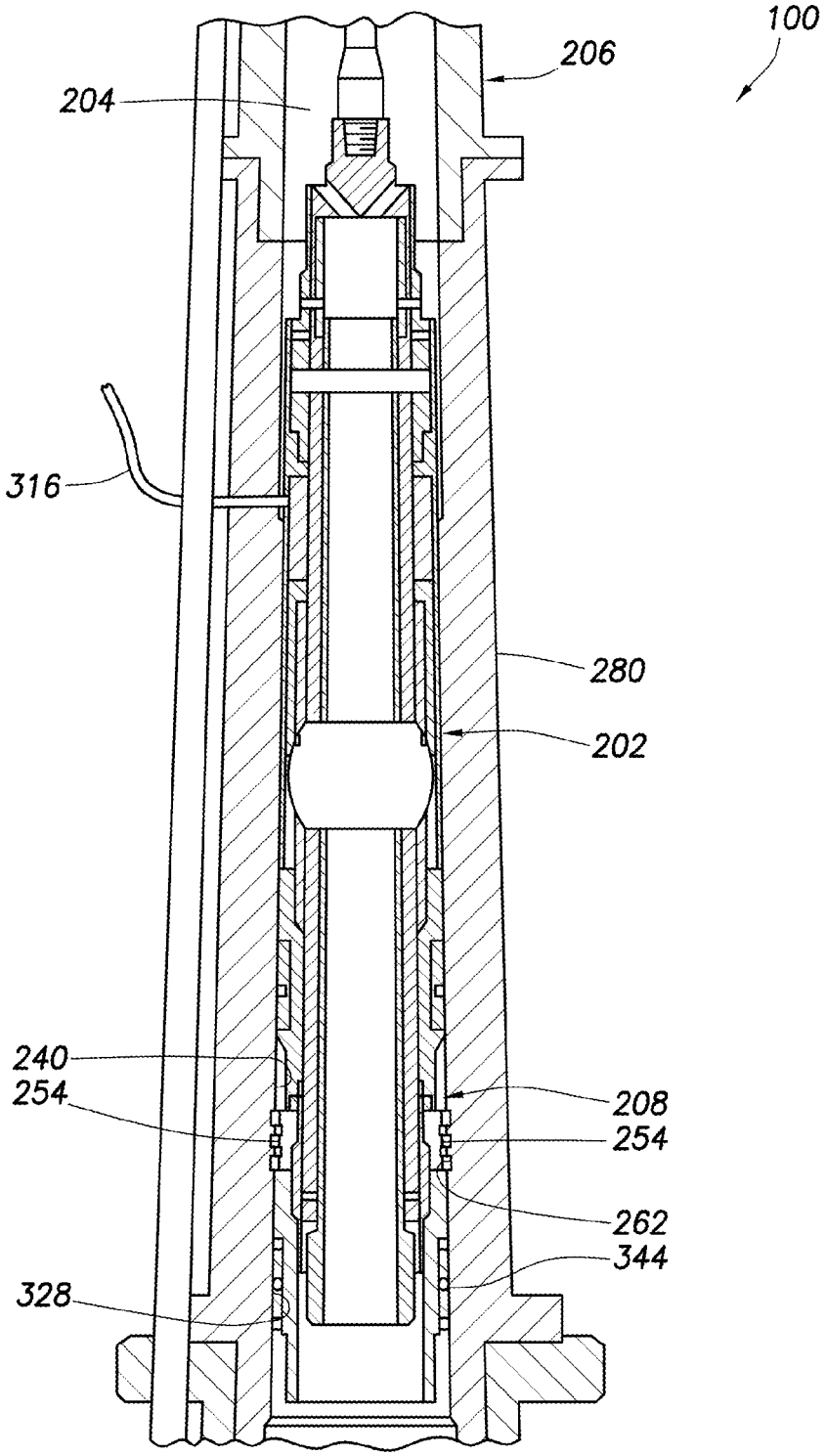
FIG. 12 is a schematic cross-sectional view of another alternate configuration of the riser system and method embodying principles of the present invention, showing installation of a valve module in the riser system.
Figure 13:
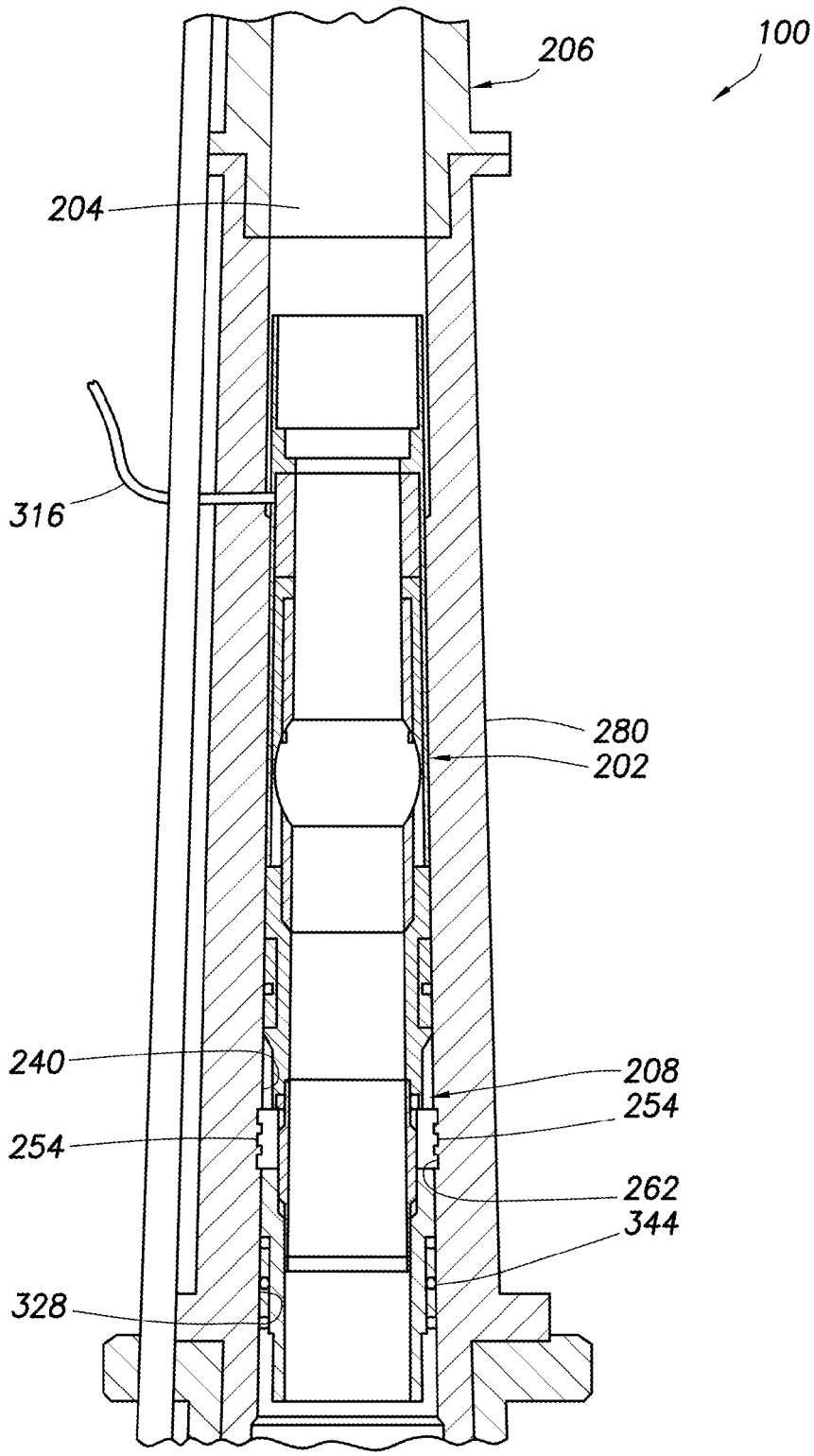
FIG. 13 is a schematic cross-sectional view of the riser system and method of FIG. 12, showing the valve module after installation.

In FIGS. 12 & 13, installation of a valve module 202 in a riser string 206 is representatively illustrated. FIG. 12 depicts the valve module 202 being conveyed and positioned in a valve module housing 280 of the riser string 206, and FIG. 13 depicts the valve module 202 after it has been secured and sealed within the housing 280.

Figure 8:
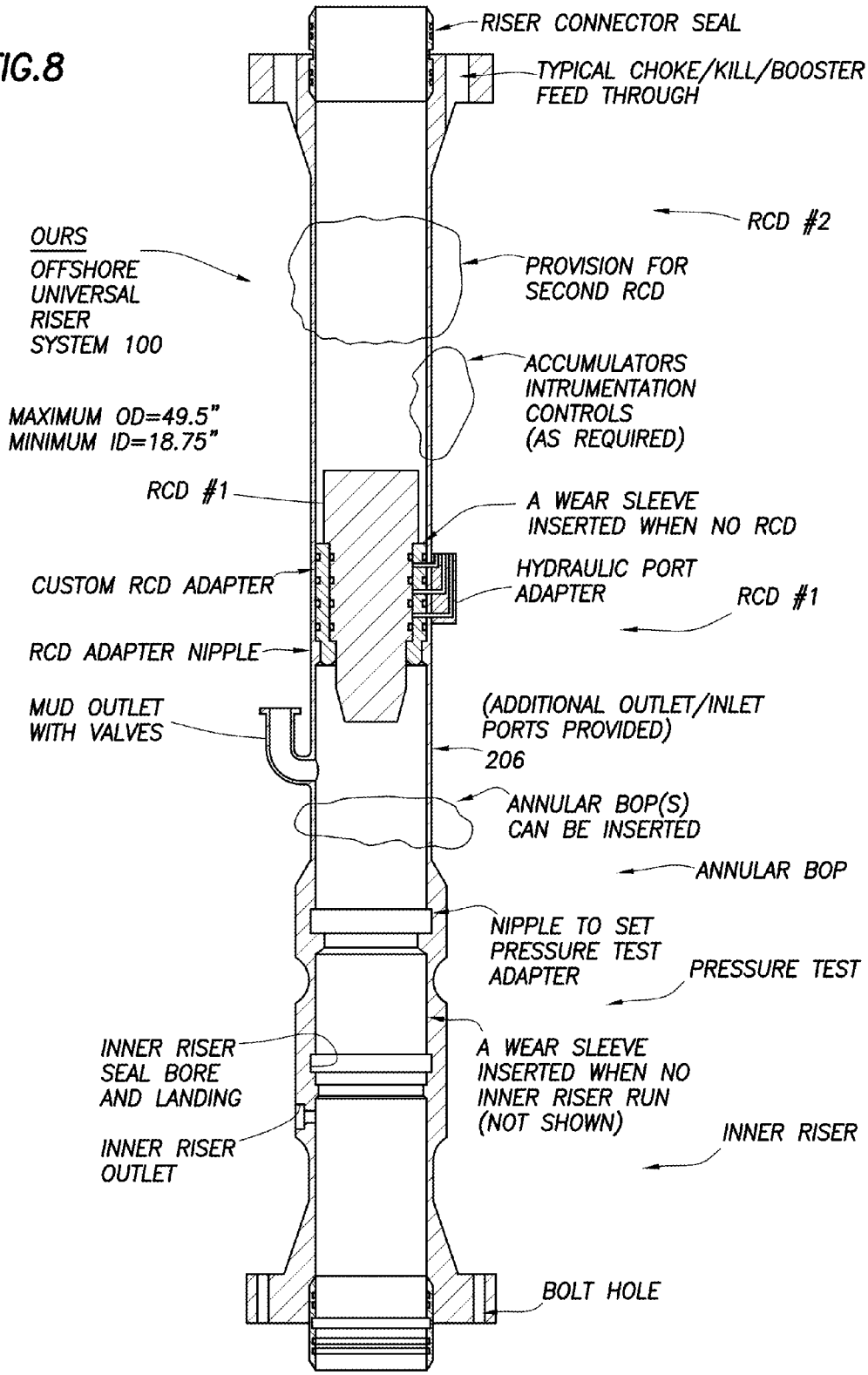
FIG. 8 is a schematic cross-sectional view of another alternate configuration of a riser system and method embodying principles of the present invention.

The housing 280 is shown as being a separate component of the riser string 206, but in other embodiments the housing could be integrated with other module housings 268, 282, 284, 306 (described below), and could be similar to the construction of the riser section 30 shown in FIGS. 8 & 9. The riser string 206 could correspond to the riser string 84 in the process and instrumentation diagram of FIG. 11.

The housing 280 provides a location 240 for appropriately positioning the valve module 202 in the riser string 206. In this example, the housing 280 includes an internal latch profile 262 and a seal bore 328 for securing and sealing the valve module 202 in the riser string 206.

The valve module 202 includes an anchoring device 208 with radially outwardly extendable latch members 254 for engaging the profile 262, and seals 344 for sealing in the seal bore 328. The valve module 202 is depicted in FIG. 13 after the members 254 have been extended into engagement with the profile 262, and the seals 344 are sealingly engaged with the seal bore 328.

Figure 31:
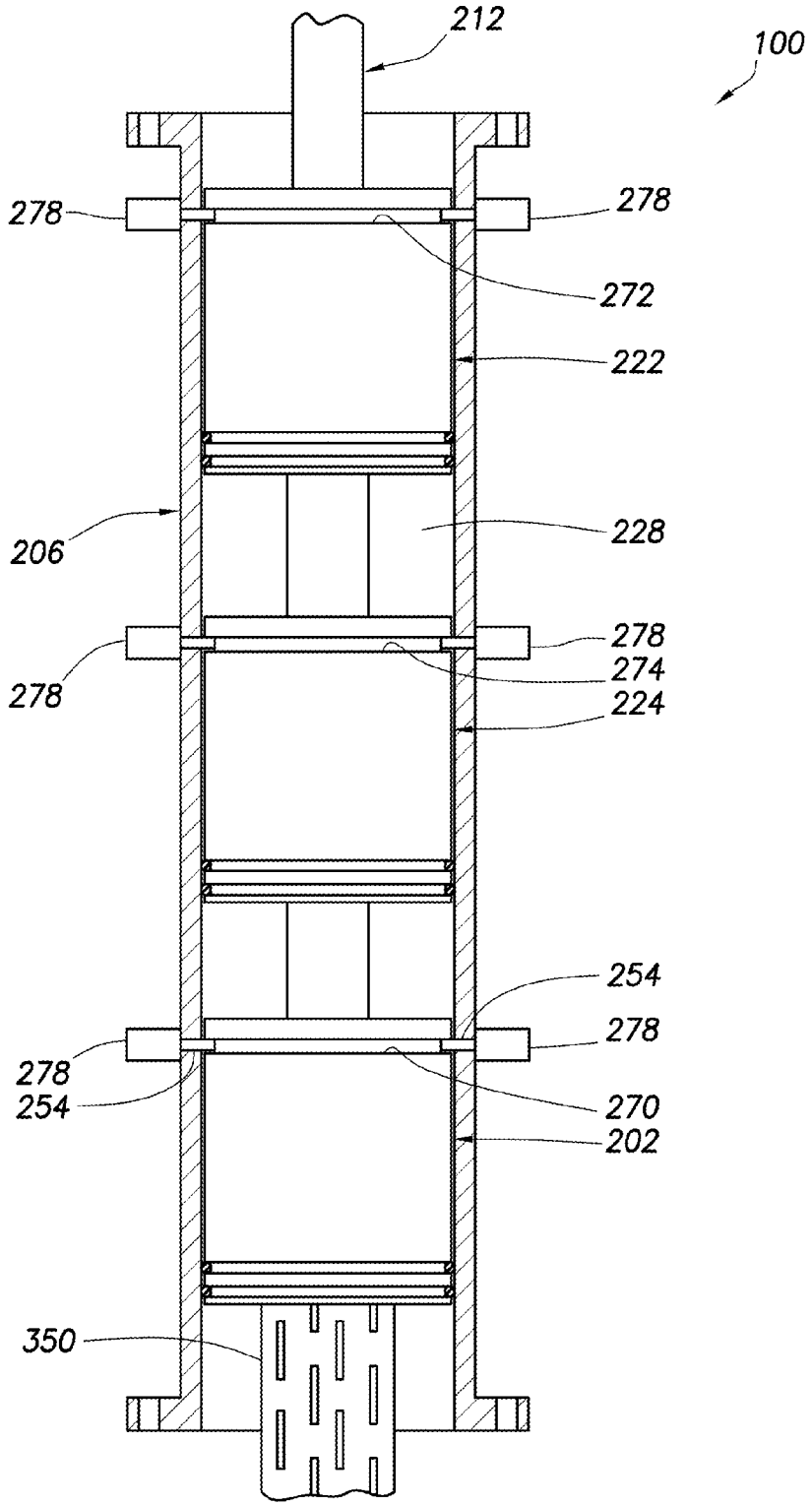
FIG. 31 is a schematic partially cross-sectional view of a method whereby various equipment may be installed using the riser system and method of FIG. 12.

Other configurations of the valve module 202 can be used, if desired. For example, as depicted in FIGS. 30 & 31, the latch members 254 could instead be displaced by means of actuators 278 positioned external to the riser string 206, in order to selectively engage the latch members with an external profile 270 formed on the valve module 202. Operation of the actuators 278 could be controlled by the subsea control systems 119, 304, control pod 301 and/or surface control system 18 described above.

The valve module 202 selectively permits and prevents fluid flow through a flow passage 204 formed longitudinally through the riser string 206. As depicted in FIGS. 12 & 13, the valve module 202 includes a ball valve which is operated by means of a hydraulic control line 316 externally connected to the housing 280, but other types of valve mechanisms (such as flapper valves, solenoid operated valves, etc.) may be used, if desired. Operation of the valve module 202 (for example, to open or close the valve) may be controlled by the subsea control system 304 and control pod 301, and/or the surface control system 18 described above.

A variety of operations may be performed utilizing the valve module 202. For example, the valve module 202 may be used to pressure test various portions of the riser string 206, to pressure test the annular seal modules 222, 224, 226 (described below), to facilitate pressure control in a wellbore 346 during underbalanced or managed pressure drilling (such as, during drill bit 348 changes, etc., see FIG. 22), or during installation of completion equipment 350 (see FIG. 31).

Figure 14:
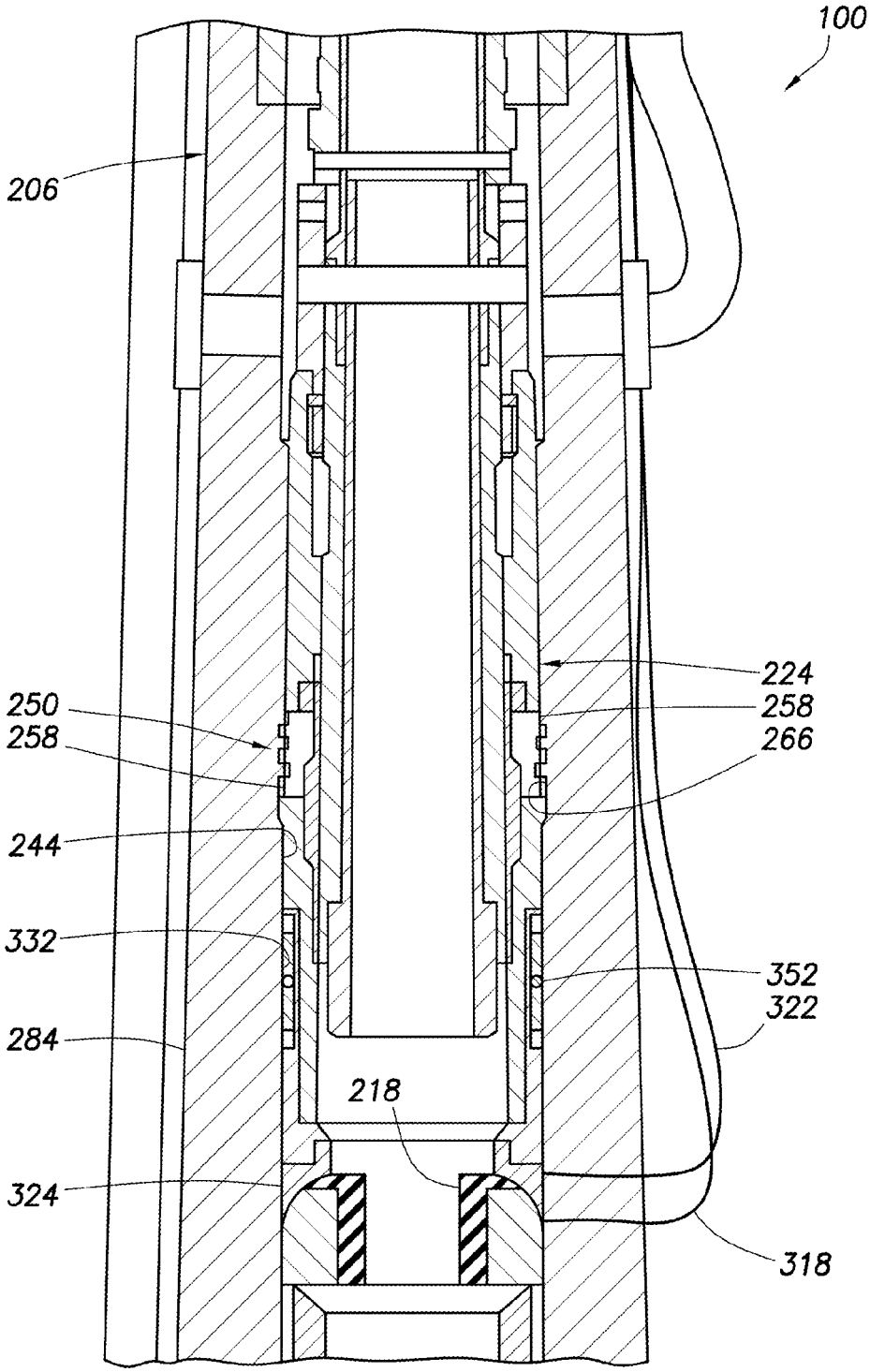
FIG. 14 is a schematic cross-sectional view of the riser system and method of FIG. 12, showing installation of an annular seal module in the riser system.
Figure 15:
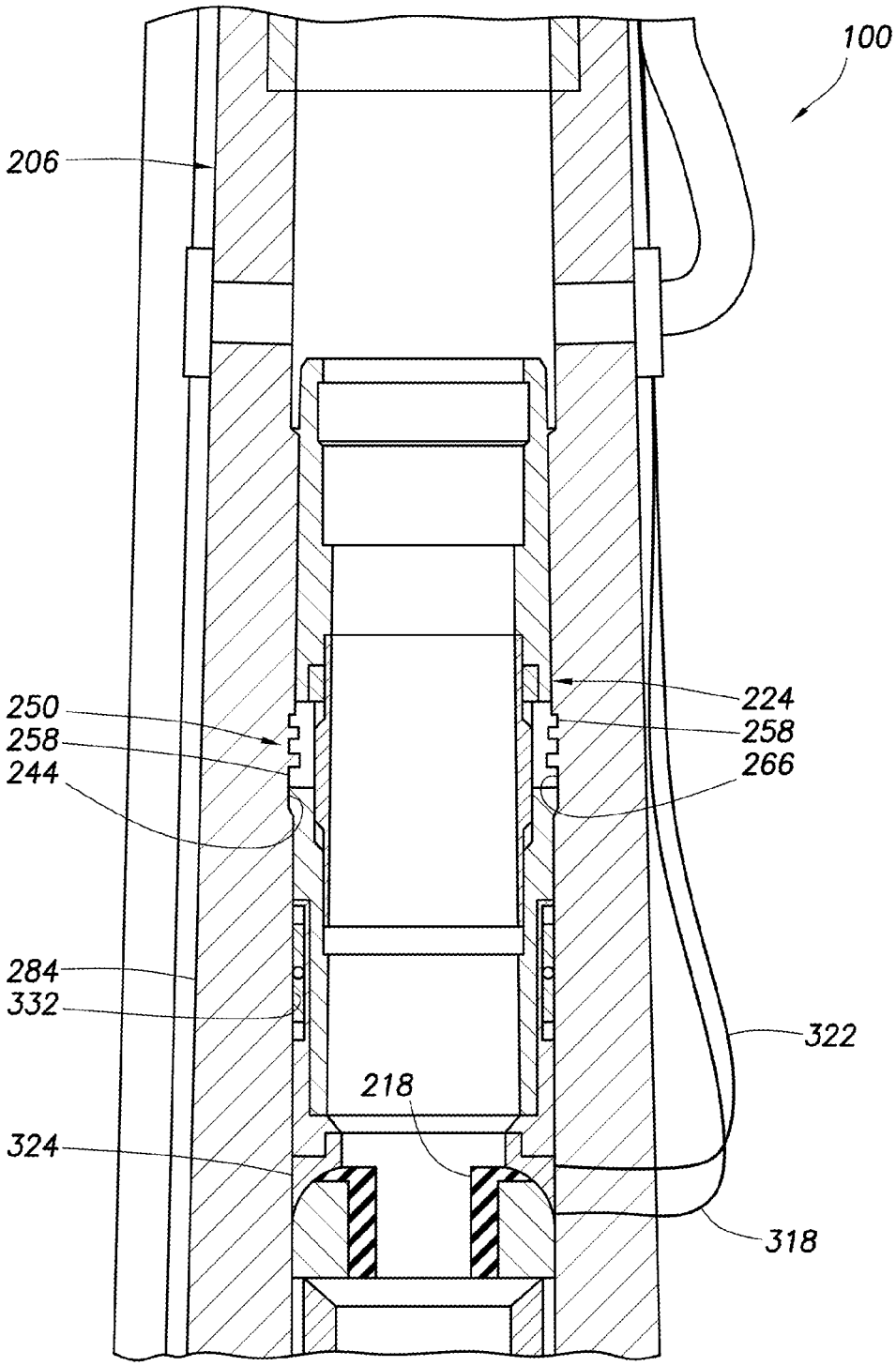
FIG. 15 is a schematic cross-sectional view of the riser system and method of FIG. 12, showing the annular seal module after installation.

Referring now to FIGS. 14 & 15, an annular seal module 224 is representatively illustrated being installed in a housing 284 in the riser string 206. In FIG. 14, the annular seal module 224 is being conveyed into the housing 284, and in FIG. 15, the annular seal module is depicted after having been secured and sealed within the housing.

The housing 284 provides a location 244 for appropriately positioning the annular seal module 224 in the riser string 206. In this example, the housing 284 includes an internal latch profile 266 and a seal bore 332 for securing and sealing the annular seal module 224 in the riser string 206. The housing 284 may be a separate component of the riser string 206, or it may be integrally formed with any other housing(s), section(s) or portion(s) of the riser string.

The annular seal module 224 includes an anchoring device 250 with radially outwardly extendable latch members 258 for engaging the profile 266, and seals 352 for sealing in the seal bore 332. The annular seal module 224 is depicted in FIG. 15 after the members 258 have been extended into engagement with the profile 266, and the seals 352 are sealingly engaged with the seal bore 332.

Other configurations of the annular seal module 224 can be used, if desired. For example, as depicted in FIGS. 30 & 31, the latch members 258 could instead be displaced by means of actuators 278 positioned external to the riser string 206, in order to selectively engage the latch members with an external profile 274 formed on the annular seal module 224. Operation of the actuators 278 could be controlled by the subsea control system 119, 304 and control pod 302, and/or surface control system 18 described above.

Figure 22:
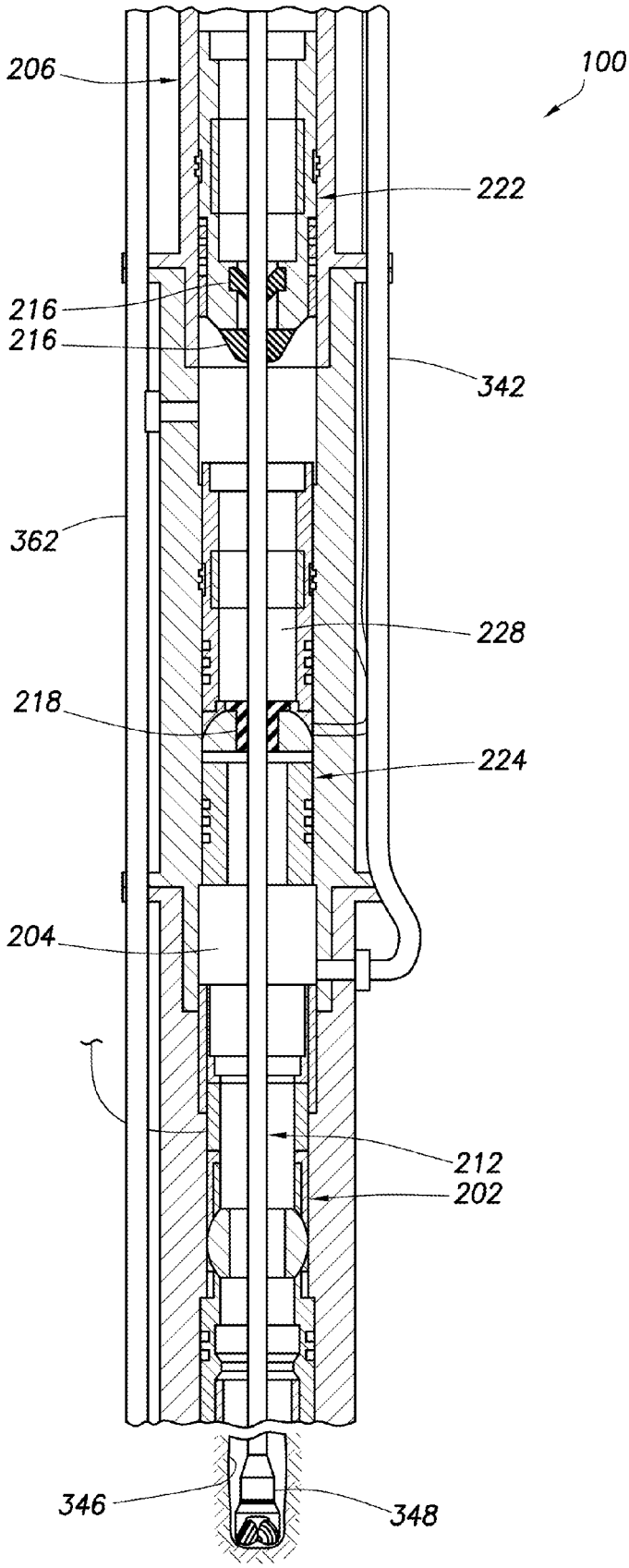
FIG. 22 is a schematic cross-sectional view of the riser system and method of FIG. 12, showing a configuration of the riser system during drilling operations.

The annular seal module 224 selectively permits and prevents fluid flow through an annular space 228 formed radially between the riser string 206 and a tubular string 212 positioned in the flow passage 204 (see FIG. 22). As depicted in FIGS. 14 & 15, the annular seal module 224 includes a radially extendable seal 218 which is operated in response to pressure applied to a hydraulic control line 318 externally connected to the housing 284.

The annular seal module 224 also includes a bearing assembly 324 which permits the seal 218 to rotate with the tubular string 212 when the seal is engaged with the tubular string and the tubular string is rotated within the flow passage 204 (such as, during drilling operations).

The bearing assembly 324 is supplied with lubricant via a lubricant supply line 322 externally connected to the housing 284. A lubricant return line 326 (see FIG. 23) may be used, if desired, to provide for circulation of lubricant to and from the bearing assembly 324.

The annular seal module 224 is an alternative for, and may be used in place of, the active RCD 50 described above. Operation of the annular seal module 224 (for example, to extend or retract the seal 218) may be controlled by means of the subsea control system 304 and control pod 302, and/or the surface control system 18 described above.

Figure 16:
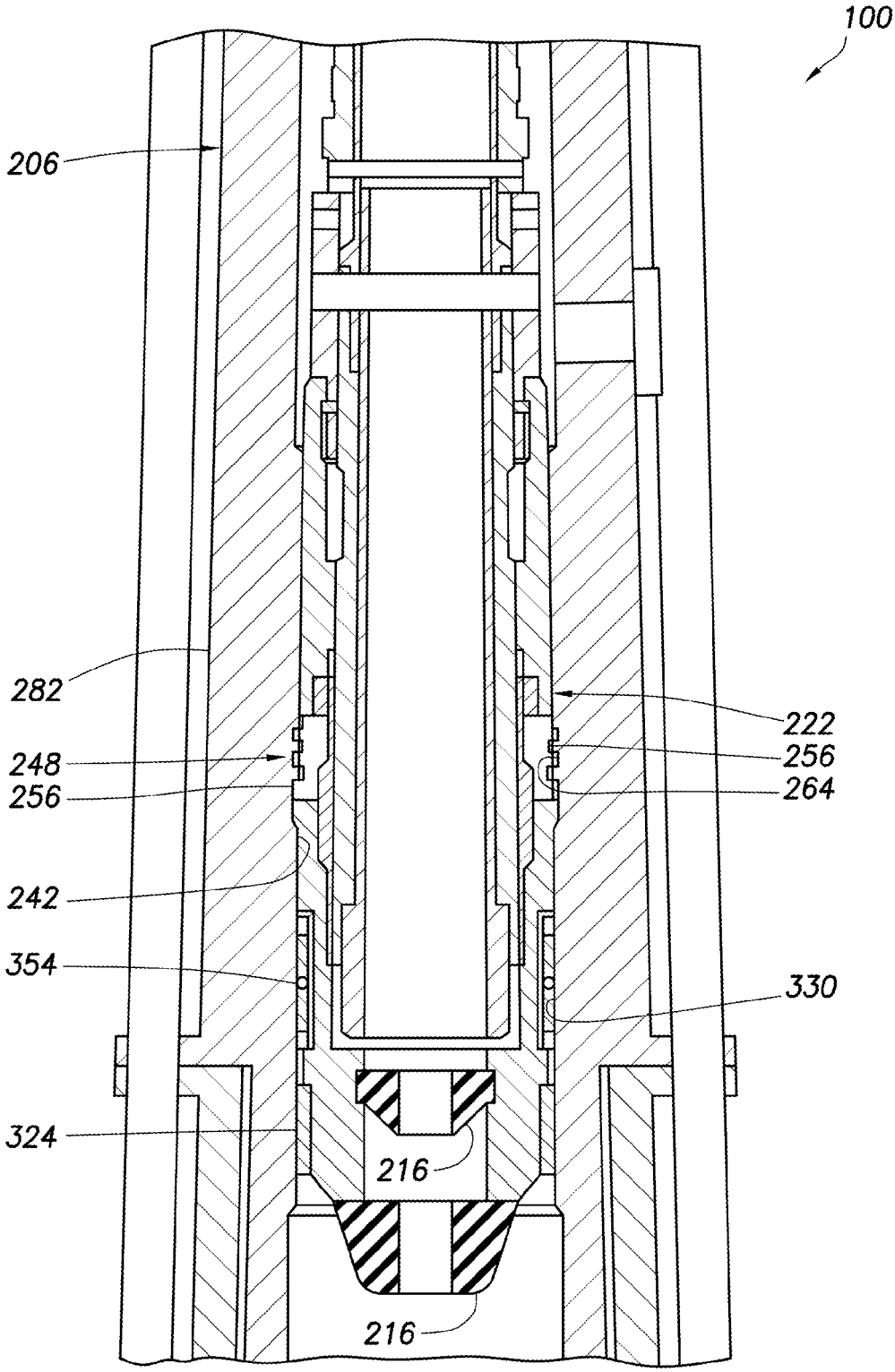
FIG. 16 is a schematic cross-sectional view of the riser system and method of FIG. 12, showing installation of another annular seal module in the riser system.
Figure 17:
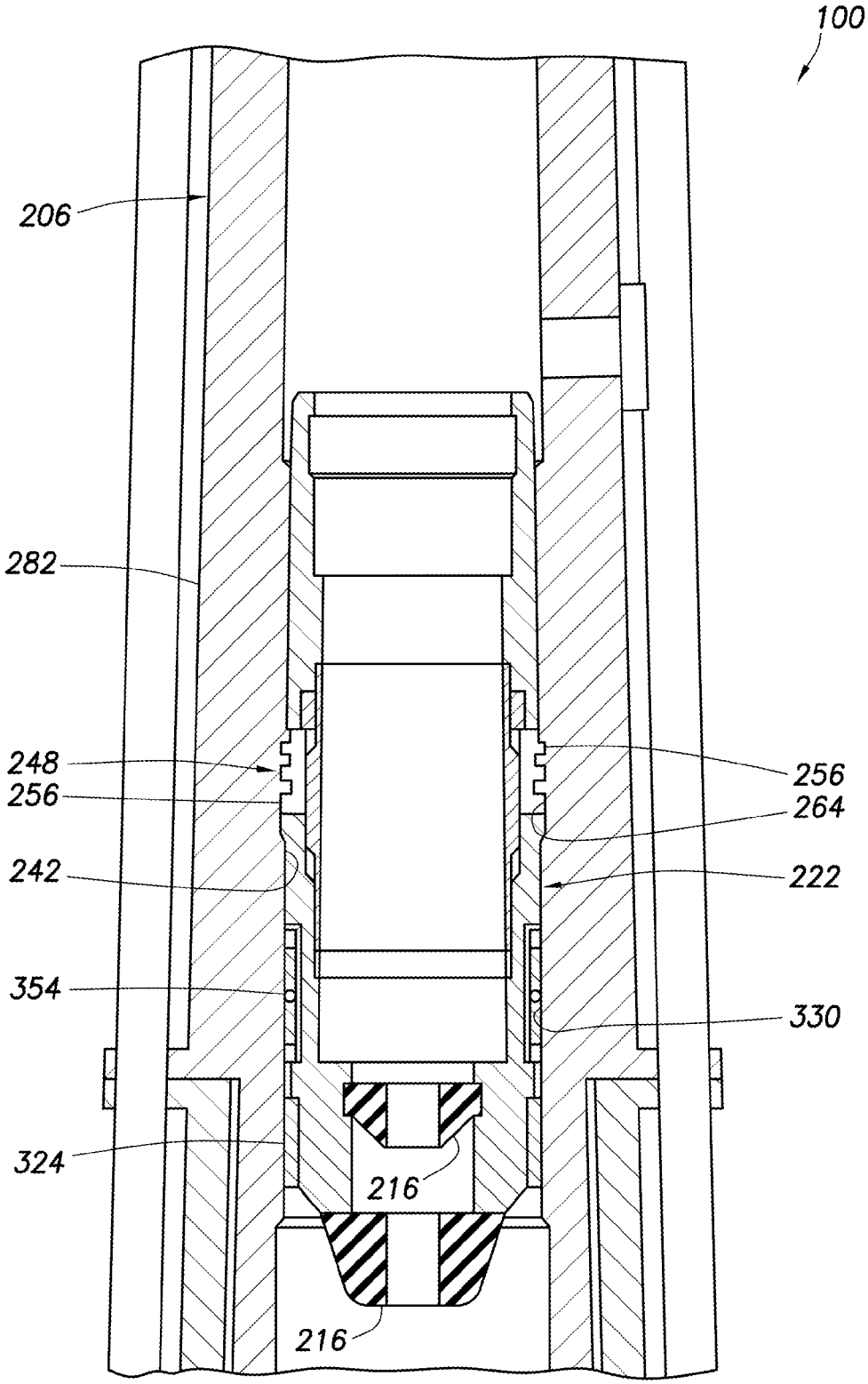
FIG. 17 is a schematic cross-sectional view of the riser system and method of FIG. 12, showing the annular seal module of FIG. 16 after installation.

Referring now to FIGS. 16 & 17, an annular seal module 222 is representatively illustrated being installed in a housing 282 in the riser string 206. In FIG. 16, the annular seal module 222 is being conveyed into the housing 282, and in FIG. 17, the annular seal module is depicted after having been secured and sealed within the housing.

The housing 282 provides a location 242 for appropriately positioning the annular seal module 222 in the riser string 206. In this example, the housing 282 includes an internal latch profile 266 and a seal bore 330 for securing and sealing the annular seal module 222 in the riser string 206. The housing 282 may be a separate component of the riser string 206, or it may be integrally formed with any other housing(s), section(s) or portion(s) of the riser string.

The annular seal module 222 includes an anchoring device 248 with radially outwardly extendable latch members 256 for engaging the profile 266, and seals 354 for sealing in the seal bore 330. The annular seal module 222 is depicted in FIG. 17 after the members 256 have been extended into engagement with the profile 266, and the seals 354 are sealingly engaged with the seal bore 330.

Other configurations of the annular seal module 222 can be used, if desired. For example, as depicted in FIGS. 30 & 31, the latch members 256 could instead be displaced by means of actuators 278 positioned external to the riser string 206, in order to selectively engage the latch members with an external profile 272 formed on the annular seal module 222. Operation of the actuators 278 could be controlled by the subsea control system 120, 304 and control pod 303, and/or surface control system 18 described above.

The annular seal module 222 selectively permits and prevents fluid flow through the annular space 228 formed radially between the riser string 206 and the tubular string 212 positioned in the flow passage 204 (see FIG. 22). As depicted in FIGS. 16 & 17, the annular seal module 222 includes flexible seals 216 which are for sealingly engaging the tubular string 212.

The annular seal module 222 also includes a bearing assembly 324 which permits the seals 216 to rotate with the tubular string 212 when the seal is engaged with the tubular string and the tubular string is rotated within the flow passage 204 (such as, during drilling operations). The bearing assembly 324 may be supplied with lubricant via a lubricant supply line and lubricant return line as described above for the annular seal module 224.

The annular seal module 222 is an alternative for, and may be used in place of, the passive RCD 58 described above. Operation of the annular seal module 222 may be controlled by means of the subsea control system 304 and control pod 302, and/or the surface control system 18 described above.

Figure 18:
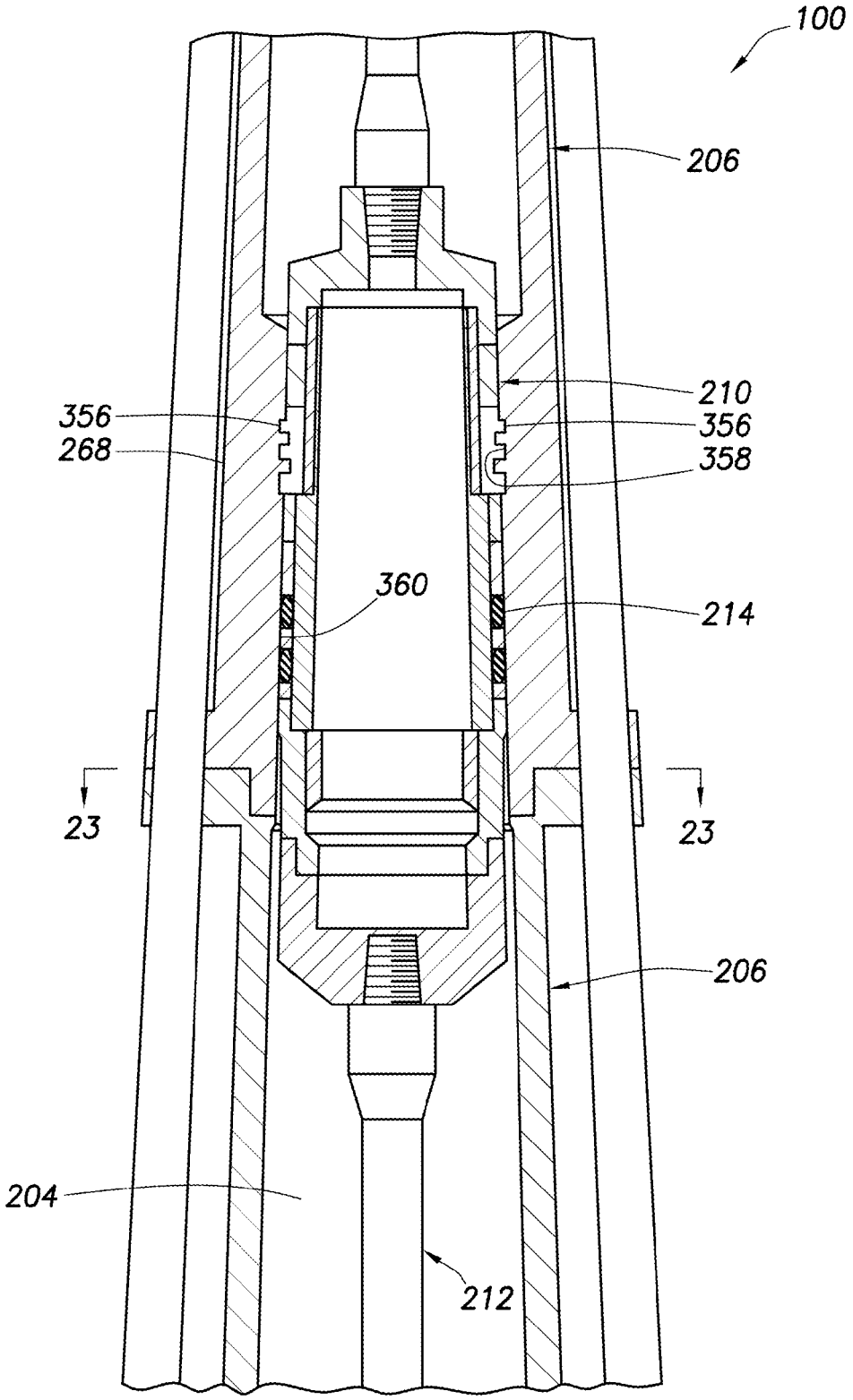
FIG. 18 is a schematic cross-sectional view of the riser system and method of FIG. 12, showing installation of a riser testing module in the riser system.

Referring now to FIG. 18, a tubular string anchoring device 210 is depicted as installed in a housing 268 interconnected in the riser string 206. The anchoring device 210 includes latch members 356 engaged with an internal profile 358 formed in the housing 268. In addition, seals 214 are sealed in a seal bore 360 formed in the housing 268.

The housing 268 may be a separate component of the riser string 206, or it may be integrally formed with any other housing(s), section(s) or portion(s) of the riser string. In this configuration of the riser system 100, the housing 268 is preferably positioned above the locations 240, 242, 244, 246 provided for the other modules 202, 222, 224, 226, so that the anchoring device 210 and seals 214 may be used for pressure testing the riser string 206 and the other modules.

In one pressure testing procedure, the anchoring device 210 and seals 214 can be conveyed into and installed in the riser string 206 with a portion of the tubular string 212 which extends downwardly from the anchoring device and through any annular seal modules 222, 224, 226, but not through the valve module 202. This configuration is representatively illustrated in FIG. 19.

Figure 19:
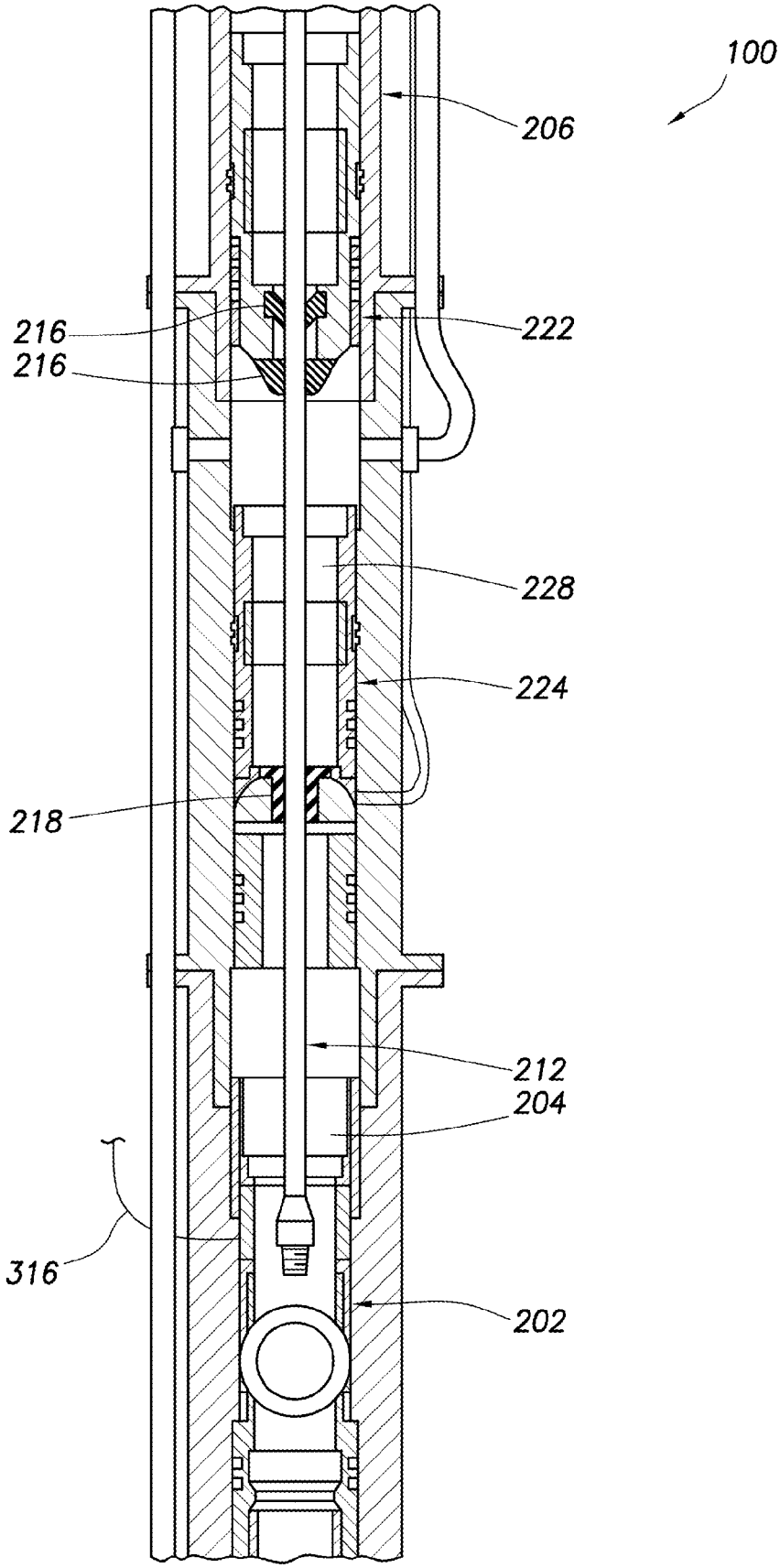
FIG. 19 is a schematic cross-sectional view of the riser system and method of FIG. 12, showing a configuration of the riser system during a riser pressure testing procedure.

Note that, in FIG. 19, the tubular string 212 extends downwardly from the anchoring device 210 (not visible in FIG. 19), through the annular seal modules 222, 224, and into the flow passage 204 above the valve module 202. The tubular string 212 does not extend through the valve module 202.

The anchoring device 210 functions in the pressure testing procedure to prevent displacement of the tubular string 212 when pressure differentials are applied across the annular seal modules 222, 224, 226 and the valve module 202. The seals 214 on the anchoring device 210 also function to seal off the flow passage 204. Pressure can be delivered from a remote location (such as a surface facility) through the tubular string 212 to the flow passage 204 below the anchoring device 210.

The valve module 202 can be pressure tested by applying a pressure differential across the closed valve module using the tubular string 212. In the configuration of FIG. 19, pressure may be applied via the tubular string 212 to a portion of the riser string 206 between the closed valve module 202 and the annular seal module 224 (in which the seal 218 has been actuated to sealingly engage the tubular string). This applied pressure would also cause application of a pressure differential across the annular seal module 224 and the portion of the riser string 206 between the closed valve module 202 and the annular seal module 224. Any pressure leakage observed would be indicative of a structural or seal failure in the valve module 202, riser string 206 portion or annular seal module 224.

In order to pressure test the annular seal module 222 and the portion of the riser string 206 between the annular seal modules 222, 224, the seal 218 of the annular seal module 224 can be operated to disengage from the tubular string 212. In this manner, pressure applied via the tubular string 212 to the flow passage 204 would cause a pressure differential to be applied across the annular seal module 222 and the portion of the riser string 206 between the annular seal modules 222, 224.

Alternatively, or in addition, the tubular string 212 could be positioned so that its lower end is between the annular seal modules 222, 224, in which case operation of the seal 218 may not affect whether a pressure differential is applied across the annular seal module 222 or the portion of the riser string 206 between the annular seal modules 222, 224.

If the valve module 202 is opened, then pressure applied via the tubular string 212 can be used to pressure test the portion of the riser string 206 below the annular seal module 222 and/or annular seal module 224. In this manner, the pressure integrity of the portion of the riser string 206 which would be subject to significant pressure differentials during underbalanced or managed pressure drilling can be verified.

Note that the pressure applied to the flow passage 204 via the tubular string 212 may be a pressure increase or a pressure decrease, as desired. In addition, the pressure differentials caused as a result of the application of pressure via the tubular string 212 may also be used for pressure testing various components of the riser string 206, including but not limited to valves, lines, accumulators, chokes, seals, control systems, sensors, etc. which are associated with the riser string.

Although the FIG. 19 configuration depicts the annular seal module 222 being positioned below the anchoring device 210, the annular seal module 224 being positioned below the annular seal module 222, and the valve module 202 being positioned below the annular seal module 224, it should be clearly understood that various arrangements of these components, and different combinations of these and other components, may be used in keeping with the principles of the invention. For example, instead of one each of the annular seal modules 222, 224 being used in the riser system 100, only one annular seal module 222 or 224 could be used, two annular seal modules 222 or two annular seal modules 224 could be used, the annular seal module 226 (described below) could be used in place of either or both of the annular seal modules 222, 224, any number or combination of annular seal modules could be used, the annular BOP 42 described above could be used in place of any of the annular seal modules 222, 224, 226, etc.

Figure 20:
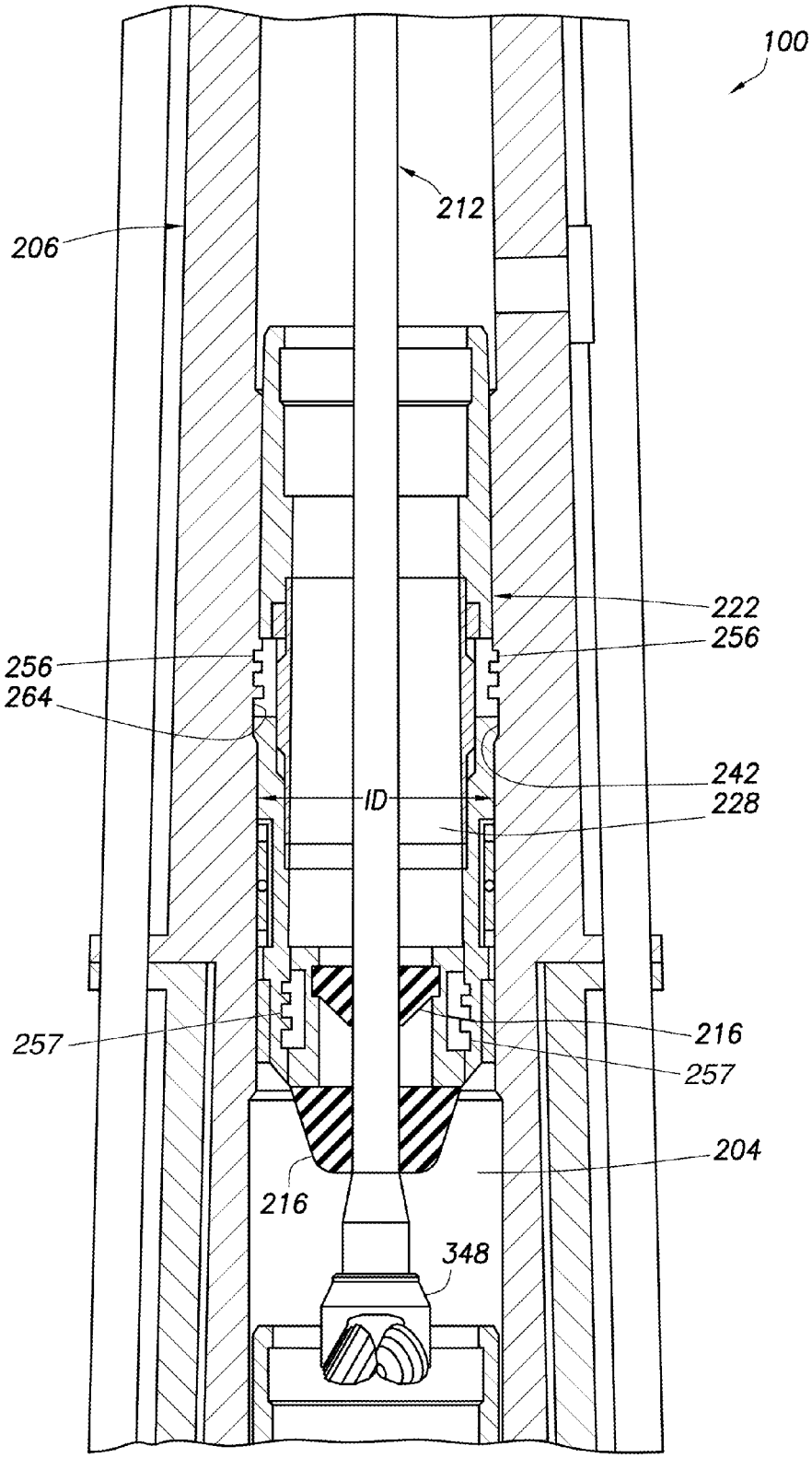
FIG. 20 is a schematic cross-sectional view of the riser system and method of FIG. 12, showing conveyance of an annular seal module into the riser system on a drill string.

Referring additionally now to FIG. 20, the annular seal module 222 is depicted as being installed in the riser string 206 conveyed on the tubular string 212. The drill bit 348 on the lower end of the tubular string 212 prevents the annular seal module 222 from falling off of the lower end of the tubular string.

Preferably, the latch members 256 and profile 264 are of the type which selectively engage with each other as the module 222 displaces through the riser string 206. That is, the latch members 256 and profile 264 may be "keyed" to each other, so that the latch members 256 will not operatively engage any other profiles (such as profiles 262, 266, 358) in the riser string 206, and the profile 264 will not be operatively engaged by any other latch members (such as latch members 254, 258, 356). A suitable "keying" system for this purpose is the SELECT-20™ system marketed by Halliburton Engineering Services, Inc. of Houston, Tex. USA.

One advantage of using such a "keyed" system is that a minimum internal dimension ID of the riser string 206 at each of the module locations 240, 242, 244, 246 can be at least as great as a minimum internal dimension of the riser string between the opposite end connections 232, 234 of the riser string. This would not necessarily be the case if progressively decreasing no-go diameters were used to locate the modules 202, 222, 224, 226 in the riser string 206.

Once the annular seal module 222 has been installed in the riser string 206, either conveyed on the tubular string 212 as depicted in FIG. 20 or by using a running tool as depicted in FIG. 16, the seals 216 can be installed in the annular seal module or retrieved from the annular module by conveying the seals on the tubular string 212.

Latch members 257 permit the seals 216 to be separately installed in or retrieved from the annular seal module 222. The latch members 257 could, for example, be the same as or similar to the latch members 256 used to secure the annular seal module 222 in the riser string 206.

In one preferred method, the annular seal module 222 can be installed and secured in the riser string 206 using a running tool, without the seals 216 being present in the module. Then, when the tubular string 212 with the bit 348 thereon is lowered through the riser string 206, the seals 216 can be conveyed on the tubular string and installed and secured in the annular seal module 222. When the tubular string 212 and bit 348 are retrieved from the riser string 206, the seals 216 can be retrieved also.

This method can also be used for installing and retrieving the seals 218, 220 on any of the other annular seal modules 224, 226 described herein, for example, by providing latch members or other anchoring devices for the seals in the annular seal modules. The seals 216, 218, 220 could also be separately conveyed, installed and/or retrieved on other types of conveyances, such as running tools, testing tools, other tubular strings, etc.

Figure 21:
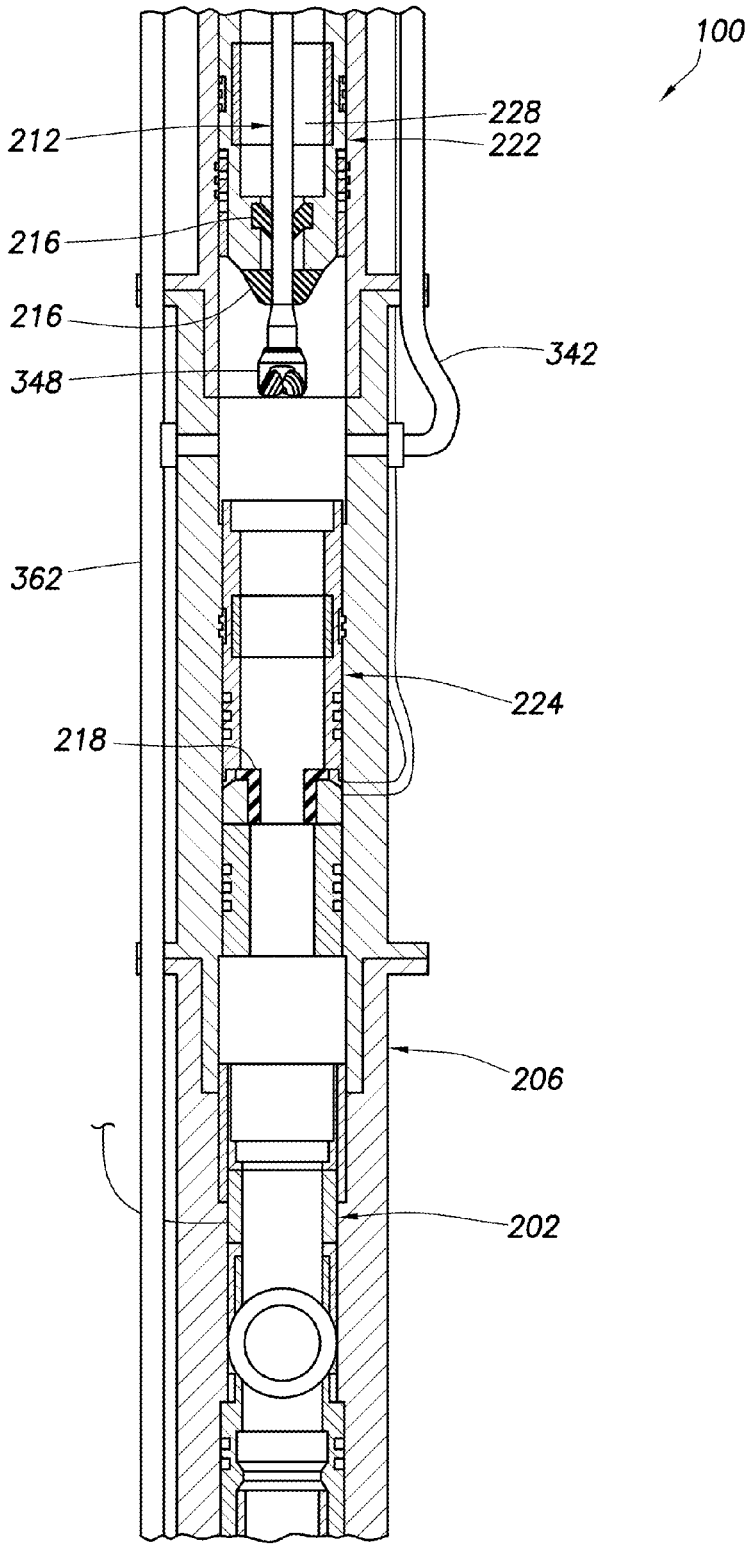
FIG. 21 is a schematic cross-sectional view of the riser system and method of FIG. 12, showing retrieval of an annular seal module from the riser system on a drill string.

The annular seal modules 222, 224 and/or 226 can be installed in any order and in any combination, and the seals 216, 218 and/or 220 can be separately installed and/or retrieved from the riser string in any order and in any combination. For example, two annular seal modules (such as the annular seal modules 222, 224 as depicted in FIG. 21) could be installed in the riser string 206, and then the seals 216, 218 could be conveyed on the tubular string 212 (either together or separately) and secured in the respective annular seal modules. The use of selective latch members 257 permits the appropriate seal 216 or 218 to be selectively installed in its respective annular seal module 222, 224.

Referring additionally now to FIG. 21, the annular seal module 222 is depicted as being retrieved from the riser string 206 by the tubular string 212. With the latch members 256 disengaged from the profile 264, the annular seal module 222 can be retrieved from within the riser string 206 along with the tubular string 212 (for example, with the drill bit 348 preventing the annular seal module from falling off of the lower end of the tubular string), so that a separate trip does not need to be made to retrieve the annular seal module. This method will also permit convenient replacement of the seals 216, or other maintenance to be performed on the annular seal module 222, between trips of the tubular string 212 into the well (such as, during replacement of the bit 348).

Note that any of the other modules 202, 224, 226 can also be conveyed into the riser string 206 on the tubular string 212, and any of the other modules can also be retrieved from the riser string on the tubular string. In one example described below (see FIG. 30), multiple modules can be retrieved from the riser string 206 simultaneously on the tubular string 212.

Referring additionally now to FIG. 22, the riser system 100 is representatively illustrated while the tubular string 212 is rotated in the flow passage 204 of the riser string 206 in order to drill the wellbore 346 during a drilling operation. The seals 216 of the annular seal module 222 sealingly engage and rotate with the tubular string 212, and the seal 218 of the annular seal module 224 sealingly engage and rotate with the tubular string, in order to seal off the annular space 228. In this respect, the annular seal module 222 may act as a backup for the annular seal module 224.

The drilling fluid return line 342 is in this example in fluid communication with the flow passage 204 below the annular seal module 224. Drilling fluid which is circulated down the tubular string 212 is returned (along with cuttings, the fluid composition 150 and/or formation fluids, etc., during the drilling operation) via the line 342 to the surface.

The line 342 may correspond to the line 88 or 194 described above, and various valves (e.g., valves 113, 114, 115, 116, 121, 122, 133, 134), chokes (e.g., chokes 112, 117, 123, 132), sensors (e.g., sensors 111, 118, 124, 131), etc., may be connected to the line 342 for regulating fluid flow through the line, regulating back pressure applied to the flow passage 204 to maintain a constant or selectively varying pressure in the wellbore 346, etc. The line 342 is depicted in FIG. 21 as being connected to the portion of the riser string 206 between the annular seal modules 222, 224 in order to demonstrate that various locations for locating the line may be used in keeping with the principles of the invention.

Another line 362 may be in fluid communication with the flow passage 204, for example, in communication with the annular space 228 between the annular seal modules 222, 224. This line 362 may be used for pressure relief (in which case the line may correspond to the line 95 described above), for monitoring pressure in the annular space 228, as an alternate drilling fluid return line, or for any other purpose. The line 362 could be in communication with the flow passage 204 at any desired point along the riser string 206, as desired.

Figure 23:
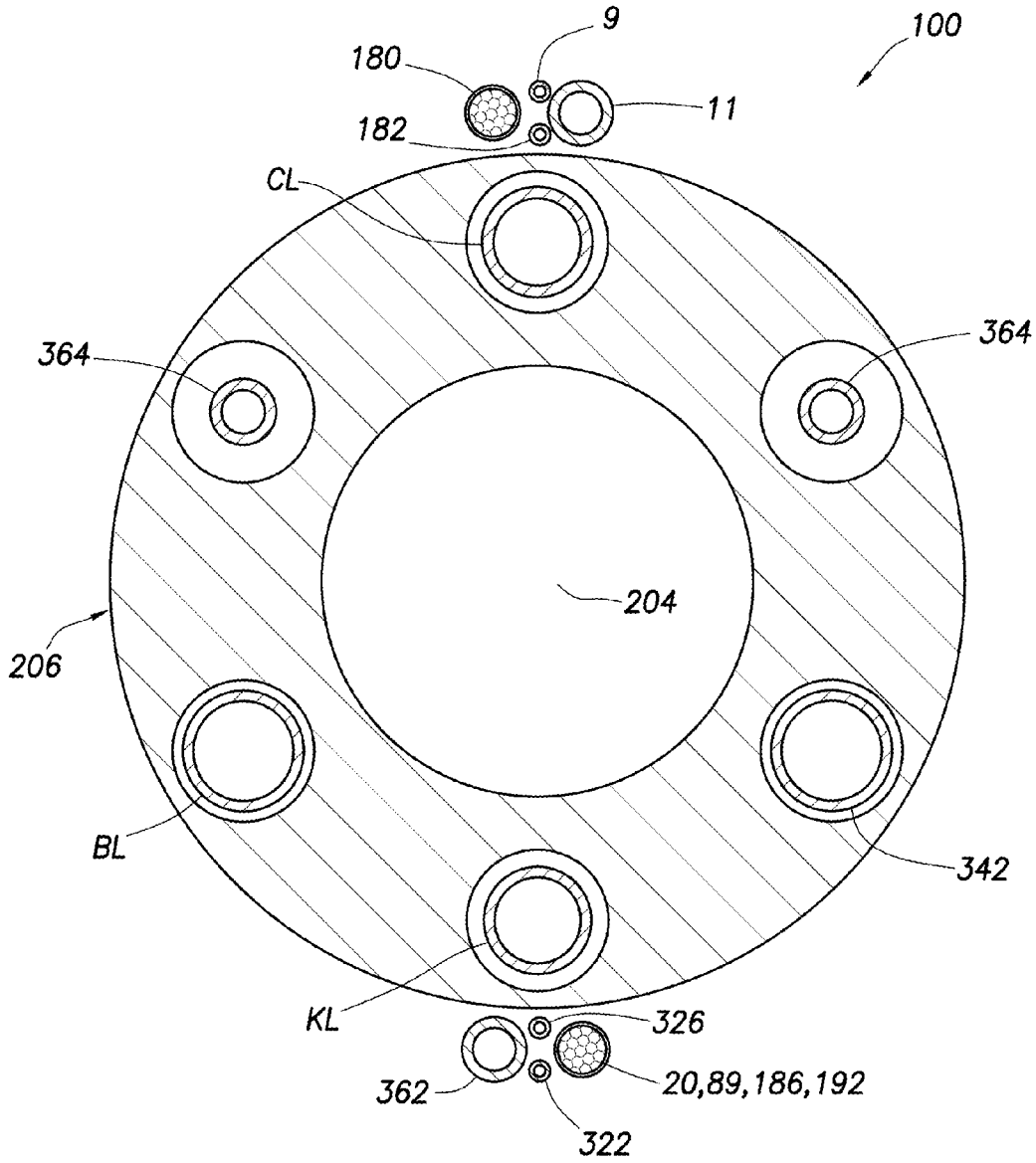
FIG. 23 is a schematic cross-sectional view of the riser system and method of FIG. 12, showing a riser flange connection, taken along line 23-23 of FIG. 18.

Referring additionally now to FIG. 23, an example of a flange connection along the riser string 206 is representatively illustrated, in order to demonstrate how the various lines can be accommodated while still allowing the riser system to fit through a conventional rotary table RT. This view is taken along line 23-23 of FIG. 18. Note that the booster line BL, choke line CL, kill line KL, well control umbilical 180 and subsea BOP hydraulic supply lines 364 are conventional and, thus, are not described further here.

The drilling fluid return line 342 is conveniently installed in a typically unused portion of the flange connection. The injection conduit 11 and hydraulic supply line 9, as well as the lubrication supply and return lines 322, 326, pressure relief line 362 and electrical lines 20, 89, 186, 192 are positioned external to the flange connection, but still within an envelope which permits the riser string 206 to be installed through the rotary table RT. A hydraulic return or balance line 182 may also be provided external to the flange connection, if desired.

Figure 25:
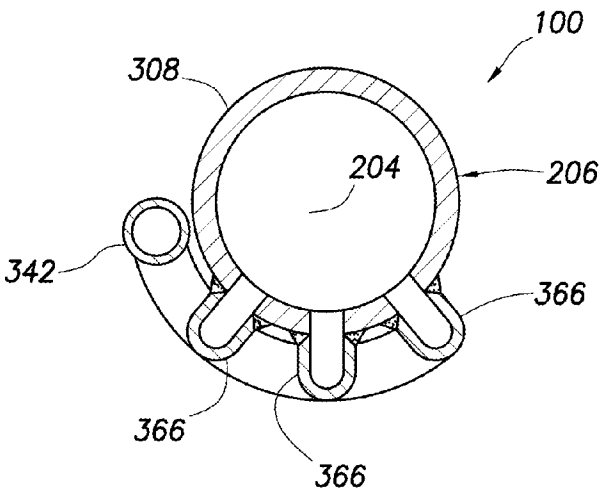
FIG. 25 is a schematic cross-sectional view of the external valve manifold configuration, taken along line 25-25 of FIG. 24.
Figure 24:
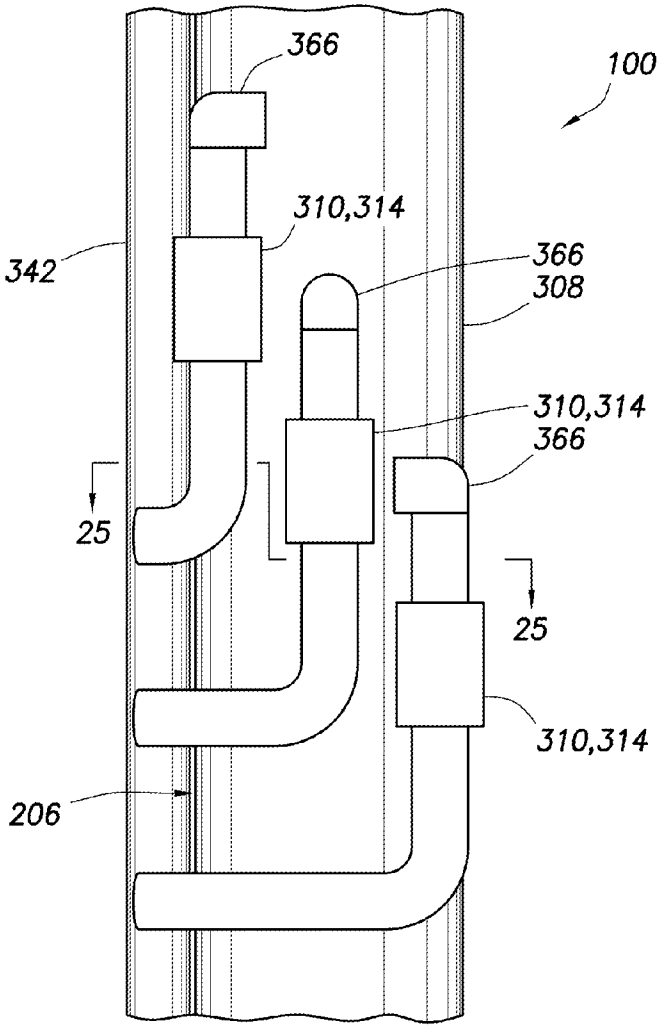
FIG. 24 is a schematic elevation view of the riser system and method of FIG. 12, showing an external valve manifold configuration.

Referring additionally now to FIGS. 24 & 25, a manner in which compact external connections to the flow passage 204 in the riser string 206 can be accomplished is representatively illustrated. In this example, multiple connections are made between the drilling fluid return line 342 and the flow passage 204, but it should be understood that such connections may be made between the flow passage and any one or more external lines, such as the pressure relief line 362, injection conduit 11, etc.

Note that three combined valves 310 and actuators 314 are interconnected between the return line 342 and respective angled riser port connectors 366. These valves 310 and actuators 314 may correspond to the various valves (e.g., valves 113, 114, 115, 116, 121, 122, 133, 134) and chokes (e.g., chokes 112, 117, 123, 132) described above. By arranging the valves 310 and actuators 314 as depicted in FIGS. 24 & 25, the riser string 206 is made more compact and able to displace through a conventional rotary table RT.

Referring additionally now to FIGS. 26A-E, various arrangements of the components of the riser system 100 are representatively illustrated, so that it may be appreciated that the invention is not limited to any specific example described herein.

Figure 26E:
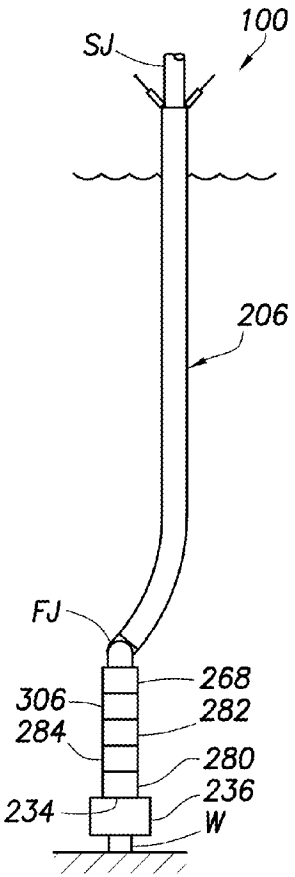
FIGS. 26A-E are schematic elevation views of various positions of elements of the riser system and method of FIG. 12.
Figure 26D:
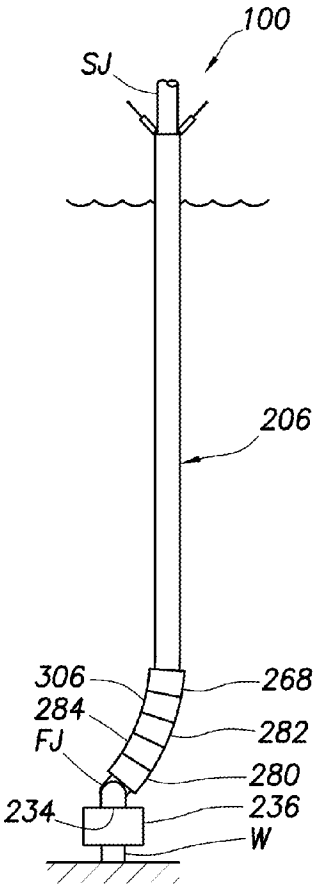
Figure 26C:
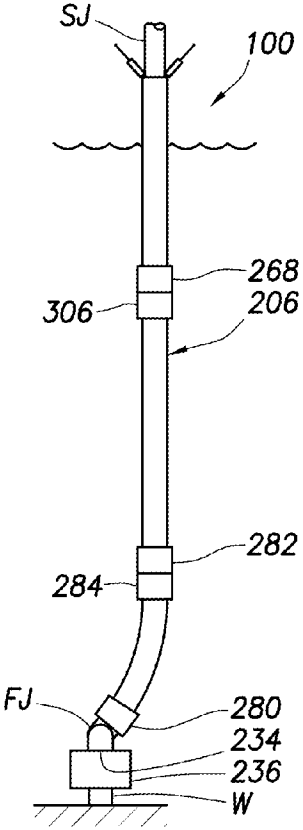
Figure 26B:
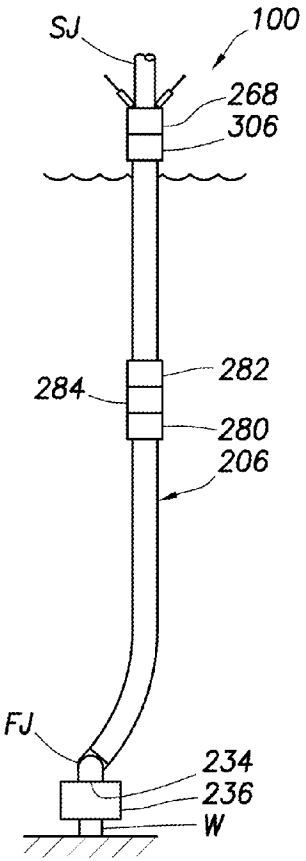
Figure 26A:
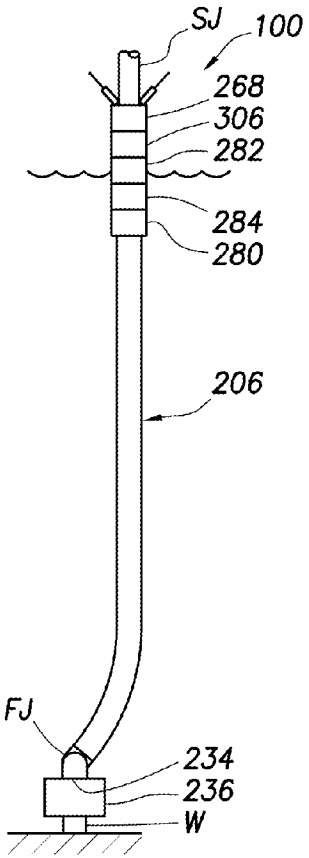

In FIG. 26A, all of the module housings 268, 306, 282, 284, 280 are contiguously connected near an upper end of the riser string 206. This arrangement has the benefits of requiring shorter hydraulic and electrical lines for connection to the surface, and permits the housings 268, 306, 282, 284, 280 to be integrally constructed as a single section of the riser string and to share components (such as accumulators, etc.). However, a large portion of the riser string 206 below the housings 268, 306, 282, 284, 280 would be pressurized during, for example, managed pressure drilling, and this may be undesirable in some circumstances.

In FIG. 26B, the housings 280, 282, 284 for the valve module 202 and annular seal modules 222, 224 are positioned approximately midway along the riser string 206. This reduces the portion of the riser string 206 which may be pressurized, but increases the length of hydraulic and electrical lines to these modules.

In FIG. 26C, the housings 268, 306, 282, 284, 280 are distributed along the riser string 206 in another manner which places the valve module housing 280 just above a flex joint FJ at a lower end connection 234 of the riser string to the subsea wellhead structure 236. This arrangement allows the valve module 202 to be used to isolate substantially all of the riser string 206 from the well below.

In FIG. 26D, the housings 268, 306, 282, 284, 280 are arranged contiguous to each other just above the flex joint FJ. As with the configuration of FIG. 26C, this arrangement allows the valve module 202 to be used to isolate substantially all of the riser string 206 from the well below, and also substantially reduces the portion of the riser string which would be pressurized during managed pressure drilling.

The arrangement of FIG. 26E is very similar to the arrangement of FIG. 26D, except that the flex joint FJ is positioned above the housings 268, 306, 282, 284, 280. This arrangement may be beneficial in that it does not require pressurizing of the flex joint FJ during managed pressure drilling.

The flex joint FJ could alternatively be positioned between any of the housings 268, 306, 282, 284, 280, and at any point along the riser string 206. One advantage of the riser system 100 is that it enables utilization of a pressurized riser in deepwater drilling operations where an intermediate flex joint FJ is required, and where a riser fill up valve is required.

Although each of the housings 306, 282, 284 for the annular seal modules 226, 224, 222 are depicted in FIGS. 26A-E, it should be understood that any one or combination of the housings could be used instead. The various housings 268, 306, 282, 284, 280 may also be arranged in a different order from that depicted in FIGS. 26A-E.

Figure 27:
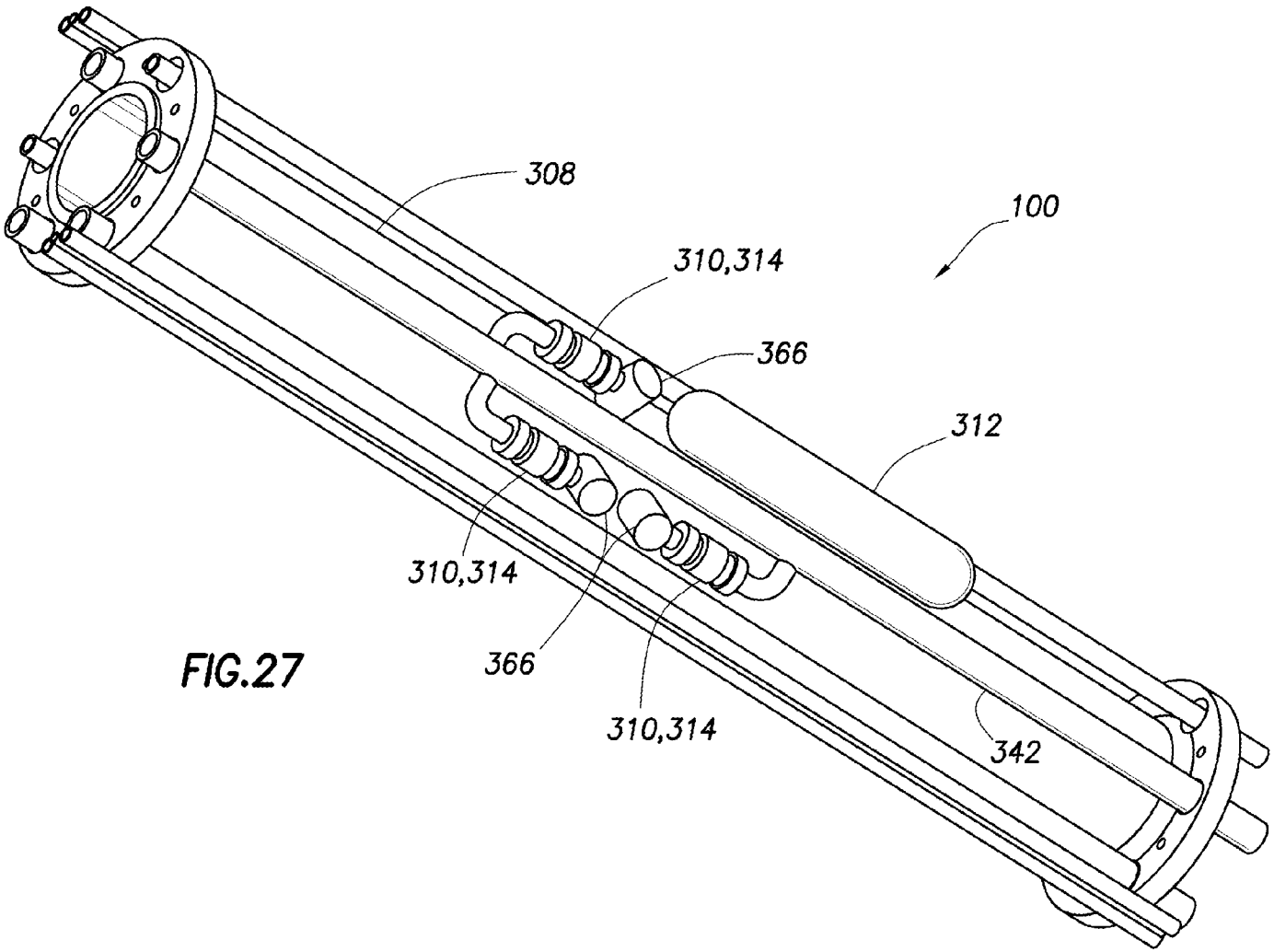
FIG. 27 is an isometric view of a riser section of the riser system and method of FIG. 12, showing an arrangement of various lines, valves and accumulator external to the riser.

Referring additionally now to FIG. 27, a portion 308 of the riser string 206 is representatively illustrated in an isometric view, so that the compact construction of the riser string, which enables it to be installed through a conventional rotary table RT, may be more fully appreciated.

In this view, the externally connected valves 310, actuators 314 and connectors 366 described above in conjunction with FIGS. 24 & 25 are again depicted. In addition, an accumulator 312 is shown externally attached to the riser portion 308. This accumulator 312 may correspond to any of the accumulators 5, 15, 56 described above.

Figure 28:
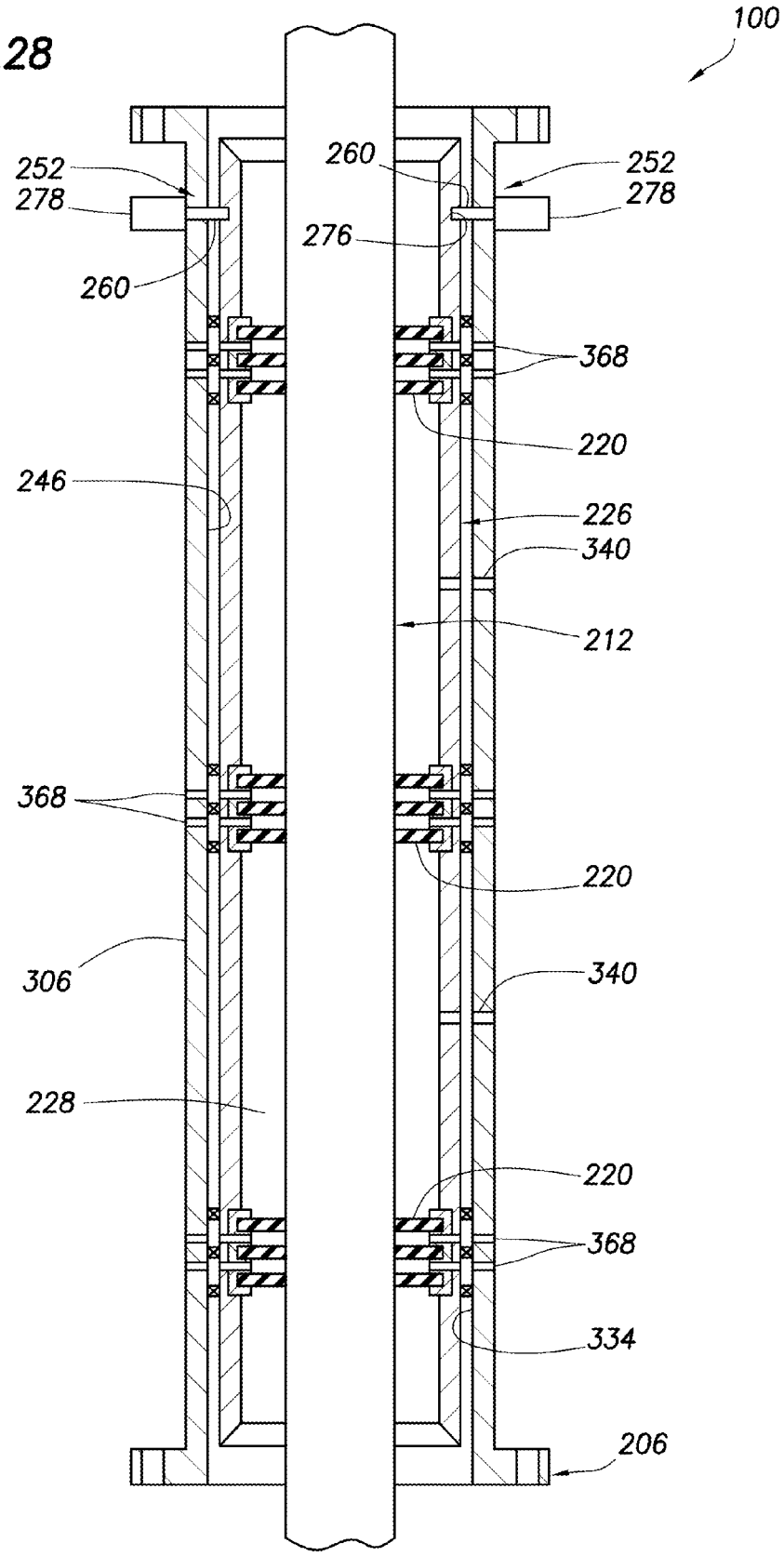
FIG. 28 is a schematic cross-sectional view of an alternate annular seal module for use in the riser system and method of FIG. 12.

Referring additionally now to FIG. 28, the annular seal module 226 is representatively illustrated as being installed within a seal bore 334 in a housing 306 as part of the riser string 206. The annular seal module 226 may be used in addition to, or in place of, any of the other annular seal modules 222, 224, the active RCD 50 or the passive RCD 58 described above.

The annular seal module 226 includes multiple sets of seals 220 for sealingly engaging the tubular string 212 while the tubular string rotates within the flow passage 204. The seals 220 can, thus, seal off the annular space 228 both while the tubular string 212 rotates and while the tubular string does not rotate in the flow passage 204.

In contrast to the seals of the other annular seal modules 222, 224, the active RCD 50 and the passive RCD 58 which rotate with the tubular string 212, the seals 220 of the annular seal module 226 do not rotate with the tubular string. Instead, the seals 220 remain stationary while the tubular string 212 rotates within the seals.

A lubricant/sealant (such as viscous grease, etc.) may be injected between the seals 220 via ports 368 from an exterior of the riser string 206 to thereby provide lubrication to reduce friction between the seals and the tubular string 212, and to enhance the differential pressure sealing capability of the seals. Sensors 340 may be used to monitor the performance of the seals 220 (e.g., to detect whether any leakage occurs, etc.).

Seals similar in some respects to the seals 220 of the annular seal module 226 are described in further detail in PCT Publication No. WO 2007/008085. The entire disclosure of this publication is incorporated herein by this reference.

Although three sets of the seals 220 are depicted in FIG. 28, with three seals in each set, any number of seals and any number of sets of seals may be used in keeping with the principles of the invention.

Anchoring devices 252 are used for securing the annular seal module 226 in the housing 306 at the appropriate location 246. Each anchoring device 252 includes an actuator 278 and a latch member 260 for engagement with an external profile 276 formed on the annular seal module 226.

The use of the actuators 278 external to the riser string 206 provides for convenient securing and releasing of the module 226 from a remote location. In one embodiment, one or more of the modules 226 can be conveniently installed and/or retrieved on the tubular string 212 with appropriate operation of the actuators 278.

Operation of the actuators 278 could be controlled by the subsea control system 120, 304 and control pod 302 or 303, and/or surface control system 18 described above. Operation of the annular seal module 226 (e.g., injection of the lubricant/sealant, monitoring of the sensors 340, etc.) may be controlled by means of the subsea control system 304 and control pod 302 or 303, and/or the surface control system 18 described above.

Figure 29:
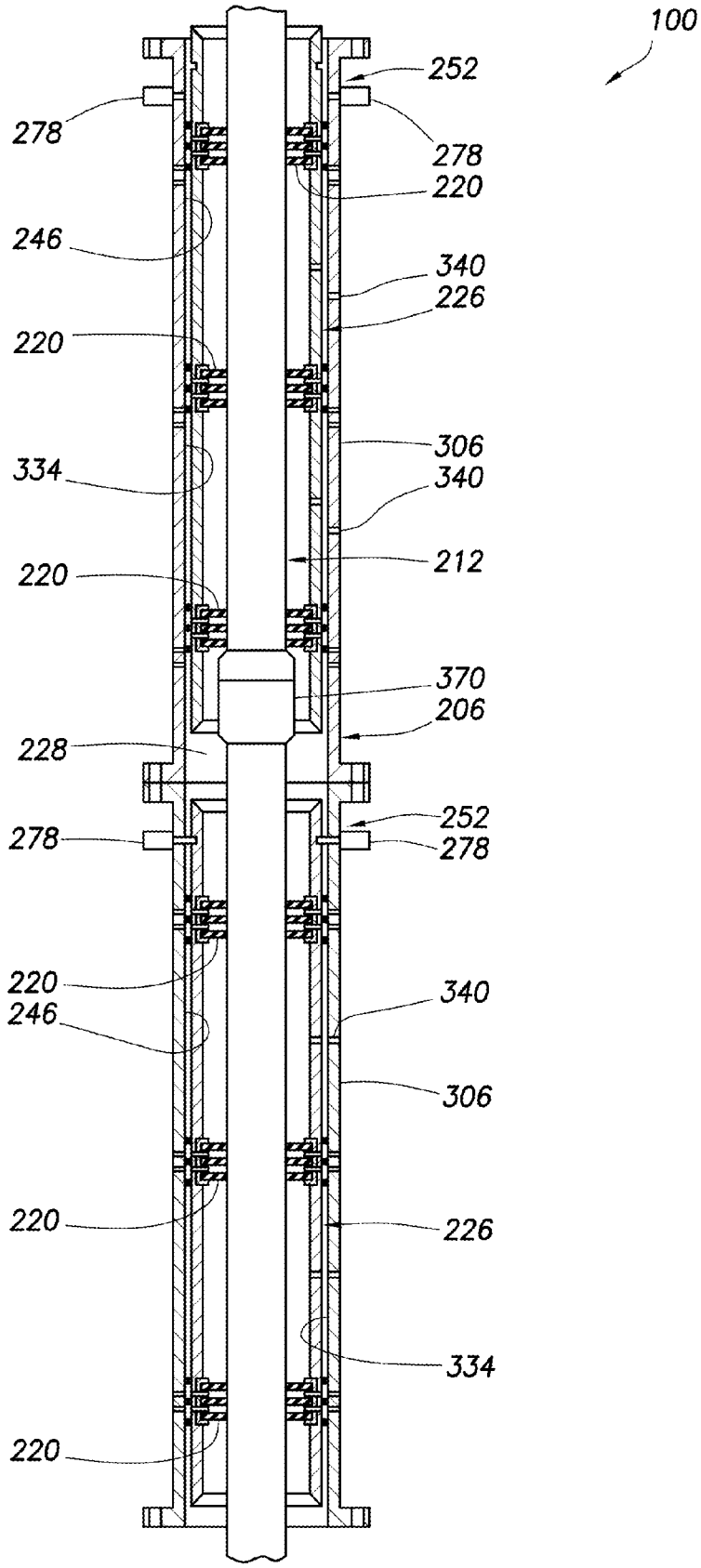
FIG. 29 is a schematic cross-sectional view of a method whereby multiple annular seal modules may be installed in the riser system and method of FIG. 12.

Referring additionally now to FIG. 29, an example of the riser system 100 is representatively illustrated in which multiple annular seal modules 226 are installed in the riser string 206. As depicted in FIG. 29, a second upper annular seal module 226 is being conveyed into the riser string 206 on the tubular string 212. The upper module 226 is supported on the tubular string 212 by a radially enlarged (externally upset) joint 370. When the upper module 226 is appropriately positioned in the housing 306, the actuators 278 will be operated to secure the upper module in position.

It will be appreciated that this method allows for installation of one or more annular seal modules 226 using the tubular string 212, without requiring additional trips into the riser string 206, and/or during normal drilling operations. For example, if during a drilling operation it is observed that the seals 220 of a lower module 226 are at or near the end of their projected life (perhaps informed by indications received from the sensors 340), an additional module 226 can be conveyed by the tubular string 212 into the riser string 206 by merely installing the module onto the tubular string when a next joint 370 is connected.

In this manner, the drilling operations are not interrupted, and the tubular string 212 does not have to be retrieved from the riser string 206, in order to ensure continued sealing of the annular space 228. This method is not limited to use with drilling operations, but can be used during other operations as well, such as completion or stimulation operations.

Referring additionally now to FIG. 30, the riser system 100 is representatively illustrated with multiple modules 202, 222, 224 being retrieved simultaneously from the riser string 206 on the tubular string 212. Use of the external actuators 278 is particularly beneficial in this example, since they permit all of the modules 202, 222, 224 to be quickly and conveniently released from the riser string 206 for retrieval.

As depicted in FIG. 30, the drill bit 348 supports the modules 202, 222, 224 on the tubular string 212 for retrieval from the riser string 206. However, other means of supporting the modules 202, 222, 224 on the tubular string 212 may be used, if desired.

In an emergency situation, such as in severe weather conditions, it may be desirable to retrieve the tubular string 212 quickly and install hang-off tools. Use of the external actuators 278 enables this operation to be accomplished quickly and conveniently.

In the event of failure of one or more of the actuators 278 to function properly, a conventional subsea remotely operated vehicle (ROV) 320 may be used to operate the actuators 278. As described above, the ROV 320 may also be used to perform maintenance on the subsea control systems 119, 120, 142, 304, and to perform other tasks.

Also shown in FIG. 30 are sensors 230, 336, 338 of the respective modules 202, 222, 224. The sensors 230, 336, 338 can be used to monitor parameters such as pressure, temperature, or other characteristics which are indicative of the performance of each module 202, 222, 224. External connectors 372 may be used to connect the sensors 230, 336, 338 to the control systems 304, 18.

Referring additionally now to FIG. 31, the riser system 100 is representatively illustrated during installation of completion equipment 350 through the riser string 206. Since the modules 202, 222, 224 provide for relatively large bore access through the riser string 206, many items of completion equipment can be installed through the modules.

As depicted in FIG. 31, the completion equipment 350 includes a slotted liner. However, it will be appreciated that many other types and combinations of completion equipment can be installed through the modules 202, 222, 224 in keeping with the principles of the invention.

During installation of the completion equipment 350, the valve module 202 can be initially closed while the completion equipment is assembled and conveyed into the riser string 206 above the valve module. After the completion equipment 350 is in the upper riser string 206, and one or more of the annular seal modules 222, 224, 226 seals off the annular space 228 about the tubular string 212 above the completion equipment, the valve module 202 can be opened to allow the completion equipment and the tubular string to be safely conveyed into the wellbore 346.

In this type of operation, the spacing between the annular seal module(s) and the valve module 202 should be long enough to accommodate the length of the completion equipment 350. For example, a configuration similar to that shown in FIG. 26C could be used for this purpose.

Figure 32:
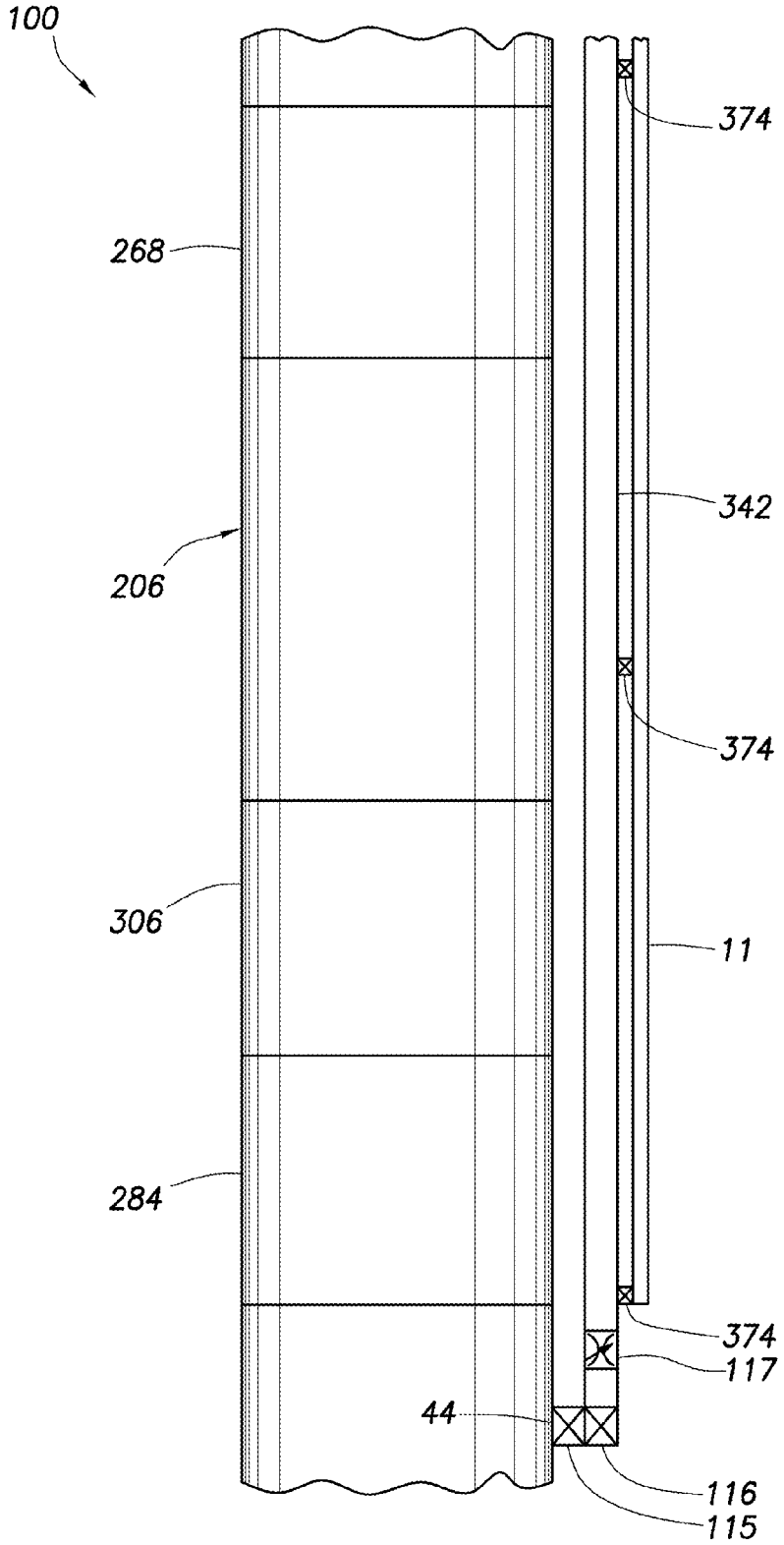
FIG. 32 is a schematic elevational view of another alternate configuration of the riser system.

Referring additionally now to FIG. 32, another configuration of the riser system 100 is representatively and schematically illustrated, in which the injection conduit 11 is connected to the drilling fluid return line 342. Thus, instead of injecting the fluid composition 150 directly into the annular space 228 or flow passage 204 in the riser string 206, in the configuration of FIG. 32 the fluid composition is injected into the drilling fluid return line 342.

In this manner, problems associated with, e.g., forming gas slugs in the riser string 206 may be avoided. The subsea choke 112, 117, 123 or 132 can still be used to regulate back pressure on the annular space 228 and, thus, the wellbore 346 (for example, during managed pressure drilling), and the benefits of dual density and dual gradient drilling can still be obtained, without flowing variable density fluids or gas through the subsea choke.

As depicted in FIG. 32, the fluid composition 150 is injected from the injection conduit 11 into the drilling fluid return line 342 downstream of the choke 117 and valves 115, 116 at outlet/inlet 44. However, this could be accomplished downstream of any of outlets/inlets 40, 45 or 54, as well.

In another feature of the configuration illustrated in FIG. 32, the fluid composition 150 may be injected into the drilling fluid return line 342 at various different points along the return line. Valves 374 are interconnected between the injection conduit 11 and the return line 342 at spaced apart locations along the return line. Thus, a large degree of flexibility is available in the riser system 100 for gas-lifting or otherwise utilizing dual density or dual gradient drilling techniques with all, or any portion of, the return line 342 between the outlet/inlet 44 and the surface rig structure 238.

The valves 374 may be controlled utilizing the subsea control system 142 described above. The injection system illustrated in FIG. 32 may take the place of the injection system 200 described above, or the two could operate in conjunction with each other. The injection system of FIG. 32 could utilize valves similar to the valves 3*a*, 3*b*, chokes similar to choke 14, non-return valves similar to the non-return valve 8, and sensors similar to the sensors 21 described above.

It may now be fully appreciated that the above description provides many improvements in the art of riser system construction, drilling methods, etc. The riser system 100 allows the tubular string 212 to be moved in and out of the well under pressure in a variety of different types of drilling operations, such as underbalanced (UBD), managed pressure (MPD) and normal drilling operations. The riser system 100 allows for various internal modules 202, 222, 224, 226 and anchoring device 210 to be run in on tubular string 212 and locked in place by hydraulic and/or mechanical means. The internal modules 202, 222, 224, 226 allow for annular isolation, well isolation, pipe rotation, diverting of flow, dynamic control of flow, and controlled fluid injection into the return line 342 and/or into the riser string 206.

The riser system 100 enables utilization of a pressurized riser in deepwater drilling operations where an intermediate flex joint FJ is required, and where a riser fill up valve is required.

The riser system 100 allows isolation of the wellbore 346 from the surface by closing the valve module 202. This permits introduction of long completion tool strings (such as the completion equipment 350), bottom hole assemblies, etc., while still maintaining multiple flowpaths back to surface to continue managed pressure drilling operations.

The riser system 100 permits flexibility in dual gradient, underbalanced, managed pressure and normal drilling operations with the ability to have chokes 112, 117, 123, 132 positioned subsea and in the return line 342, as well as the surface choke manifold CM. The subsea and surface choke systems can be linked and fully redundant. This removes the complexity of the dual gradient fluid (e.g., the fluid composition 150) being in the return line 342 during well control operations.

The riser system 100 allows dual gradient operations, without the drilling fluid having to be pumped to surface from the sea bed, removing the back pressure from the well, with the ability to have multiple injection points along the return line 342 to surface, and the flexibility to position the internal modules 202, 222, 224, 226 anywhere along the riser string 206 from the slip joint SJ to the lower marine riser package LMRP.

The riser system 100 has the capability of having multiple annular seal modules 222, 224, 226 installed in the riser string 206, in any combination thereof. The seals 216, 218, 220 in the modules 222, 224, 226 may be active or passive, control system or wellbore pressure operated, and rotating or static. The module housings 268, 280, 282, 284, 306 can accept modules provided by any manufacturer, which modules are appropriately configured for the respective internal profiles, seal bores, etc.

The riser system 100 allows for full bore access through the riser string 206 when the modules 202, 222, 224, 226 are removed, therefore, not imposing any restrictions on normal operations or procedures from a floating drilling vessel. In emergency situations, the modules 202, 222, 224, 226 can be quickly retrieved and an operator can run conventional hang-off tools through the riser string 206.

The riser system 100 allows all module housings 268, 280, 282, 284, 306 to be deployed through the rotary table RT as normal riser sections. There preferably is no need for personnel to make connections or install equipment in the moon pool area of a rig 238 for the riser system 100.

The riser system 100 provides for continuous monitoring of flow rates, pressures, temperatures, valve positions, choke positions, valve integrity (e.g., by monitoring pressure differential across valves) utilizing sensors 21, 111, 118, 124, 131, 340, 336, 338, 230. The sensors are connected to subsea and surface control systems 119, 120, 304, 142, 18, 19 for monitoring and control of all significant aspects of the riser system 100.

The riser system 100 can accept deployment of an inner riser 36, if needed for increasing the pressure differential capability of the riser string 206 below the annular seal modules 222, 224, 226.

The riser system 100 can utilize protective sleeves 35, 48 to protect ports and seal bores 328, 330, 332, 334, 360 in the riser string 206 when the respective modules are not installed. The inner diameters of the protective sleeves 35, 48 are preferably at least as great the inner diameter of the conventional riser joints used in the riser string 206.

The riser system 100 permits the annular seal modules 222, 224 and/or 226 to be installed in any order, and in any combination. The annular seal modules 222, 224 and/or 226 can all be positioned below the slip joint SJ.

The latching profiles 358, 262, 266, 264 or latch actuators 278 and profiles 270, 272, 274, 276, and seal bores 328, 330, 332, 334, 360 can be standardized to allow interchangeability between different modules and different types of modules.

The valve module 202 may be used in conjunction with a blind BOP at the wellhead structure 236 and/or a BOP module 42 in the riser system 100 for redundant isolation between the wellbore 346 and the surface in the riser string 206.

In particular, the above description provides a riser system 100 which may include a valve module 202 which selectively permits and prevents fluid flow through a flow passage 204 extending longitudinally through a riser string 206.

An anchoring device 208 can releasably secure the valve module 202 in the flow passage 204. The anchoring device 208 may be actuated from a subsea location exterior to the riser string 206.

Another anchoring device 210 may releasably secure a tubular string 212 in the flow passage 204. The anchoring device 210 may prevent displacement of the tubular string 212 relative to the riser string 206 when pressure is increased in a portion of the riser string between the valve module 202 and a seal 214, 216, 218 or 220 between the tubular string 212 and the riser string 206.

An annular seal module 222, 224 or 226 may seal an annular space 228 between the riser string 206 and the tubular string 212. The anchoring device 210 may prevent displacement of the tubular string 212 relative to the riser string 206 when pressure is increased in a portion of the riser string between the valve module 202 and the annular seal module 222, 224 or 226.

As discussed above, the riser system 100 may include one or more annular seal modules 222, 224, 226 which seal the annular space 228 between the riser string 206 and a tubular string 212 in the flow passage 204. The annular seal module 222, 224 or 226 may include one or more seals 216, 218, 220 which seal against the tubular string 212 while the tubular string rotates within the flow passage 204. The seal 216, 218 may rotate with the tubular string 212. The seal 220 may remain stationary within the riser string 206 while the tubular string 212 rotates within the seal 220. The seal 218 may be selectively radially extendable into sealing contact with the tubular string 212.

The riser system 100 may include at least one sensor 230 which senses at least one parameter for monitoring operation of the valve module 202.

A method of pressure testing a riser string 206 has been described which may include the steps of: installing a valve module 202 into an internal longitudinal flow passage 204 extending through the riser string 206; closing the valve module 202 to thereby prevent fluid flow through the flow passage 204; and applying a pressure differential across the closed valve module 202, thereby pressure testing at least a portion of the riser string 206.

The installing step may include securing the valve module 202 in a portion of the flow passage 204 disposed between opposite end connections 232, 234 of the riser string 206. The lower end connection 234 may secure the riser string 206 to a subsea wellhead structure 236, and the upper end connection 232 may secure the riser string 206 to a rig structure 238. The upper end connection 232 may rigidly secure the riser string 206 to the rig structure 238.

The method may further include the step of installing an annular seal module 222, 224 or 226 into the flow passage 204, with the annular seal module being operative to seal an annular space 228 between the riser string 206 and a tubular string 212 positioned within the flow passage 204. The pressure differential applying step may include increasing pressure in the flow passage 204 between the valve module 202 and the annular seal module 222, 224 or 226.

The method may further include the step of installing another annular seal module 222, 224 or 226 into the flow passage 204, with the second annular seal module being operative to seal the annular space 228 between the riser string 206 and the tubular string 212 positioned within the flow passage 204. The pressure differential applying step may further include increasing pressure in the flow passage 204 between the valve module 202 and the second annular seal module 222, 224 or 226.

The method may further include the step of increasing pressure in the riser string 206 between the first and second annular seal modules 222, 224 and/or 226, thereby pressure testing the riser string between the first and second annular seal modules.

In the pressure differential applying step, the portion of the riser string 206 which is pressure tested may be between the valve module 202 and an end connection 234 of the riser string 206 which is secured to a wellhead structure 236.

The method may also include the steps of: conveying a tubular string 212 into the flow passage 204; and sealing and securing the tubular string at a position in the flow passage, so that fluid flow is prevented through an annular space 228 between the riser string 206 and the tubular string 212, and the pressure differential applying step may further include applying increased pressure via the tubular string 212 to the portion of the riser string 206 which is disposed between the valve module 202 and the position at which the tubular string 212 is sealed and secured in the flow passage 204.

The method may further include the step of utilizing at least one sensor 111, 118, 124 and/or 131 to monitor pressure within the riser portion during the pressure differential applying step.

Also described above is a method of constructing a riser system 100. The method may include the steps of: installing a valve module 202 in a flow passage 204 extending longitudinally through a riser string 206, the valve module 202 being operative to selectively permit and prevent fluid flow through the flow passage 204; and installing at least one annular seal module 222, 224 and/or 226 in the flow passage 204, the annular seal module being operative to prevent fluid flow through an annular space 228 between the riser string 206 and a tubular string 212 positioned in the flow passage 204.

The method may include the steps of providing an internal location 240 for sealing and securing the valve module 202 in the flow passage 204, and providing another location 242, 244 and/or 246 for sealing and securing the annular seal module 222, 224, 226 in the flow passage, and wherein a minimum internal dimension ID of the riser string 206 at each of these locations 240, 242, 244, 246 is at least as great as a minimum internal dimension of the riser string between opposite end connections 232, 234 of the riser string.

The valve module 202 and annular seal module 222, 224, 226 installing steps may also each include actuating an anchoring device 208, 248, 250, 252 to secure the respective module relative to the riser string 206. The actuating step may include engaging a latch member 254, 256, 258, 260 of the respective module 202, 222, 224, 226 with a corresponding internal profile 262, 264, 266 formed in the riser string 206. The actuating step may include displacing a respective latch member 254, 256, 258, 260 into engagement with a corresponding external profile 270, 272, 274, 276 formed on the respective module 202, 222, 224, 226, and wherein a respective actuator 278 on an exterior of the riser string 206 causes displacement of the respective latch member 254, 256, 258, 260.

The method may include the steps of: interconnecting a valve module housing 280 as part of the riser string 206; and interconnecting an annular seal module housing 282, 284 and/or 306 as part of the riser string. Each of the interconnecting steps may include displacing the respective module housing 280, 282, 284, 306 through a rotary table RT. The displacing step may include displacing the respective module housing 280, 282, 284, 306 through the rotary table RT with at least one of a valve 113, 114, 115, 116, 121, 122, 133 and/or 134 and an accumulator 56 externally connected to the respective module housing 280, 282, 284, 306.

The riser string 206 may include a portion 308 or section 30 having at least one valve 310, 113, 114, 115, 116, 121, 122, 133 and/or 134, at least one accumulator 312 and/or 56, and at least one actuator 314 and/or 278 externally connected to the riser portion for operation of the valve and annular seal modules 202, 222, 224 and/or 226. The method may also include the step of displacing the riser portion 308 or section 30 with the externally connected valve 310, 113, 114, 115, 116, 121, 122, 133 and/or 134, accumulator 312 and/or 56 and actuator 314 and/or 278 through a rotary table RT.

The method may include the steps of connecting hydraulic control lines 90, 316, 318 externally to the riser string 206 for operation of the valve and annular seal modules 202, 222, 224 and/or 226, and connecting the hydraulic control lines to a subsea hydraulic control system 304 external to the riser string 206. The method may also include the step of replacing the hydraulic control system 304 using a subsea remotely operated vehicle 320.

The method may include the step of connecting a hydraulic supply line 90 and an electrical control line 89 between the subsea hydraulic control system 304 and a surface hydraulic control system 18. Signals for operating the subsea hydraulic control system 304 to selectively supply hydraulic fluid to operate the valve and annular seal modules 202, 222, 224 and/or 226 may be multiplexed on the electrical control line 89.

The method may include the step of connecting at least one lubrication supply line 53 or 322 externally to the riser string 206 for lubricating a bearing assembly 324 of the annular seal module 222, 224. The method may include the step of connecting at least one lubrication return line 326 externally to the riser string 206 for returning lubricant from the bearing assembly 324.

The annular seal module 222, 224, 226 includes at least one seal 216, 218, 220 which seals against the tubular string 212 while the tubular string rotates within the flow passage 204. The seal 216 or 218 may rotate with the tubular string 212. The seal 220 may remain stationary within the riser string 206 while the tubular string 212 rotates within the seal 220. The seal 218 may be selectively radially extendable into sealing contact with the tubular string 212.

The valve and annular seal module 202, 222, 224, 226 installing steps may include sealing the respective module in a corresponding seal bore 328, 330, 332, 334 formed in the riser string 206. The method may further include the steps of retrieving a respective seal bore protector sleeve 35, 48 from within the corresponding seal bore 328, 330, 332, 334 prior to the steps of installing the respective one of the valve and annular seal modules 202, 222, 224, 226.

The method may include the step of retrieving a seal bore protector sleeve 35, 48 from within the riser string 206 prior to the step of installing the valve module 202. The method may include the step of retrieving a seal bore protector sleeve 35, 48 from within the riser string 206 prior to the step of installing the annular seal module 222, 224, 226.

The method may include utilizing at least one sensor 111, 118, 124, 131 to monitor pressure in the flow passage 204 between the valve module 202 and the annular seal module 222, 224 or 226. The method may include utilizing at least one sensor 230, 336, 338, 340 to monitor at least one parameter indicative of a performance characteristic of at least one of the valve and annular seal modules 202, 222, 224, 226.

A drilling method is also described which may include the steps of: connecting an injection conduit 11 externally to a riser string 206, so that the injection conduit is communicable with an internal flow passage 204 extending longitudinally through the riser string 206; installing an annular seal module 222, 224, 226 in the flow passage 204, the annular seal module being positioned in the flow passage between opposite end connections 232, 234 of the riser string 206; conveying a tubular string 212 into the flow passage 204; sealing an annular space 228 between the tubular string 212 and the riser string 206 utilizing the annular seal module 222, 224, 226; rotating the tubular string 212 to thereby rotate a drill bit 348 at a distal end of the tubular string, the annular seal module 222, 224, 226 sealing the annular space 228 during the rotating step; flowing drilling fluid 81 from the annular space 228 to a surface location; and injecting a fluid composition 150 having a density less than that of the drilling fluid into the annular space 228 via the injection conduit 11.

In the injecting step, the fluid composition 150 may include Nitrogen gas. The fluid composition 150 may include hollow glass spheres. The fluid composition 150 may include a mixture of liquid and gas.

The riser string 206 may include a portion 1 having at least one valve 8, 3*a*, 3*b*, 6*a*, 6*b* at least one accumulator 5, 15, and at least one actuator 4*a*, 4*b* externally connected to the riser portion 1 for controlling injection of the fluid composition 150. The method may include displacing the riser portion 1 with the externally connected valve 8, 3*a*, 3*b*, 6*a*, 6*b* accumulator 5, 15 and actuator 4*a*, 4*b*, through a rotary table RT.

The method may include the steps of connecting hydraulic control lines 7, 9, 17 externally to the riser string 84, 206 for controlling injection of the fluid composition 150, and connecting the hydraulic control lines to a subsea hydraulic control system 142 external to the riser string 84, 206. The method may include replacing the hydraulic control system 142 utilizing a subsea remotely operated vehicle 320. The method may include connecting a hydraulic supply line 9 and an electrical control line 20 between the subsea hydraulic control system 142 and a surface hydraulic control system 18. Signals for operating the subsea hydraulic control system 142 to selectively supply hydraulic fluid to control injection of the fluid composition 150 may be multiplexed on the electrical control line 20.

The method may include utilizing at least one sensor 21 to monitor pressure in the injection conduit 11.

A drilling method is also described which may include the steps of: connecting a drilling fluid return line 88, 194, 342 externally to a riser string 84, 206, so that the drilling fluid return line is communicable with an internal flow passage 204 extending longitudinally through the riser string; installing an annular seal module 222, 224, 226 in the flow passage 204, the annular seal module being positioned in the flow passage between opposite end connections 232, 234 of the riser string; conveying a tubular string 212 into the flow passage 204; sealing an annular space 228 between the tubular string 212 and the riser string 206 utilizing the annular seal module 222, 224, 226; rotating the tubular string 212 to thereby rotate a drill bit 348 at a distal end of the tubular string, the annular seal module 222, 224, 226 sealing the annular space 228 during the rotating step; and flowing drilling fluid 81 from the annular space 228 to a surface location via the drilling fluid return line 342, the flowing step including varying a flow restriction through a subsea choke 112, 117, 123, 132 externally connected to the riser string 206 to thereby maintain a desired downhole pressure.

The step of varying the flow restriction may include automatically varying the flow restriction without human intervention to thereby maintain the desired downhole pressure.

The riser string 206 may include a portion 308 having at least one valve 310, at least one accumulator 312, and at least one actuator 314 externally connected to the riser portion for operating the subsea choke 112, 117, 123, 132. The method may further include displacing the riser portion 308 with the externally connected valve 310, accumulator 312 and actuator 314 through a rotary table RT.

The method may include connecting hydraulic control lines 87, 93 externally to the riser string 84, 206 for controlling operation of the choke 112, 117, 123, 132, and connecting the hydraulic control lines to a subsea hydraulic control system 119, 120 external to the riser string 84, 206. The method may include connecting the hydraulic control line 87, 93 and at least one electrical control line 186, 192 between the subsea hydraulic control system 119, 120 and a surface hydraulic control system 18. Signals for operating the subsea hydraulic control system 119, 120 to selectively supply hydraulic fluid to control operation of the choke 112, 117, 123, 132 may be multiplexed on the electrical control line 186, 192.

The method may include utilizing at least one sensor 111, 118, 124, 131 to monitor pressure in the drilling fluid return line 88, 194.

Another drilling method is described which may include the steps of: installing a first annular seal module 222, 224 or 226 in an internal flow passage 204 extending longitudinally through a riser string 206, the first annular seal module being secured in the flow passage between opposite end connections 232, 234 of the riser string; sealing an annular space 228 between the riser string 206 and a tubular string 212 in the flow passage 204 utilizing the first annular seal module 222, 224 or 226, the sealing step being performed while the tubular string rotates within the flow passage; and then conveying a second annular seal module 222, 224 or 226 into the flow passage 204 on the tubular string 212.

The tubular string 212 may remain in the flow passage 204 between the opposite end connections 232, 234 of the riser string 206 continuously between the sealing and conveying steps.

The method may include sealing the annular space 228 between the riser string 206 and the tubular string 212 in the flow passage 204 utilizing the second annular seal module 222, 224 or 226, while the tubular string rotates within the flow passage.

The second annular seal module 222, 224 or 226 may include at least one seal 216, 218, 220 which seals against the tubular string 212 while the tubular string rotates within the flow passage 204. The seal 216, 218 may rotate with the tubular string 212. The seal 220 may remain stationary within the riser string 206 while the tubular string 212 rotates within the seal. The seal 218 may be selectively radially extendable into sealing contact with the tubular string 212.

The method may include utilizing at least one sensor 118, 124, 131 to monitor pressure in the flow passage 204 between the first and second annular seal modules 222, 224, 226.

A further method is described which may include the steps of: installing multiple modules 202, 222, 224 and/or 226 in an internal flow passage 204 extending longitudinally through a riser string 206, the modules being installed in the flow passage between opposite end connections 232, 234 of the riser string; inserting a tubular string 212 through an interior of each of the modules 202, 222, 224 and/or 226; and then simultaneously retrieving the multiple modules 202, 222, 224 and/or 226 from the flow passage 204 on the tubular string 212.

The retrieving step may include operating anchoring devices 208, 248, 250, 252 for the respective modules to thereby release the modules 202, 222, 224, 226 for displacement relative to the riser string 206. Each of the anchoring devices 208, 248, 250, 252 may include an actuator 278 externally connected to the riser string 206. At least one of the anchoring devices 278 may be operable by a subsea remotely operated vehicle 320 from an exterior of the riser string 206.

The modules 202, 222, 224, 226 may include at least one annular seal module 222, 224, 226 which seals an annular space 228 between the tubular string 212 and the riser string 206. The modules 202, 222, 224, 226 may include at least one valve module 202 which selectively permits and prevents fluid flow through the flow passage 204.

A drilling method is described above which includes the steps of: sealing an annular space 228 between a tubular string 212 and a riser string 206; flowing drilling fluid from the annular space to a surface location via a drilling fluid return line 342; and injecting a fluid composition 150 having a density less than that of the drilling fluid into the drilling fluid return line via an injection conduit 11.

The fluid composition 150 may include Nitrogen gas, hollow glass spheres and/or a mixture of liquid and gas.

The injecting step may include selecting from among multiple connection points between the drilling fluid return line 342 and the injection conduit 11 for injecting the fluid composition 150 into the drilling fluid return line.

The method may include the steps of connecting hydraulic control lines 7, 9, 17 externally to the riser string 206 for controlling injection of the fluid composition 150, and connecting the hydraulic control lines to a subsea hydraulic control system 142 external to the riser string 206.

The injecting step may include injecting the fluid composition 150 into the drilling fluid return line 342 downstream from a subsea choke 112, 117, 123 or 132 which variably regulates flow through the drilling fluid return line. The injecting step may include injecting the fluid composition 150 into the drilling fluid return line 342 at a position between a surface location and a subsea choke 112, 117, 123 or 132 interconnected in the drilling fluid return line.

A drilling method described above includes the steps of: installing an annular seal module 222, 224 or 226 in an internal flow passage 204 extending longitudinally through a riser string 206, the annular seal module being secured in the flow passage between opposite end connections 232, 234 of the riser string; then conveying a second annular seal module 222, 224 or 226 into the flow passage 204; and sealing an annular space 228 between the riser string and a tubular string 212 in the flow passage utilizing the first and second annular seal modules.

The sealing step may include sealing the annular space 228 between the riser string 206 and the tubular string 212 in the flow passage 204 utilizing the first and second annular seal modules 222, 224, 226 while the tubular string rotates within the flow passage.

Each of the annular seal modules may include at least one seal 216, 218, 220 which seals against the tubular string 212 while the tubular string rotates within the flow passage 204. The seal 216, 218 may rotate with the tubular string 212. The seal 220 may remain stationary within the riser string 206 while the tubular string 212 rotates within the seal. The seal 218 may be selectively radially extendable into sealing contact with the tubular string 212.

The method may include the step of utilizing at least one sensor 118, 124, 131 to monitor pressure in the flow passage between the first and second annular seal modules 222, 224, 226.

Another drilling method described above includes the steps of: installing an annular seal module 222, 224, 226 in an internal flow passage 204 extending longitudinally through a riser string 206, the annular seal module being secured in the flow passage between opposite end connections 232, 234 of the riser string; then conveying on a tubular string 212 at least one seal 216, 218, 220 into the annular seal module 222, 224, 226; and sealing an annular space 228 between the riser string 206 and the tubular string 212 in the flow passage 204 utilizing the seal 216, 218, 220, the sealing step being performed while a drill bit 348 on the tubular string 212 is rotated.

The method may also include the steps of installing another annular seal module 222, 224, 226 in the flow passage 204, and then conveying on the tubular string 212 at least one other seal 216, 218, 220 into the second annular seal module.

The method may also include the step of sealing the annular space 228 between the riser string 206 and the tubular string 212 in the flow passage 204 utilizing the first annular seal module 222, 224, 226, while the drill bit 348 rotates.

The first seal 216, 218, 220 may seal against the tubular string 212 while the drill bit 348 rotates. The first seal 216, 218, 220 may rotate with the tubular string 212 while the tubular string rotates with the drill bit 348. The first seal 216, 218, 220 may remain stationary within the riser string 206 while the tubular string 212 rotates within the first seal. The first seal 216, 218, 220 may be selectively radially extendable into sealing contact with the tubular string 212.

The method may include the step of retrieving on the tubular string 212 the first seal 216, 218, 220 from the riser string 206.

The tubular string 212 may or may not rotate during drilling operations. For example, if a mud motor (which rotates a drill bit on an end of a tubular string in response to circulation of mud or other drilling fluid through the motor) is used, drilling operations can be performed without rotating the tubular string 212. The annular seal modules 222, 224, 226 can seal off the annular space 228 whether or not the tubular string 212 rotates during drilling, completion, stimulation, etc. operations.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method comprising the steps of:

installing at least one annular seal module and at least one valve module within an internal flow passage extending longitudinally through a riser string, the modules being installed within the flow passage between opposite end connections of the riser string, wherein the annular seal module includes a seal which seals an annular space between a tubular string and the riser string, and wherein the valve module includes a valve which selectively permits and prevents fluid flow through the flow passage;

inserting the tubular string through an interior of each of the modules; and then simultaneously retrieving the modules from the flow passage on the tubular string.

2. The method of claim 1, wherein the retrieving step further comprises operating anchoring devices for the respective modules to thereby release the modules for displacement relative to the riser string.

3. The method of claim 2, wherein each of the anchoring devices includes an actuator externally connected to the riser string.

4. The method of claim 2, wherein at least one of the anchoring devices is operable by a subsea remotely operated vehicle from an exterior of the riser string.

* * * * *